US010646057B2

(12) United States Patent
Charlier et al.

(10) Patent No.: US 10,646,057 B2
(45) Date of Patent: May 12, 2020

(54) ADJUSTABLE BREATH GUARD

(71) Applicant: The Vollrath Company, L.L.C., Sheboygan, WI (US)

(72) Inventors: David Charlier, Sheboygan, WI (US); Robert Hebel, New London, WI (US); Jill Hundley, Sheboygan, WI (US); Andrew Laures, Cleveland, WI (US)

(73) Assignee: The Vollrath Company, L.L.C., Sheboygan, WI (US)

( * ) Notice: Subject to any disclaimer, the term of this patent is extended or adjusted under 35 U.S.C. 154(b) by 0 days.

(21) Appl. No.: 16/161,498

(22) Filed: Oct. 16, 2018

(65) Prior Publication Data

US 2019/0110613 A1 Apr. 18, 2019

Related U.S. Application Data

(60) Provisional application No. 62/573,011, filed on Oct. 16, 2017.

(51) Int. Cl.

| | |
|---|---|
| ***A47F 10/06*** | (2006.01) |
| ***A47F 3/00*** | (2006.01) |
| ***A47F 3/12*** | (2006.01) |

(52) U.S. Cl.

CPC ..... *A47F 10/06* (2013.01); *A47F 3/007* (2013.01); *A47F 3/004* (2013.01); *A47F 3/12* (2013.01);

(Continued)

(58) Field of Classification Search

CPC .. A47F 10/06; A47F 3/007; A47F 3/12; A47F 2003/008; A47F 3/004; A47F 2010/065

See application file for complete search history.

(56) References Cited

U.S. PATENT DOCUMENTS 1,431,371 A * 10/1922 Chapman ..... A47F 3/12 312/114
1,644,675 A * 10/1927 Huening ..... A47F 3/12 312/114

(Continued)

FOREIGN PATENT DOCUMENTS

DE 10320528 A1 12/2004
JP 2007-159882 A 6/2007

OTHER PUBLICATIONS

BSI: Deco Engineered Food Shields, Model: DECO-250-N, Apr. 30, 2017 (Apr. 30, 2017), XP055544067, Retrieved from the Internet: URL:https://assetcloud.roccommerce.net//files/_singer/4/10/8/10004447_spec_sheet.pdf.

(Continued)

*Primary Examiner* — Hanh V Tran
(74) *Attorney, Agent, or Firm* — Foley & Lardner LLP

(57) ABSTRACT

A breath guard includes a first support, a second support, a guide rail coupled to the first support and extending in a substantially longitudinal direction, the guide rail including a rack defining a series of teeth, an adjustable panel extending between the first support and the second support, and an adjustment mechanism including a pawl rotatably coupled to the adjustable panel and configured to selectively engage the teeth of the rack. The adjustable panel is rotatable relative to the guide rail about an axis of rotation that extends laterally. The adjustment mechanism is configured to prevent longitudinal movement of the adjustable panel relative to the guide rail in a first direction and allow longitudinal movement of the adjustable panel in a second direction when the pawl engages the teeth of the rack, such that the adjustable panel is selectively repositionable between a series of longitudinal positions.

20 Claims, 56 Drawing Sheets

(52) U.S. Cl.
CPC ... *A47F 2003/008* (2013.01); *A47F 2010/065* (2013.01)

(56) References Cited

U.S. PATENT DOCUMENTS

| | | | | |
|---|---|---|---|---|
| 1,725,867 | A * | 8/1929 | Kennedy | A47F 3/12 312/139.1 |
| 3,554,416 | A | 1/1971 | Bott | |
| 4,448,337 | A | 5/1984 | Cronce | |
| 4,469,261 | A | 9/1984 | Stapleton et al. | |
| 4,500,020 | A | 2/1985 | Rasor | |
| 4,660,885 | A | 4/1987 | Suhr et al. | |
| 6,132,018 | A | 10/2000 | McGrath | |
| 6,390,424 | B1 | 5/2002 | Kidushim et al. | |
| 6,485,118 | B2 | 11/2002 | Matus, Jr. | |
| D472,083 | S | 3/2003 | English et al. | |
| 6,588,863 | B1 | 7/2003 | Yatchak et al. | |
| D497,739 | S | 11/2004 | English et al. | |
| 7,040,723 | B2 | 5/2006 | Matus, Jr. | |
| 7,210,742 | B2 | 5/2007 | Wu | |
| D575,560 | S | 8/2008 | English | |
| 7,640,696 | B2 | 1/2010 | Yingst | |
| 7,958,673 | B2 | 6/2011 | Yingst et al. | |
| D649,865 | S | 12/2011 | English et al. | |
| 8,109,579 | B2 | 2/2012 | English et al. | |
| 8,128,306 | B2 | 3/2012 | Gorza | |
| 8,302,919 | B1 | 11/2012 | McGrath | |
| 8,308,249 | B2 | 11/2012 | Matus, Jr. | |
| 8,403,430 | B2 | 3/2013 | Atkins | |
| 8,585,160 | B2 | 11/2013 | Atkins | |
| 8,671,618 | B2 | 3/2014 | Yingst et al. | |
| 8,925,172 | B2 | 1/2015 | English | |
| 8,973,876 | B1 | 3/2015 | McGrath | |
| 9,010,883 | B2 | 4/2015 | Scott | |
| 9,062,483 | B1 | 6/2015 | McGrath | |
| 9,291,188 | B2 | 3/2016 | English | |
| D756,759 | S | 5/2016 | Atkins et al. | |
| 9,326,621 | B1 | 5/2016 | McAllister et al. | |
| 9,339,131 | B1 | 5/2016 | Christianson | |
| 2003/0057810 | A1 | 3/2003 | Dewitt | |
| 2004/0226903 | A1 | 11/2004 | Wang | |
| 2006/0163976 | A1 | 7/2006 | Matus, Jr. | |
| 2006/0175940 | A1 | 8/2006 | English | |
| 2006/0192467 | A1 | 8/2006 | Matus, Jr. | |
| 2007/0236112 | A1 | 10/2007 | Williman | |
| 2011/0080075 | A1* | 4/2011 | Matus, Jr. | A47F 3/007 312/140.4 |
| 2011/0169384 | A1 | 7/2011 | Padden et al. | |
| 2014/0366751 | A1 | 12/2014 | Atkins et al. | |
| 2016/0073795 | A1 | 3/2016 | Matus, Jr. | |
| 2018/0242760 | A1* | 8/2018 | Cummings | A47F 3/007 |
| 2019/0110614 | A1* | 4/2019 | Charlier | A47F 10/06 |

OTHER PUBLICATIONS

International Search Report and Written Opinion of the International Searching Authority for PCT/US2018/000384 dated Jan. 28, 2019.

* cited by examiner

ADJUSTABLE BREATH GUARD

CROSS-REFERENCE TO RELATED PATENT APPLICATIONS

This application claims the benefit of U.S. Provisional Patent Application No. 62/573,011, filed Oct. 16, 2017, which is incorporated herein by reference in its entirety.

BACKGROUND

The present invention relates generally to the field of food serving systems and, in particular, to the field of breath guards for food serving systems.

Conventional food serving systems include a base that houses a number of pans or other containers configured to hold prepared food exposed to facilitate serving to a customer. The base may include heating and/or refrigeration components configured to keep the food at a desired serving temperature while the food is served to a customer. To protect the exposed food, the food serving systems conventionally include a breath or sneeze guard coupled to the top of the base. Breath guards conventionally include one or more transparent panels that extend between a customer and the food. The breath guard provides a barrier between the customer and the prepared food in order to prevent potential contamination and maintain a healthy environment for both customers and foodservice staff.

Breath guards for food serving systems are configured differently depending upon the situation in which they are used. In a buffet setting, customers access food displayed in the food serving system from one or both of a front side and a back side of the food serving system. Accordingly, breath guards used in such situations leave at least one side facing the customer uncovered to facilitate access to the food. In a cafeteria setting, food service staff stand on one side of the food serving system and serve food to a customer located on the other side. In such a situation, the customer does not require access to the food serving system. Accordingly, breath guards used in such a situation block a front side that faces the customer to protect the food. Some conventional breath guards provide a single fixed configuration that is useful in either a buffet setting or a cafeteria setting. Such breath guards limit the food serving system from being used in multiple types of situations. Other types of conventional breath guards are adjustable. However, adjustment of such breath guards typically requires more than one operator, especially when the breath guard is configured to cover a large area. Accordingly, there is a need for a breath guard that can be easily reconfigured for use in both a buffet setting and a cafeteria setting by a single operator.

SUMMARY

At least one embodiment relates to a breath guard for a food serving system. The breath guard includes a first support and a second support positioned laterally offset from one another, a guide rail coupled to the first support and extending in a substantially longitudinal direction, the guide rail including a rack defining a series of teeth, an adjustable panel extending between the first support and the second support, and an adjustment mechanism including a pawl rotatably coupled to the adjustable panel and configured to selectively engage the teeth of the rack in a series of locations. The adjustable panel is rotatably and translatably coupled to the guide rail. The adjustable panel is rotatable relative to the guide rail about an axis of rotation that extends laterally. The adjustment mechanism is configured to prevent longitudinal movement of the adjustable panel relative to the guide rail in a first direction and allow longitudinal movement of the adjustable panel in a second direction opposite the first direction when the pawl engages the teeth of the rack, such that the adjustable panel is selectively repositionable between a series of longitudinal positions relative to the guide rail.

Another embodiment relates to a breath guard for a food serving system. The breath guard includes a first support and a second support positioned laterally offset from one another, a guide rail coupled to the first support and extending in a substantially longitudinal direction, an adjustable panel extending between the first support and the second support, an adjustment mechanism coupled to the adjustable panel and configured to selectively engage the guide rail in a series of locations, and a logic resetting protrusion coupled to the guide rail. The adjustable panel is rotatably and translatably coupled to the guide rail. The adjustment mechanism is selectively reconfigurable between an activated position and a deactivated position. The adjustable panel is rotatable relative to the guide rail about an axis of rotation that extends laterally. The adjustment mechanism is configured to engage the guide rail to prevent longitudinal movement of the adjustable panel relative to the guide rail in a first direction when the adjustment mechanism is in the activated position. The adjustment mechanism is configured to allow longitudinal movement of the adjustable panel in a second direction opposite the first direction when the adjustment mechanism is in the activated position. The adjustment mechanism is configured to permit movement of the adjustable panel in both the first direction and the second direction when the adjustment mechanism is in the deactivated position. The logic resetting protrusion is configured to move the adjustment mechanism toward the deactivated position when the adjustment mechanism engages the logic resetting protrusion.

Another embodiment relates to a breath guard for a food serving system. The breath guard includes a first support and a second support positioned laterally offset from one another, a guide rail coupled to the first support and extending in a substantially longitudinal direction, an adjustable panel extending between the first support and the second support, an adjustment mechanism coupled to the adjustable panel and configured to selectively engage the guide rail in a series of locations, a damping system including a snubber coupled to the guide rail. The adjustable panel is rotatably and translatably coupled to the guide rail. The adjustable panel is rotatable relative to the guide rail about an axis of rotation that extends laterally. The adjustment mechanism is configured to prevent longitudinal movement of the adjustable panel relative to the guide rail in a first direction and allow longitudinal movement of the adjustable panel in a second direction opposite the first direction when the adjustment mechanism engages the guide rail, such that the adjustable panel is selectively repositionable between a series of longitudinal positions relative to the guide rail. The adjustable panel is movable along a length of the guide rail within a longitudinal range. The snubber is configured to resist movement of the adjustable panel in the first direction when the adjustable panel is within a first portion of the longitudinal range.

BRIEF DESCRIPTION OF THE DRAWINGS

The invention will become more fully understood from the following detailed description, taken in conjunction with the accompanying drawings, in which.

DETAILED DESCRIPTION

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring to the Figures, a breath guard for a food serving system is shown according to various exemplary embodiments. In some embodiments, the breath guard includes 2 or more supports laterally offset from one another and an adjustable panel extending between the supports. Guide rails coupled to each of the supports extend longitudinally near the top of each support. Each guide rail includes a rack and a rack gear. A torsional member extends from the adjustable panel and is fixedly coupled to a pair of gears. The gears engage the rack gears such that the adjustable panel is rotatable and longitudinally translatable relative to the guide rails. Engagement between the rack gears and the gears prevents one side of the adjustable panel from moving longitudinally at a different rate than the opposite side of the adjustable panel. The adjustable panel is configured to selectively rest upon a boss extending from the support. Contact between the adjustable panel and the boss causes angular positioning of the adjustable panel relative to the guide rail. A pawl is rotatably coupled to the adjustable panel (e.g., indirectly through the torsional member) and configured to selectively engage the rack. When engaging the rack, the pawl prevents longitudinal motion of the adjustable panel in a first direction and allows longitudinal motion of the adjustable panel in a second direction. A pin extends laterally from the pawl, such that the adjustable panel engages the pin when rotated upward. Further upward movement of the adjustable panel past the point of engagement with the pin pushes the pawl out of engagement with the rack, allowing movement of the adjustable panel in both longitudinal directions.

Figure 1:
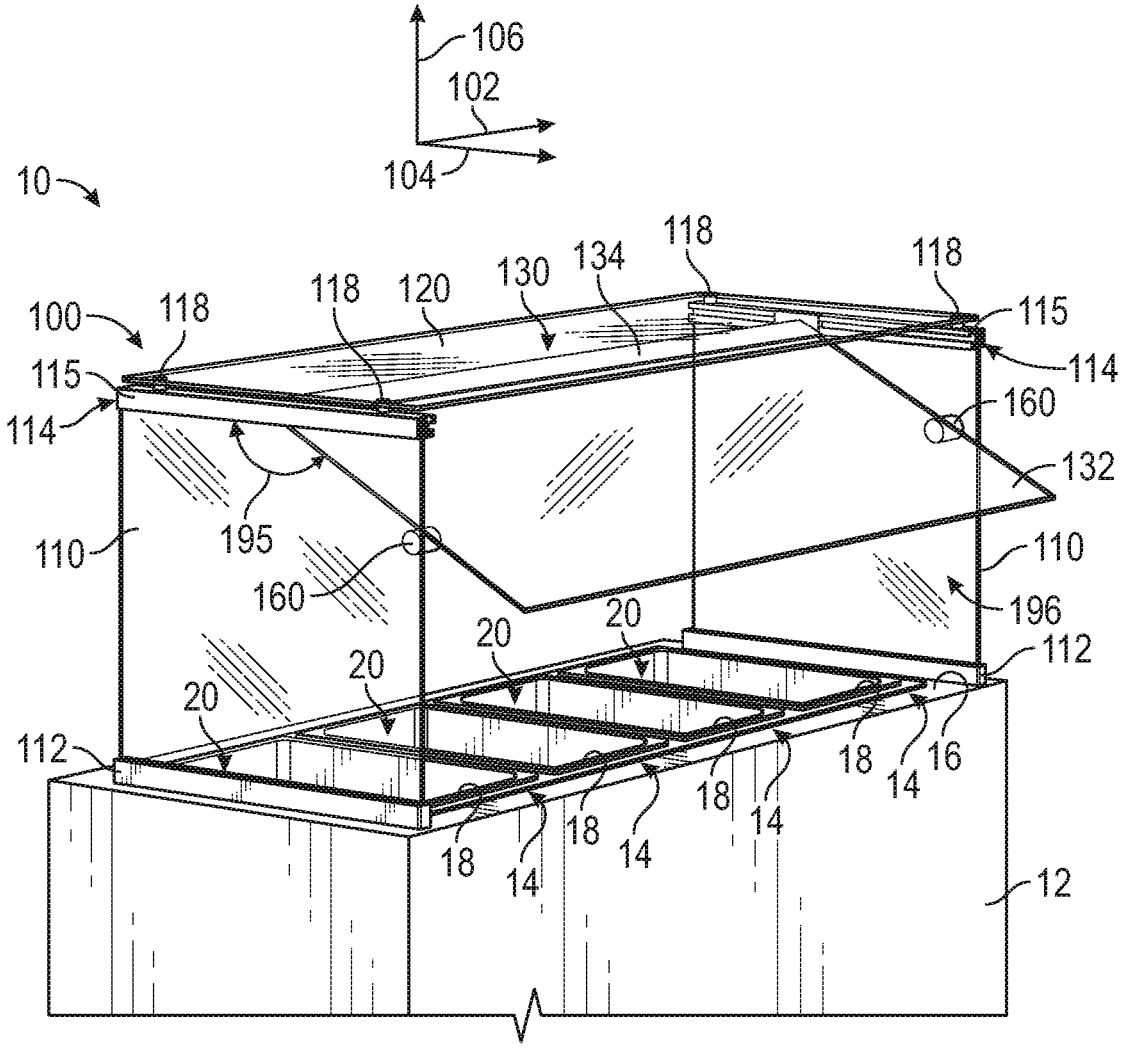
FIG. 1 is a perspective view of a food display system including a breath guard, according to an exemplary embodiment.

Referring to FIG. 1, a food serving system or food display system is shown as system 10 according to an exemplary embodiment. The system 10 includes a base 12 configured to support a series of pans or other containers, shown as food pans 14. The food pans 14 rest upon a top surface 16 of the base 12. In some embodiments, the top surface 16 of the base 12 is located at approximately waist height. The base 12 defines one or more wells or apertures in the top surface 16 configured to receive the food pans 14. The food pans 14 each include a lip 18 that is configured to rest upon the top surface 16. In other embodiments, the base 12 includes another type of food preparation or display surface, such as a counter or carving station.

Each of the food pans 14 are configured to receive prepared food (e.g., meats, ice cream, pasta, vegetables, etc.) within a depression 20. The size and shape of each depression 20 may be varied depending on the type of food that is received by the depression 20. The food may be kept at a warm temperature while serving or kept at a cold temperature while serving. Accordingly, the base 12 may include a heating mechanism (e.g., a resistance heater, a gas burner, etc.) and/or a cooling mechanism (e.g., a refrigeration circuit, etc.) to keep the food pans 14 at a desired temperature. In some embodiments, the base 12 includes a temperature sensor (e.g., configured to measure the temperature of one or more of the food pans 14) to facilitate closed loop temperature control. The base 12 may control the temperatures of the food pans 14 directly, or the base 12 may control the temperature of another medium (e.g., water) that contacts the food pans 14 to regulate the temperature of the food pans 14.

Referring again to FIG. 1, the system 10 includes an adjustable sneeze guard assembly, breath guard assembly, or food shield assembly, shown as breath guard 100. The breath guard 100 is coupled to the top surface 16 and extends upward from the top surface 16. Alternatively, the breath guard 100 may extend through or extend around the top surface 16 to couple to another portion of the base 12. The breath guard 100 is configured to act as a barrier between one or more users and the food pans 14, protecting the food held in the food pans 14 from contamination (e.g., from sneezing, from coughing, from breathing, from touching, etc.). The breath guard 100 is configured such that the area covered by the breath guard 100 is adjustable for use in multiple different situations. By way of example, breath guard 100 may be reconfigurable between a first configuration (e.g., a full-service or cafeteria configuration) where the breath guard 100 blocks access to the food pans 14 from a front side of the system 10 and a second configuration (e.g., a self-service or buffet configuration) where the breath guard 100 allows access from the front side, but blocks a portion of the front side to provide a shield between a customer and the food.

Referring again to FIG. 1, the breath guard 100 extends along a lateral axis 102, a longitudinal axis 104, and a vertical axis 106. The breath guard 100 includes a pair of supports, shown as side panels 110, each coupled to the top surface 16 by a bracket 112. The side panels 110 are spaced apart from one another laterally and extend vertically upward from the top surface 16. As shown in FIG. 1, the side panels 110 have a sufficient width to prevent access to the food pans 14 from the lateral sides of the base 12. In an alternative embodiment, the side panels 110 are significantly narrower than the lateral sides of the base 12 such that access to the food pans 14 from the lateral sides of the base 12 is minimally obstructed. The breath guard 100 may additionally or alternatively include one or more other supports, such as panels, rods, or tubular members (e.g., the frame members 220 shown in FIGS. 10 and 11). The brackets 112 are coupled (e.g., fastened, welded, adhered, etc.) to the base 12. By way of example, the brackets 112 may each define one or more protrusions that each extend into a corresponding aperture or channel defined by the base 12. The brackets 112 each define a longitudinally extending and upward facing groove or slot that receives a bottom end of one of the side panels 110. The brackets 112 each extend a distance (e.g., 1 inch, 2 inches, etc.) up the lateral sides (i.e., sides that extend perpendicular to the lateral axis 102) of the corresponding side panel 110. This facilitates transferring any moment loads caused by lateral forces into the base 12. The brackets 112 are coupled (e.g., fastened, adhered, etc.) to the bottom end of the corresponding side panel 110.

Figure 2:
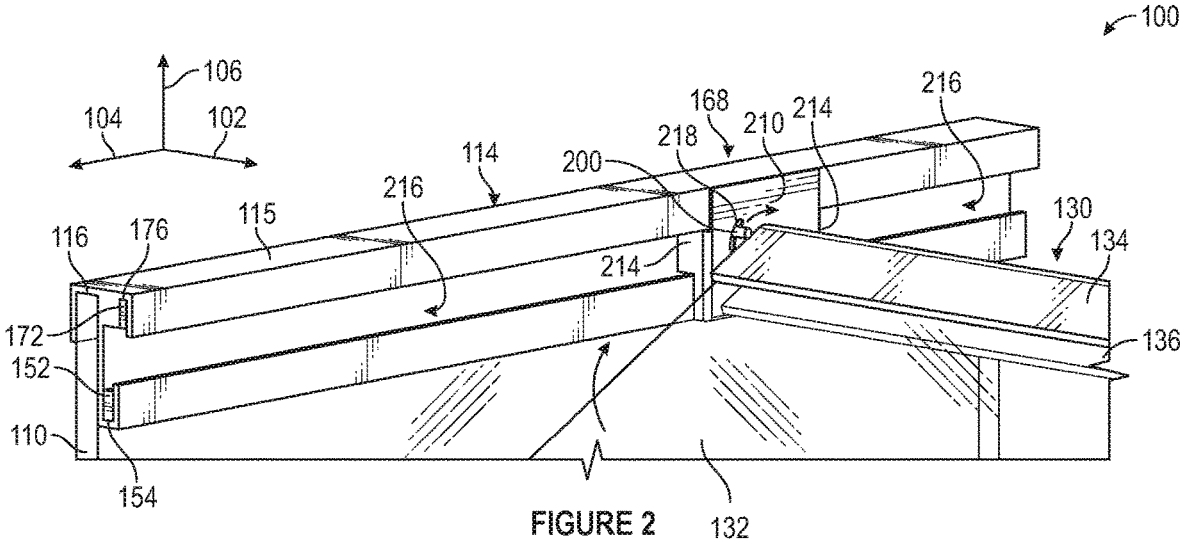
FIG. 2 is a perspective view of a guide rail and an adjustable panel of a breath guard, according to an exemplary embodiment.
Figure 3:
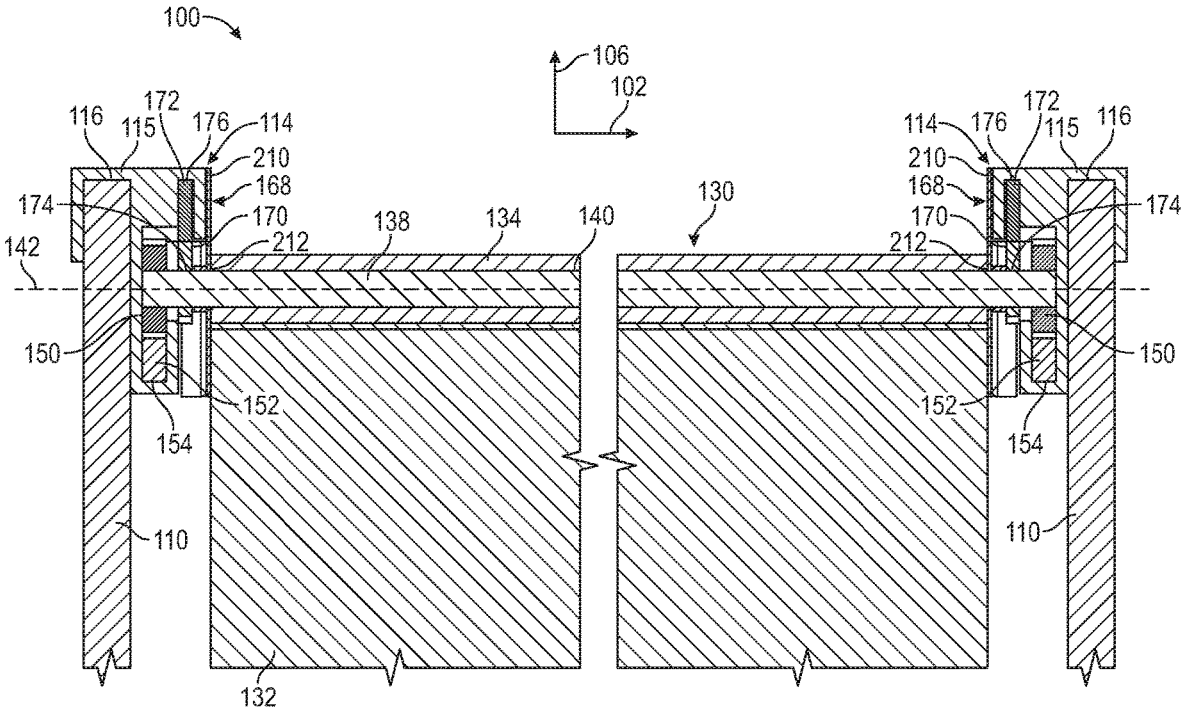
FIG. 3 is a front section view of the breath guard of FIG. 2.

Referring to FIGS. 1 and 2, a top end of each side panel 110 is coupled to a component or assembly, shown as guide rail system 114. Each guide rail system 114 includes a base member or track, shown as frame rail 115. As shown in FIG. 3, the frame rail 115 defines a first slot, groove, or pocket, shown as pocket 116. The pocket 116 opens downward to receive the top end of the side panel 110. Alternatively, each side panel 110 may be coupled to an exterior face of the corresponding guide rail system 114 (e.g., such that the guide rail system 114 sits flush to the top surface or a lateral side surface of the corresponding side panel 110, etc.). The guide rail systems 114 extend substantially parallel to the longitudinal axis 104 along a top surface of each side panel 110. As shown in FIG. 1, each guide rail system 114 includes a pair of protrusions or standoffs, shown as standoffs 118, coupled to and extending vertically upward from the corresponding frame rail 115. The standoffs 118 are received by corresponding apertures in a top panel 120, coupling (e.g., with fasteners, with adhesive, etc.) the top panel 120 to the side panels 110. In some embodiments, the top panel 120 is removable to facilitate cleaning. The top panel 120 protects food in the food pans 14 from contaminants originating directly above the food pans 14 and can be used as a shelf to support other items (e.g., cutlery, napkins, food products, etc.). Additionally, the top panel 120 structurally ties the side panels 110 together, improving the overall strength of the breath guard 100. In an alternative embodiment, the top panel 120 is omitted, facilitating access to the base 12 from directly above the breath guard 100.

Referring again to FIGS. 1 and 2, the breath guard 100 further includes an adjustable panel assembly, shown as adjustable panel 130. The adjustable panel 130 includes a shield or panel 132 and a bracket 134. The bracket 134 defines a first slot, groove, or pocket, shown as pocket 136. The pocket 136 is configured to receive a portion (e.g., 1.5 inches, 2 inches, etc.) of the top end of the panel 132. The panel 132 is coupled (e.g., adhered, fastened, etc.) to the bracket 134. In some embodiments, the panel 132 is removable from the bracket 134 (e.g., by loosening one or more fasteners, etc.) to facilitate cleaning. The adjustable panel 130 extends between the side panels 110, from the guide rail system 114 on one of the side panels 110 to the guide rail system 114 on the other of the side panels 110. Referring to FIG. 3, a torsional member or rod, shown as axle 138, extends laterally through an aperture 140 defined in the bracket 134. The axle 138 extends laterally outward from the bracket 134 and is received by the frame rail 115 (e.g., in the groove 216, shown in FIG. 2) on each lateral side of the adjustable panel 130. The adjustable panel 130 is configured to rotate relative to the axle 138 about an axis of rotation 142 extending laterally through the center of the axle 138 perpendicular to the guide rail systems 114. Accordingly, the bracket 134 may include bearings or bushings or may be made from a material different than that of the axle 138 to facilitate rotatably coupling the bracket 134 to the axle 138. In an alternative embodiment, the axle 138 is replaced by a pair of protrusions (e.g., bosses formed in the bracket 134, pins or rods received by the bracket 134, etc.) extending laterally outward from the bracket 134. Each protrusion may be received by one of the frame rails 115, similar to how the axle 138 is received by the frame rails 115. In another alternative embodiment, the bracket 134 includes two or more separate pieces. Each piece may be arranged to cover a span of the panel 132 near one of the guide rail systems 114 such that a span of the panel 132 near the center is not covered by the bracket 134. Each piece may define an aperture 140 configured to receive the axle 138, or each piece may include a protrusion extending therefrom that is received by the corresponding frame rail 115.

Figure 4:
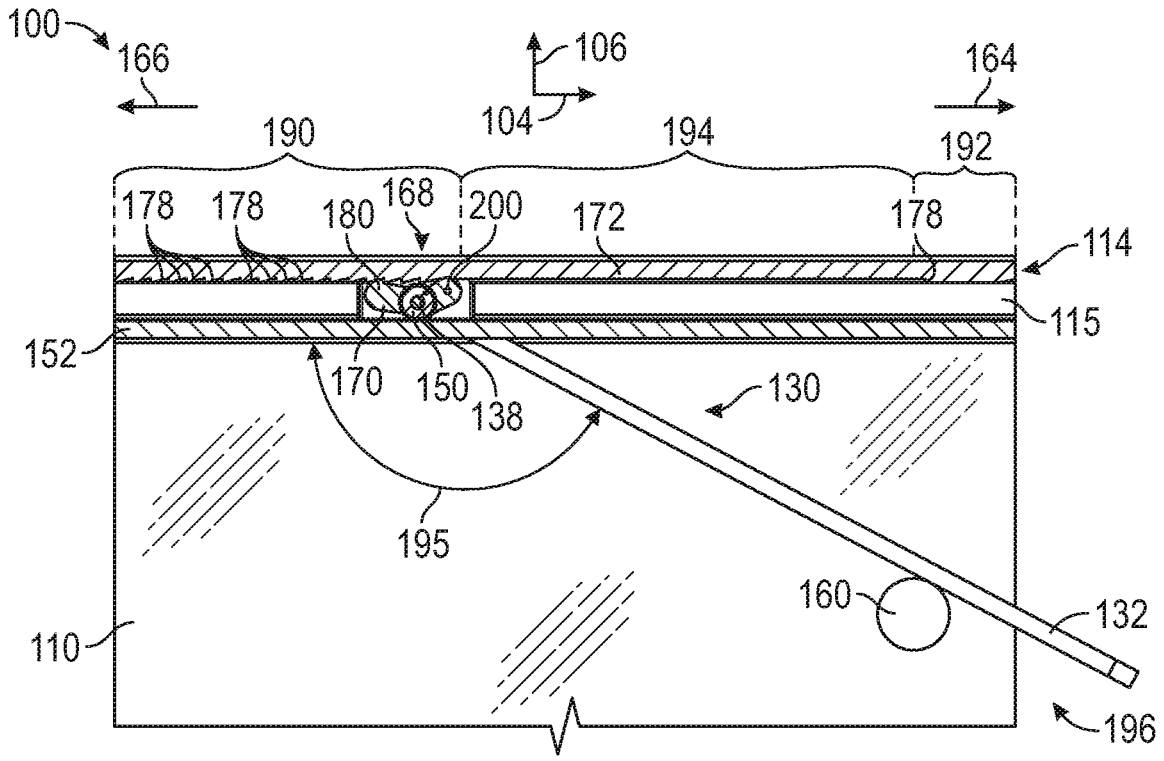
FIGS. 4 and 5 are side section views of the breath guard of FIG. 2.
Figure 5:
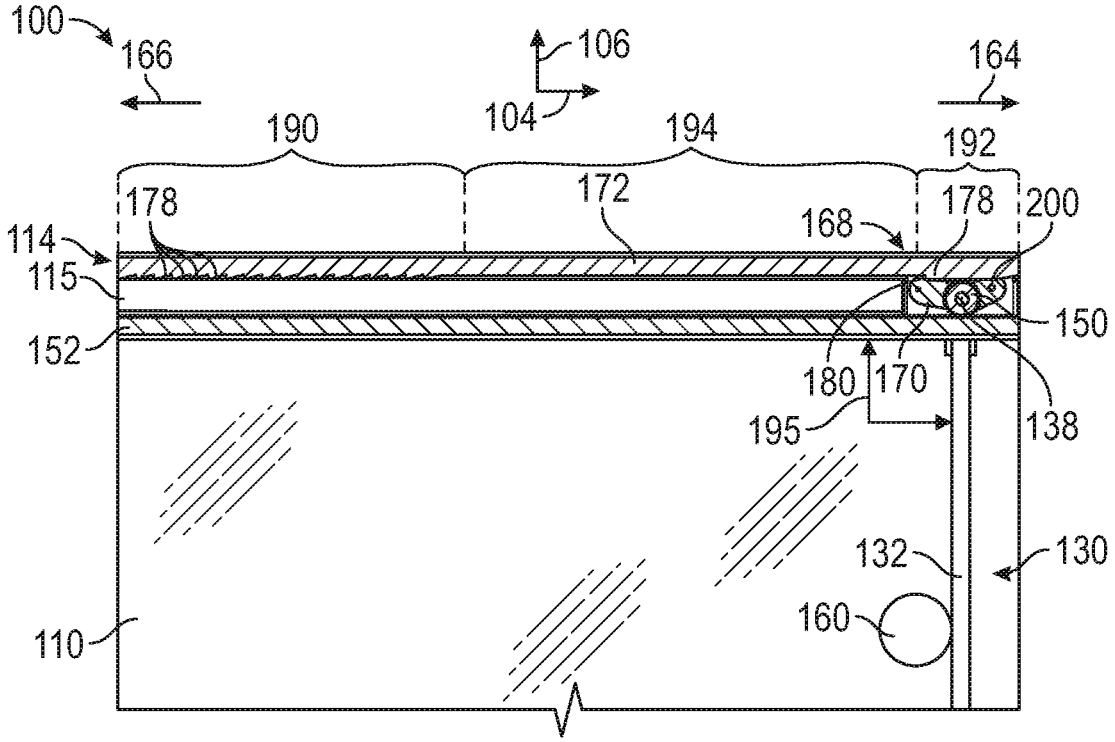

The breath guard 100 includes two or more load bearing elements or bearing elements (e.g., bearings, bushings, gears, pins, etc.), shown in FIGS. 3-5 as gears 150 (e.g., spur gears, helical gears, etc.). Each gear 150 receives the axle 138 or is otherwise coupled to the axle 138 such that the gear 150 is centered about the axis of rotation 142. The gears 150 may fixedly coupled to the axle 138 and are rotationally fixed relative to one another. By way of example, the gears 150 and the axle 138 may have corresponding splined or keyed surfaces that interface with one another to prevent relative rotational movement. In some such embodiments, the gears 150 are be able to move laterally relative to the axle 138 to accommodate misalignment between the frame rails 115. By way of another example, the gear 150 may be solid (i.e., without a center aperture) and the axle 138 may be welded to a lateral side of the gear 150. Each of the guide rail systems 114 include a rack gear 152 fixedly coupled (e.g., fastened, welded, adhered, etc.) to a frame rail 115 and configured to engage one of the gears 150. The rack gear 152 extends longitudinally along at least a portion of the length of the guide rail system 114. The rack gear 152 is received by a slot, groove, or pocket 154 defined in the frame rail 115 below the path of the axle 138, such that the teeth of the rack gear 152 extend upward to interface with the teeth of the gear 150. In some embodiments, the pocket 154 limits the lateral movement of the gear 150. Alternatively, the rack gear 152 and the frame rail 115 may be formed from a single component (e.g., gear teeth may be formed in a surface of the frame rail 115, etc.). At least a portion of the weight of the adjustable panel 130 is transferred through the axle 138 into the gears 150, which are in turn supported by the corresponding rack gears 152. Accordingly, the adjustable panel 130 is configured to rotate about the axis of rotation 142 and translate longitudinally (i.e., horizontally, parallel to the longitudinal axis 104) along the lengths of the guide rail systems 114.

The gears 150 are configured to prevent rotation of the adjustable panel 130 about a vertical axis. The engagement of each of the gears 150 with the corresponding rack gear 152 ensures that a linear movement of one of the gears 150 and by extension, one end of the axle 138, results in a corresponding rotational movement of the gear 150 and the other end of the axle 138, and vice versa. Because the gears 150 are rotationally fixed relative to one another by the axle 138, linear movement of one lateral side of the adjustable panel 130 results in a corresponding linear movement of the opposite lateral side of the adjustable panel 130. To ensure uniform linear motion of both gears 150, both gears 150 may be configured to have the same pitch diameter. However, the gear 150 and the rack gear 152 on one side of the adjustable panel 130 may or may not have different tooth measurements than the gear 150 and the rack gear 152 on the opposite side. By way of example, the gears 150 and rack gears 152 may have different pitches, numbers of teeth, face widths, types of teeth (e.g., helical, etc.), and/or other characteristics.

According to one exemplary use of the gears 150, a longitudinal force may be applied to the adjustable panel 130 near the right side of the adjustable panel 130 (e.g., near one of the guide rail systems 114). This, in turn, imparts a longitudinal force on the axle 138, causing the gear 150 near the right side of the adjustable panel 130 to translate in the longitudinal direction. Due to the engagement between this gear 150 and the corresponding rack gear 152, this gear 150 rotates a certain amount. The axle 138 transmits torque from this gear 150 to the gear 150 on the left side of the adjustable panel 130 such that both gears 150 have the same angular displacement. The gear 150 on the left side of the adjustable panel 130 engages the corresponding rack gear 152, imparting a longitudinal force on the left side of the adjustable panel 130. Accordingly, any twisting effect on the adjustable panel 130 is negated. Without the gears 150, a longitudinal force applied near the right side of the adjustable panel 130 could cause the adjustable panel 130 to rotate about a vertical axis, binding against the guide rail systems 114. The gears 150 permit a user to apply a longitudinal force anywhere along the width of the breath guard 100 without the potential for binding. This allows a user to stand wherever is most comfortable relative to the breath guard 100 during adjustment.

In some alternative embodiments, the gears 150 are replaced with bearings or bushings, or the bearing elements are omitted and the axle 138 or projection bears against the guide rail system 114 directly. In such embodiments, the bearings, bushings, axle 138, or projections translate freely in a longitudinal direction relative to the guide rail systems 114. In such embodiments, the rack gear 152 may be omitted, and each bearing element, axle 138, or protrusion may bear against a surface of the corresponding guide rail system 114. The surface may have a shape corresponding to the shape of the bearing element, axle 138, or protrusion (e.g., a flat surface, a curved surface, an angled surface, etc.). The surface may be defined by an additional component (e.g., a flat strip fixedly coupled to the frame rail 115, etc.) or by the frame rail 115. In some embodiments, the component defining the surface is hardened to reduce wear. The bearing elements, axle 138, or protrusions contact the surface and direct at least a portion of the weight of the adjustable panel 130 into the guide rail systems 114. By way of example, the bearing elements may be bearings configured to rotate freely relative to the axle 138, the adjustable panel 130, and one another. Accordingly, the axle 138 may be replaced with one or more pins that are fixed relative to the adjustable panel 130 and that support each bearing. In some embodiments, the bearing elements, axle 138, or protrusions are configured to coordinate the longitudinal motion of the two sides of the adjustable panel 130. By way of example, the bearing elements may be V bearings each having a circumferential V-shaped notch, and the rack gears 152 may be replaced with guide rails each having a corresponding angled protrusion. In such an embodiment, the corresponding shapes of the V bearings and the guide rails prevent rotation of the bearings, and by extension the adjustable panel 130, about a vertical axis.

Figure 6:
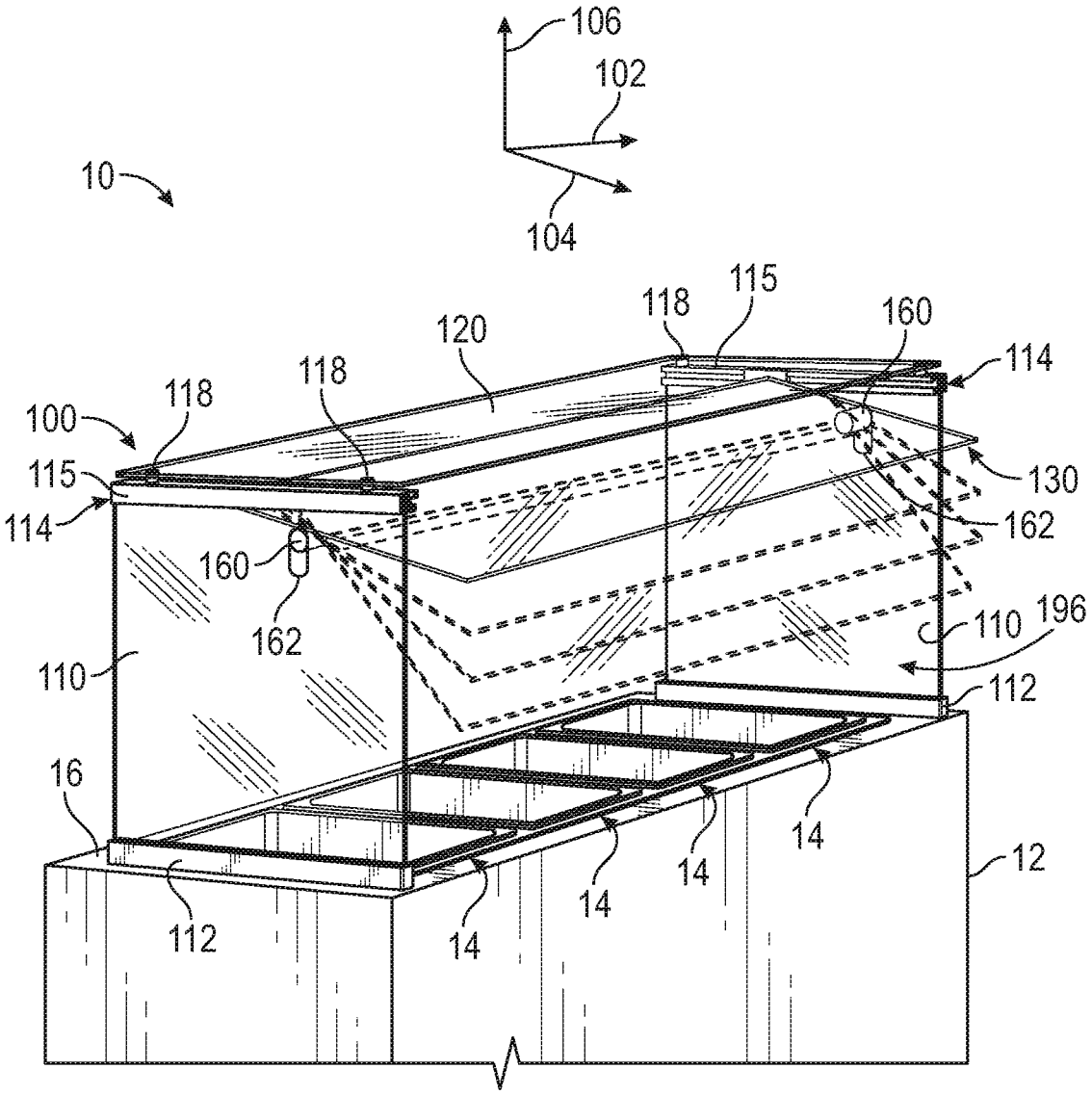
FIG. 6 is a perspective view of a food display system including a breath guard, according to another exemplary embodiment.

Referring to FIGS. 1 and 4-6, the breath guard 100 further includes one or more bosses 160. The bosses 160 extend laterally from one side panel 110 toward the other side panel 110. The bosses 160 may be fixed relative to the side panels 110, as shown in FIG. 1, or the bosses 160 may be adjustable, as shown in FIG. 6. In the embodiment shown in FIG. 6, each boss 160 is arranged in a slot 162 defined in the corresponding side panel 110 that extends substantially vertically. However, it should be understood that the slot 162 may extend in any direction along the side panel 110 (e.g., vertically, longitudinally, at an incline relative to a horizontal plane, along a curved path, etc.). The boss 160 includes an adjustment mechanism (e.g., a fastener) that facilitates selectively repositioning the boss 160 in various positions along the length of the corresponding slot 162. The bosses 160 may be round or otherwise shaped.

Referring to FIGS. 1 and 3-6, the adjustable panel 130 is configured to rest upon one or both of the bosses 160. Because the adjustable panel 130 is rotatable relative to the axle 138, without resting on the bosses 160 or being acted upon by an outside force, the adjustable panel 130 would continue to rotate downward under its own weight. As the adjustable panel 130 moves longitudinally, the adjustable panel 130 continues to rest against the boss 160. When the adjustable panel 130 moves longitudinally in a first direction 164 where the axis of rotation 142 moves toward the boss 160, the adjustable panel 130 rotates downward to remain in contact with the boss 160. When the adjustable panel 130 moves longitudinally in a second direction 166 opposite the first direction 164 where the axis of rotation 142 moves away from the boss 160, the boss 160 forces the adjustable panel 130 to rotate upward. Accordingly, a horizontal movement of the adjustable panel 130 causes a corresponding rotational movement of the adjustable panel 130 about the axis of rotation 142. It should be understood, however, that boss 160 prevents downward rotation of the adjustable panel 130 past a certain position, but does not prevent an outside force from lifting the adjustable panel 130. In embodiments where the boss 160 can be selectively repositioned (e.g., along the length of the slot 162), the position of the boss 160 can be adjusted to vary the orientation of the adjustable panel 130 relative to a horizontal plane for a given longitudinal position of the adjustable panel 130.

Referring to FIGS. 2-5, the breath guard 100 includes one or more adjustment mechanisms 168 configured to selectively hold the adjustable panel 130 in one or more longitudinal positions. Each adjustment mechanism 168 includes a pawl 170 rotatably coupled (e.g., directly, indirectly through the axle 138, etc.) to the adjustable panel 130. One or both of the guide rail systems 114 include a rack 172 configured to cooperate with one of the pawls 170 to selectively prevent longitudinal movement of the adjustable panel 130 in the first direction 164 and to permit movement in the second direction 166. The axle 138 extends through an aperture 174 defined in the pawl 170, rotatably coupling the pawl 170 to the axle 138, and thereby indirectly rotatably coupling the pawl 170 to the adjustable panel 130. The pawl 170 may include bearings or bushings or may otherwise be configured to facilitate rotation of the pawl 170 relative to the axle 138 and the adjustable panel 130. Accordingly, the axle 138, the gears 150, and the pawl 170 are all configured to move longitudinally in unison with the adjustable panel 130. In some embodiments, the axle 138, the gears 150, and the pawl 170 are all configured to rotate about the axis of rotation 142. Alternatively, the pawl 170 may be rotatably coupled to the adjustable panel 130 (e.g., directly, indirectly through the axle 138, etc.) such that the pawl 170 rotates about an axis other than the axis of rotation 142 (e.g., an axis vertically offset from the axis of rotation 142, an axis longitudinally offset from the axis of rotation 142, etc.). The breath guard 100 may include one or more support members that extend between the pawl 170 and the adjustable panel 130 or between the pawl 170 and the axle 138 to rotatably couple the pawl 170 to the adjustable panel 130.

Referring to FIGS. 3-5, the rack 172 is received by a slot, groove, or pocket 176 defined in the frame rail 115 above the path of the axle 138. The rack 172 is disposed laterally inward from the rack gear 152. It should be understood, however, that the rack 172 and the rack gear 152 may each be positioned above or below the path of the axle 138 and may have any lateral positioning relative to one another. In embodiments where the rack gear 152 is positioned above the axle 138, the axle 138 may rest on the frame rail 115 or on another component coupled to the frame rail 115. The rack 172 is coupled (e.g., fastened, adhered, welded, etc.) to the frame rail 115. The rack 172 defines a number (e.g., two, four, fifteen, etc.) of teeth 178 extending from a surface of the rack 172. Alternatively, the frame rail 115 and the rack 172 may be formed from a single component (e.g., the teeth 178 may be formed in a surface of the frame rail 115, etc.). Although the teeth 178 are shown to face downward in FIGS. 4 and 5, it should be understood that the teeth 178 could otherwise face another direction (e.g., upward, inward, etc.). The teeth 178 are configured to selectively engage a tooth 180 defined in the pawl 170 offset from the axis of rotation 142.

The teeth 178 and the tooth 180 are correspondingly shaped. As shown in FIGS. 4 and 5, each tooth 178 is shaped such that it includes both a flat and vertical or nearly vertical surface facing toward the second direction 166 and a flat surface angled shallowly outward and facing toward the first direction 164. The tooth 180 is shaped such that it includes a flat and vertical or nearly vertical surface (e.g., corresponding with the vertical or nearly vertical surface of the tooth 178) facing toward the first direction 164 and a flat surface angled shallowly outward and facing toward the second direction 166. The corresponding vertical or nearly vertical surfaces facilitate engagement between the tooth 178 and the tooth 180. Alternatively, instead of the vertical or nearly vertical surfaces, the tooth 178 and the tooth 180 may have corresponding concave and convex surfaces (e.g., with similar shapes, similar sizes, similar orientations, etc.) that are configured to engage one another. Further alternatively, instead of the vertical or nearly vertical surfaces, the tooth 178 and the tooth 180 may have corresponding flat surfaces that are angled inward such that the tooth 178 and the tooth 180 are configured to engage one another.

The tooth 180 of the pawl 170 is configured to engage one of the teeth 178 of the rack 172 when the tooth 180 is rotated toward the rack 172 (i.e., when the pawl 170 is in an activated position) and a force is applied to the adjustable panel 130 in the first direction 164. When the tooth 180 engages one of the teeth 178, the corresponding surfaces of that tooth 178 and the tooth 180 (e.g., the vertical surfaces, the concave and convex surfaces, the inwardly angled surfaces, etc.) engage one another. Due to the corresponding shapes and orientations of the corresponding surfaces, the corresponding surfaces push against one another without deflecting away from one another. Accordingly, engagement between one of the teeth 178 and the tooth 180 prevents movement of the pawl 170 and, by extension the adjustable panel 130, in the first direction 164 relative to the guide rail systems 114. When a force is applied to the adjustable panel 130 in the second direction 166, however, the outwardly angled surfaces of the teeth 178 and the tooth 180 meet one another. Due to the corresponding outward angles of these surfaces, a force in the second direction 166 forces the tooth 180 away from the rack 172, allowing free movement of the pawl 170 and, by extension the adjustable panel 130, in the second direction 166. In some embodiments, the pawl 170 is biased (e.g., by a biasing member such as a torsion spring, by the weight of the pawl 170, etc.) to rotate such that the tooth 180 moves toward the rack 172. Such an arrangement automatically prevents the adjustable panel 130 from moving in the first direction 164 under the weight of the adjustable panel 130, while still permitting a user to freely push or pull the adjustable panel 130 in the second direction 166. Additionally, the biasing force may press the corresponding outwardly angled surfaces of the teeth 178 and the tooth 180 against one another, forcing the pawl 170 in the first direction 164 until the pawl 170 engages one of the teeth 178 (e.g., until a vertical face of the tooth 180 contacts a vertical face of one of the teeth 178).

In some embodiments, friction between the rack 172 and the tooth 180 prevents the adjustable panel 130 from moving in the second direction 166 until at least a threshold force is applied to the adjustable panel 130 in the second direction 166. The magnitude of this threshold force may vary with the force applied by the biasing member, the slope of the angled surfaces of the teeth 178 and the tooth 180, the materials of the pawl 170 and the rack 172, and/or other factors. In some embodiments, the surfaces of the teeth 178 facing the second direction 166 and the surface of the tooth 180 facing the first direction 164 are angled outward instead of vertical. In some such embodiments, friction between the rack 172 and the tooth 180 prevents the adjustable panel 130 from moving in the first direction 164 until at least a threshold force is applied to the adjustable panel 130 in the first direction 164. The magnitude of this threshold force may vary with the force applied by the biasing member, the slope of the angled surfaces of the teeth 178 and the tooth 180, the materials of the pawl 170 and the rack 172, and/or other factors. In some embodiments, the teeth 178 and/or the tooth 180 are otherwise shaped (e.g., curved, textured, etc.).

The pawl 170 can engage each of the teeth 178 individually or multiple teeth 178 at one time. In some embodiments, the pawl 170 includes multiple teeth 180 to facilitate continued engagement between the pawl 170 and one or more teeth 178. Because the rack 172 includes a finite number of teeth 178 and the pawl 170 includes a finite number of teeth 180, the pawl 170 engages the rack 172 in a finite number of locations. Accordingly, the adjustable panel 130 is selectively repositionable between a finite number of longitudinal positions, each position corresponding to a longitudinal position of the pawl 170 where the pawl 170 engages a tooth 178 or a set of teeth 178. As shown in FIGS. 4 and 5, the rack 172 includes a first section or zone, shown as buffet section 190, defining a number of evenly spaced teeth 178, a second section or zone, shown as cafeteria section 192, defining a single tooth 178, and a third section or zone, shown as transition section 194, without any teeth 178 between the buffet section 190 and the cafeteria section 192.

Figure 7:
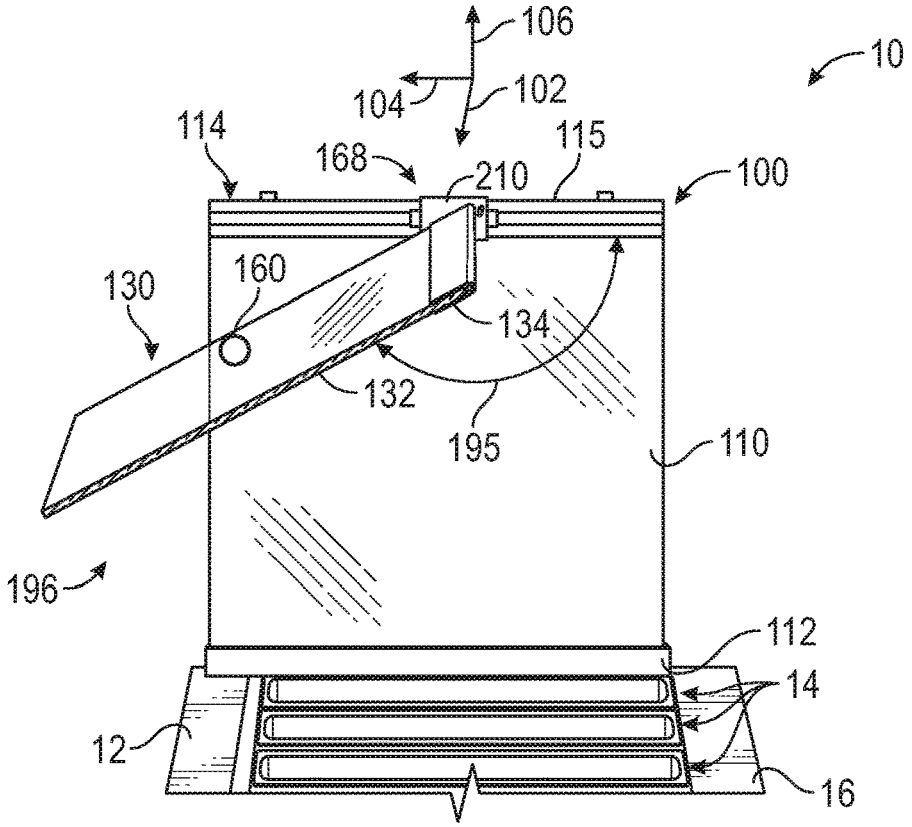
FIGS. 7 and 8 are perspective side section views of the breath guard of FIG. 2.

Referring to FIGS. 4 and 7, with the pawl 170 engaging one or more of the teeth 178 in the buffet section 190, the adjustable panel 130 is configured into a self-service or buffet configuration. In the buffet configuration, the adjustable panel 130 is angled (e.g., 165 degrees, 150 degrees, 135 degrees, 120 degrees, etc.) relative to a horizontal plane. An angle 195 between the adjustable panel 130 and a horizontal plane (e.g., the horizontal plane along which the guide rail systems 114 extend) may be adjusted by selectively repositioning the adjustable panel 130 such that the pawl 170 engages a different tooth 178 or set of teeth 178 in the buffet section 190. The angle 195 may be further adjusted by repositioning the bosses 160 relative to the side panels 110 (e.g., along the lengths of the corresponding slots 162). In the buffet configuration, an aperture or opening 196 is formed between the top surface 16, the side panels 110, and the adjustable panel 130. The opening 196 facilitates access to the food pans 14 from a front side of the system 10 (e.g., the side nearest the bosses 160). Such a configuration may be used in a buffet setting, where a customer reaches through the opening 196 to retrieve food from the food pans 14, serving themselves.

Figure 8:
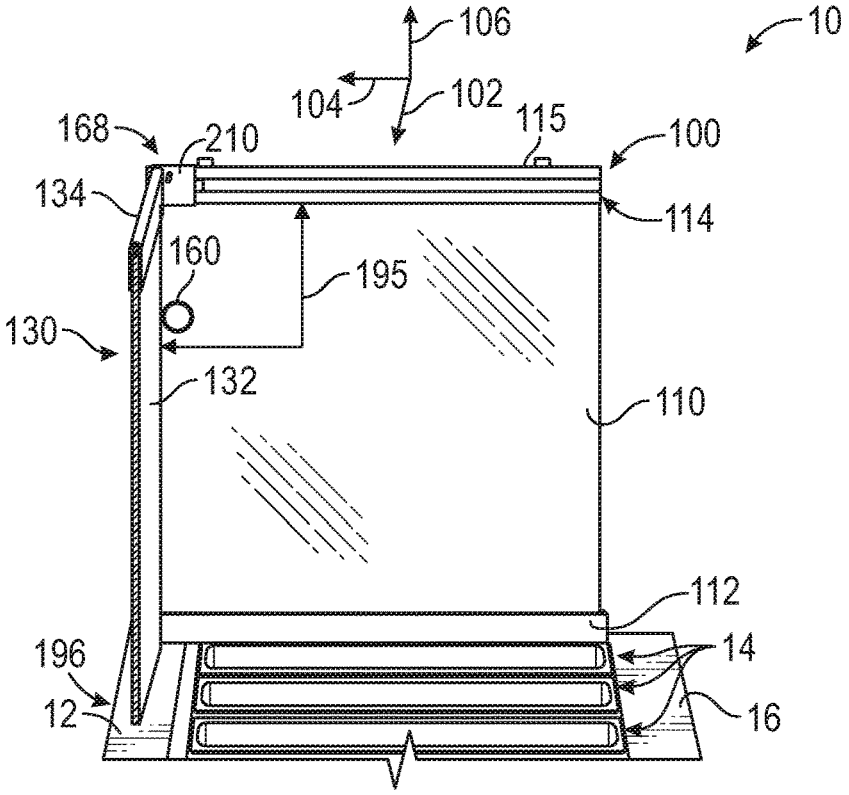

Referring to FIGS. 5 and 8, with the pawl 170 engaging the tooth 178 in the cafeteria section 192, the adjustable panel 130 is configured into a full-service or cafeteria configuration. In the cafeteria configuration shown in FIGS. 5 and 8, the adjustable panel 130 is oriented vertically (i.e., parallel to a vertical plane) such that the angle 195 is 90 degrees. In other embodiments, the angle 195 has a value other than 90 degrees while in the cafeteria configuration. In the cafeteria configuration, the adjustable panel 130 may or may not contact the boss 160. In the cafeteria configuration, the adjustable panel 130 extends between the top surface 16 and the side panels 110. In an embodiment that includes the top panel 120, such as the embodiment shown in FIG. 1, the adjustable panel 130 extends between the top surface 16, the side panels 110, and the top panel 120 while in the cafeteria configuration. Accordingly, the adjustable panel 130 prevents (i.e., blocks) access to the food pans 14 from the front side of the system 10 while in the cafeteria configuration. As such, the opening 196 is smaller in the cafeteria configuration than in the buffet configuration. The cafeteria configuration may be used in a cafeteria setting, where food service personnel stand on one side of the system 10 and serve food to a customer on the opposite side of the system 10. The system 10 allows access to the food pans 14 by the food service personnel from the rear side, but the adjustable panel 130 prevents access to the food pans 14 by the customers from the front side.

The breath guard 100 may be configured to conform to various standards for breath guards or food shields. By way of example, the breath guard 100 may be configured to conform to NSF/ANSI 2. Specifically, the cafeteria configuration of the breath guard 100 may correspond to an NSF cafeteria position conforming to NSF/ANSI 2 (e.g., at least the "food shields for use on cafeteria counters" section of NSF/ANSI 2, etc.), and the buffet configuration of the breath guard 100 may correspond to at least one NSF buffet positon conforming to NSF/ANSI 2 (e.g., at least the "self-service food shields" section of NSF/ANSI 2, etc.). In accordance with NSF/ANSI 2, a distance between the panel 132 and either of the side panels 110 may be a maximum of 0.75 inches (e.g., in both the NSF cafeteria position and the NSF buffet position). In the NSF cafeteria position, a vertical distance between the panel 132 and the top surface 16 may be a maximum of 1.5 inches. In other embodiments, the breath guard functions as a device not specifically intended for use as a food shield or for food service. For example, in these embodiments, the breath guard may be a convertible shield/shelf device in which the device is usable as a shelf with the adjustable panel arranged horizontally and as a shield with the adjustable panel arranged in other positions (e.g., a vertical position).

Due to the lack of teeth 178 in the transition section 194 of the rack 172, the pawl 170 does not engage the rack 172 in the transition section 194. Accordingly, the adjustable panel 130 may not be selectively repositionable into a longitudinal position where the pawl 170 is located adjacent the transition section 194 without an external force holding the adjustable panel 130 in place. Such positions may not be useful in a buffet configuration, as the opening 196 may not be large enough to allow a customer to reach the food pan 14 easily. Additionally, such positions may not be useful in a cafeteria configuration, as the adjustable panel 130 may not sufficiently block the opening 196. Accordingly, the teeth 178 may be omitted from the transition section 194 instead of having teeth 178 along the entire length of the rack 172.

As shown in FIGS. 2, 4, and 5, the adjustment mechanism 168 further includes a member or protrusion, shown as pin 200, directly and fixedly coupled to the pawl 170. By way of example, the pin 200 may be pressed into an aperture in the pawl 170. By way of another example, the pin 200 may be integrally formed with the pawl 170. The pin 200 may have any shape or size (e.g., a circular cross section, a rectangular cross section, etc.). The pin 200 extends laterally outward from the pawl 170, extending out over the adjustable panel 130 such that the pin 200 extends into the path of motion of the adjustable panel 130. The pin 200 is offset from the axis of rotation 142 such that the pin 200 moves in a circular path around the axis of rotation 142. The pin 200 is configured such that, as the pin 200 is rotated upward, the pawl 170 rotates from an engaged or activated position, where the pawl 170 is positioned to engage the teeth 178, to a disengaged or deactivated position, where the tooth 180 of the pawl 170 rotates away from the rack 172 and cannot engage the teeth 178. Accordingly, rotating the pin 200 upward moves the pawl 170 to the deactivated position, thereby allowing longitudinal motion of the adjustable panel 130 in both the first direction 164 and the second direction 166. Alternatively, the pin 200 may be indirectly coupled to the pawl 170 (e.g., through an additional linkage member, through a cable, etc.) such that movement of the pin 200 causes a corresponding movement of the pawl 170. Such embodiments may facilitate variations in the placement of the pin 200 to vary how the pawl 170 is controlled. By way of example, the pin 200 may be moved away from the axis of rotation 142 and connected to the pawl 170 with one or more linkage members, thereby changing the location of the point of engagement between the pin 200 and the adjustable panel 130. In such an embodiment, the pin 200 may be translatably coupled to one of the guide rail systems 114.

The adjustable panel 130 is configured to engage the pin 200 as the adjustable panel 130 is rotated upward. The pin 200 may be configured such that the pin 200 does not contact the adjustable panel 130 while the adjustable panel 130 rests on the boss 160, regardless of the longitudinal position of the adjustable panel 130. To engage the pin 200, an outside force (e.g., provided by food service personnel) lifts the adjustable panel 130 off of the boss 160. Once the adjustable panel 130 reaches a threshold rotational position, the pin 200 engages the adjustable panel 130. The location of the pin 200 may be varied to adjust the threshold rotational position. As shown in FIG. 2, the pin 200 engages the bracket 134. Further upward rotation of the adjustable panel 130 rotates the pin 200 upward, thereby moving the pawl 170 into the deactivated position. In some embodiments, the adjustable panel 130 is arranged approximately horizontally when the pawl 170 is moved to the deactivated position. By way of example, the pin 200 may be used to reconfigure the adjustable panel 130 into the cafeteria configuration from the buffet configuration. A user may lift the adjustable panel 130 until the pawl 170 is in the deactivated position, thereby allowing the adjustable panel 130 to move freely longitudinally in both the first direction 164 and the second direction 166. With the pawl 170 in the deactivated position, the user may pull the adjustable panel 130 until the tooth 180 of the pawl 170 is offset slightly from the tooth 178 of the cafeteria section 192 in the second direction 166. The user may then lower the adjustable panel 130 until the pawl 170 engages the tooth 178 and the adjustable panel 130 is arranged vertically. The adjustment mechanism 168 facilitates adjustment of the breath guard 100 by a single user, as the user can begin adjustment by simply lifting the adjustable panel 130. If user becomes fatigued while lifting the adjustable panel 130, they can simply set the adjustable panel 130 back down on the boss 160, and the adjustment mechanism 168 automatically engages the guide rail system 114 to hold the adjustable panel 130 in place.

Referring to FIGS. 2 and 3, the breath guard 100 further includes a pair of covers or guards, shown as covers 210. The covers 210 extend between the bracket 134 and each guide rail system 114. The covers 210 each define an aperture 212 that receives the axle 138, preventing relative longitudinal and vertical movement of the axle 138 and the cover 210. Each cover 210 extends across an inner side of one of the guide rail systems 114, but does not extend beyond a top surface or a bottom surface of the corresponding frame rail 115. The covers 210 each include a pair of tabs or flanges, shown as flanges 214, that extend toward the corresponding guide rail system 114. The flanges 214 are received by an engagement feature, shown as groove 216, defined in the frame rail 115 between the rack gear 152 and the rack 172. The groove 216 extends longitudinally along the length of the frame rail 115 such that the flanges 214 do not interfere with the longitudinal motion of the adjustable panel 130. The flanges 214 are configured to contact the guide rail system 114 to prevent vertical movement of the cover 210 and, by extension, the axle 138 and the gears 150. This prevents disengagement of the gears 150 from the corresponding rack gears 152, which could otherwise result in rotation of the adjustable panel 130 about a vertical axis. Accordingly, the axle 138, the gears 150, and the covers 210 rotatably and translatably couple the adjustable panel 130 to the guide rail systems 114. The covers 210 further prevent debris from reaching the gears 150 or the pawls 170. The cover 210 further defines a slot 218, through which the pin 200 extends.

In alternative embodiments, each cover 210 is otherwise coupled to the corresponding guide rail system 114. By way of example, the location of the groove 216 in each frame rail 115 may vary between different embodiments (e.g., the groove 216 may be located elsewhere on one side of the frame rail 115 or on a different side of the frame rail 115 entirely, etc.). In such an example, the flanges 214 may be moved and/or may be extended based on the locations of the grooves 216 such that the flanges 214 enter the grooves 216 in each embodiment. By way of another example, the engagement feature may be one or more rails extending outward from the frame rails 115. In such an embodiment, the flanges 214 may define one or more grooves, slots, or recesses that receive the rails, preventing relative vertical movement between each cover 210 to the corresponding guide rail system 114. By way of another example, in an embodiment where both the rack gear 152 and the rack 172 are positioned below the axle 138, the grooves 216 may be omitted from the frame rails 115. In such an example, the cover 210 may include additional flanges that extend above and/or below the corresponding guide rail system 114 such that the additional flanges prevent relative vertical movement between the cover 210 and the guide rail system 114.

Figure 9:
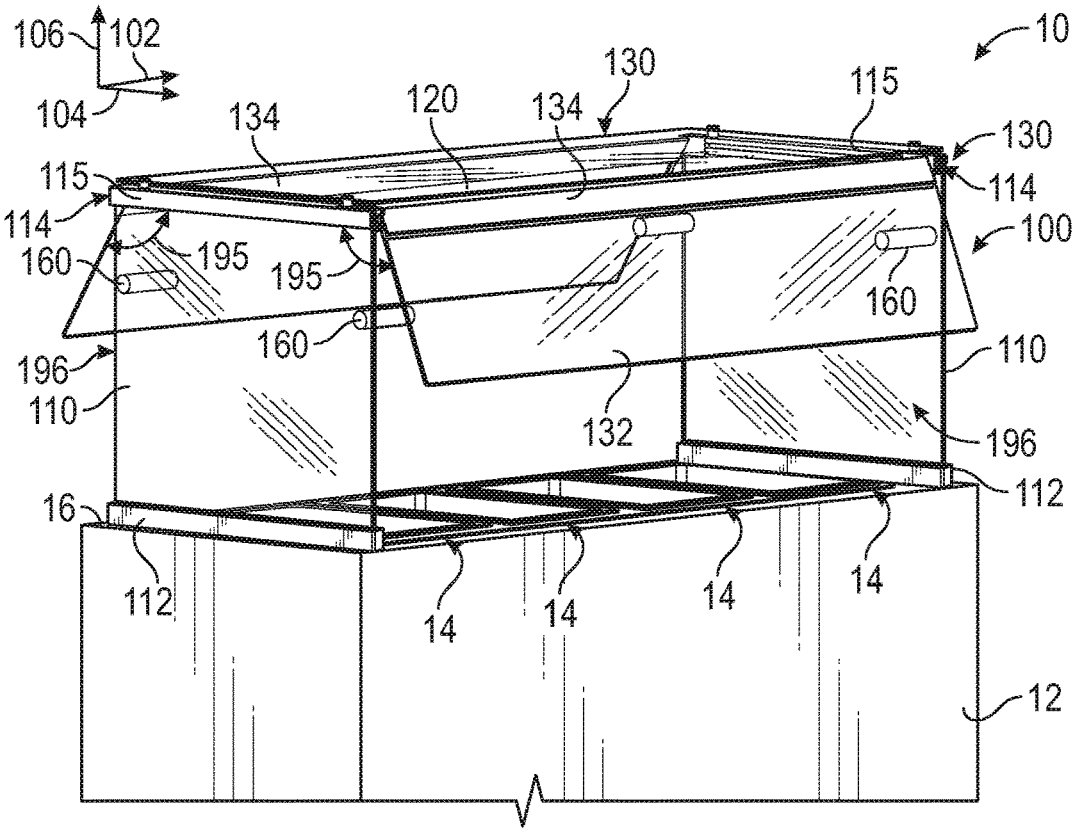
FIGS. 9-12 are perspective views of food display systems, each including a breath guard, according to various exemplary embodiments.

Referring to FIG. 9, in some embodiments, the breath guard 100 includes a pair of adjustable panels 130, each disposed on an opposite longitudinal side of the system 10. Such embodiments may be useful in buffet scenarios where customers access the food pans 14 from both longitudinal sides (i.e., the front side and the back side) of the system 10. Accordingly, in some such embodiments, the breath guard 100 may be configured such that the adjustable panels 130 are only reconfigurable into a buffet configuration and not into a cafeteria configuration. However, such embodiments still facilitate adjustment of the orientation of the adjustable panels 130 similarly to the embodiment shown in FIGS. 1-8. Accordingly, the guide rail systems 114 and the adjustable panels 130 may be shorter relative to embodiments that are reconfigurable into a cafeteria configuration. Additionally, each guide rail system 114 may include a pair of racks 172: a first rack 172 with teeth 178 having vertical surfaces facing a first direction and a second rack 172 with teeth 178 having vertical surfaces facing a second direction oriented opposite the first direction. Such an arrangement facilitates the use of a pair of adjustable panels 130 facing opposite directions.

Figure 10:
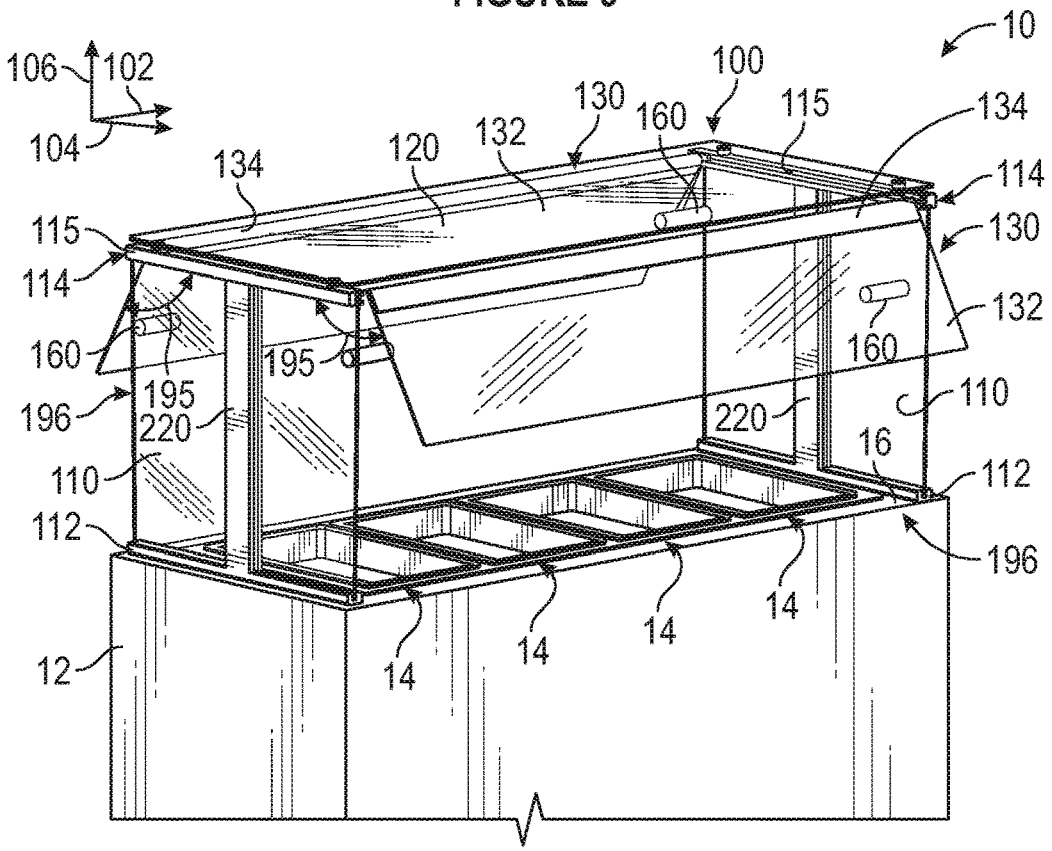
Figure 11:
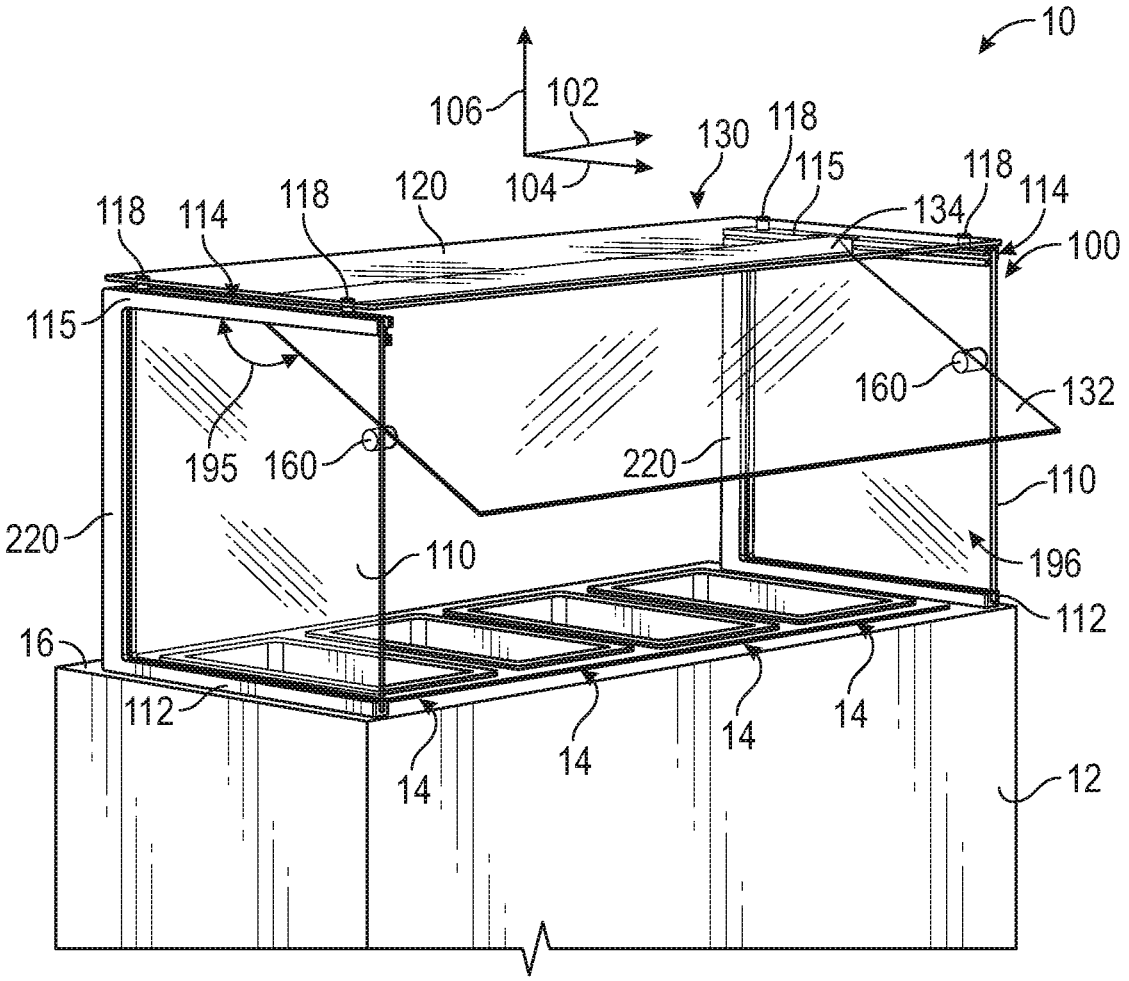

Although FIGS. 1-8 show the guide rail systems 114 as being supported by panels (e.g., the side panels 110), it should be understood that the guide rail systems 114 may be supported by various types of supports. The breath guard 100 may additionally or alternatively include frames, brackets, or other items that extend between the guide rail system 114 and the top surface 16. In a first example, the embodiment shown in FIG. 10 is substantially similar to the embodiment shown in FIG. 9, except the breath guard 100 includes supports, shown as frame members 220, that extend between each guide rail system 114 and the corresponding bracket 112. The frame members 220 are fixedly coupled (e.g., welded, fastened, etc.) to the respective bracket 112 and frame rail 115. In a second example, the embodiment shown in FIG. 11 is substantially similar to the embodiment shown in FIG. 1, except the breath guard 100 includes frame members 220 extending between each guide rail system 114 and the corresponding bracket 112. The frame members 220 are fixedly coupled (e.g., welded, fastened, etc.) to the respective bracket 112 and frame rail 115. In some embodiments that include the frame members 220, the side panels 110 are omitted.

Referring to FIGS. 12-57, a food serving system or food display system, shown as system 30, includes an adjustable sneeze guard assembly, breath guard assembly, or food shield assembly, shown as breath guard 300, as an alternative embodiment to the breath guard 100. The breath guard 300 may be substantially similar to the breath guard 100, except as otherwise stated herein. Accordingly, the individual components of the breath guard 300 may be substantially similar to the individual components of the breath guard 100, except as otherwise stated herein. The breath guard 300 is coupled to the base 12. The base 12 is configured to support containers, shown as food pans 70, that are substantially similar to the food pans 14.

Figure 12:
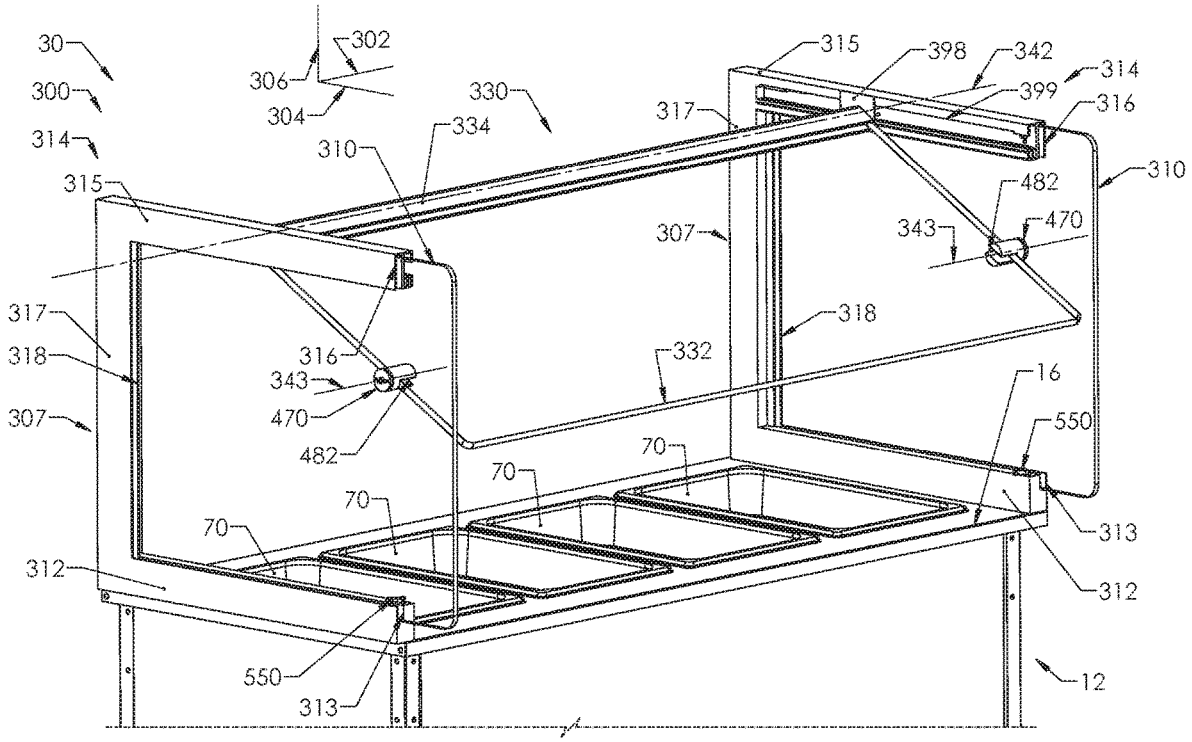
Figure 27:
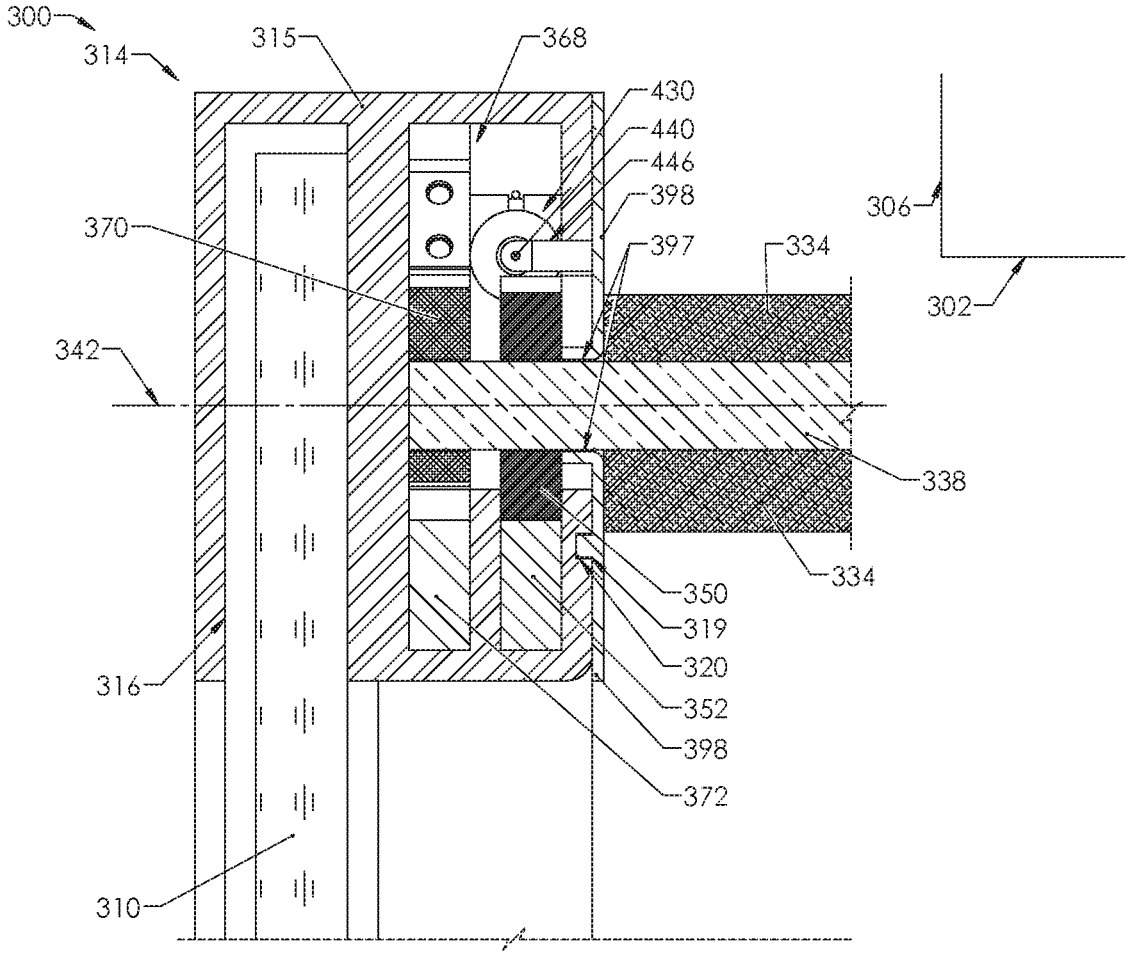
FIG. 27 is a front section view of a guide rail system of the breath guard of FIG. 12.

Referring to FIG. 12, the breath guard 300 extends along a lateral axis 302, a longitudinal axis 304, and a vertical axis 306. The breath guard 300 includes a pair of supports, shown as side panels 310, each configured to be coupled to the top surface 16 by a frame assembly, shown as side frame assembly 307. The side frame assemblies 307 each include a support or foot, shown as bracket 312, which extends between the side panel 310 and the top surface 16, coupling the side panel 310 to the base 12. Specifically, the bracket 312 defines a longitudinal slot, groove, or pocket, shown as panel slot 313, that receives a bottom end of the side panel 310. In some embodiments, the brackets 312 are fastened to the top surface 16 (e.g., by fasteners extending upward from the top surface 16). In other embodiments, the brackets 312 are otherwise coupled to the top surface 16. A top end of each side panel 310 is coupled to an assembly, shown as guide rail system 314. Each guide rail system 314 includes a base member or track, shown as frame rail 315. The frame rail 315 defines a longitudinal slot, groove, or pocket, shown as panel slot 316, that receives the top end of the side panel 310. The guide rail systems 314 extend substantially parallel to the longitudinal axis 304 along a top surface of each side panel 310. Supports or frame members, shown as spines 317, extend vertically between the guide rail systems 314 and the corresponding brackets 312. The spines 317 are fixedly coupled (e.g., fastened, welded, etc.) to the respective bracket 312 and frame rail 315. The spines 317 each define a vertical slot, groove, or pocket, shown as panel slot 318, that receives the rear end of the side panel 310. The side frame assemblies 307 may include fasteners (e.g., set screws, etc.) or another type of coupler to selectively retain the side panels 310 within the panel slot 313, the panel slot 316, and the panel slot 318. The coupler may selectively fix the side panels 310 to the side frame assemblies 307 to increase the rigidity of the overall structure. As shown in FIG. 27, the panel slot 313, the panel slot 316, and the panel slot 318 may be wider than the side panels 310 to facilitate selective removal of the side panels 310. The side frame assemblies 307 may further include one or more cosmetic covers (e.g., that cover the ends of the frame rails 315, etc.).

Figure 28:
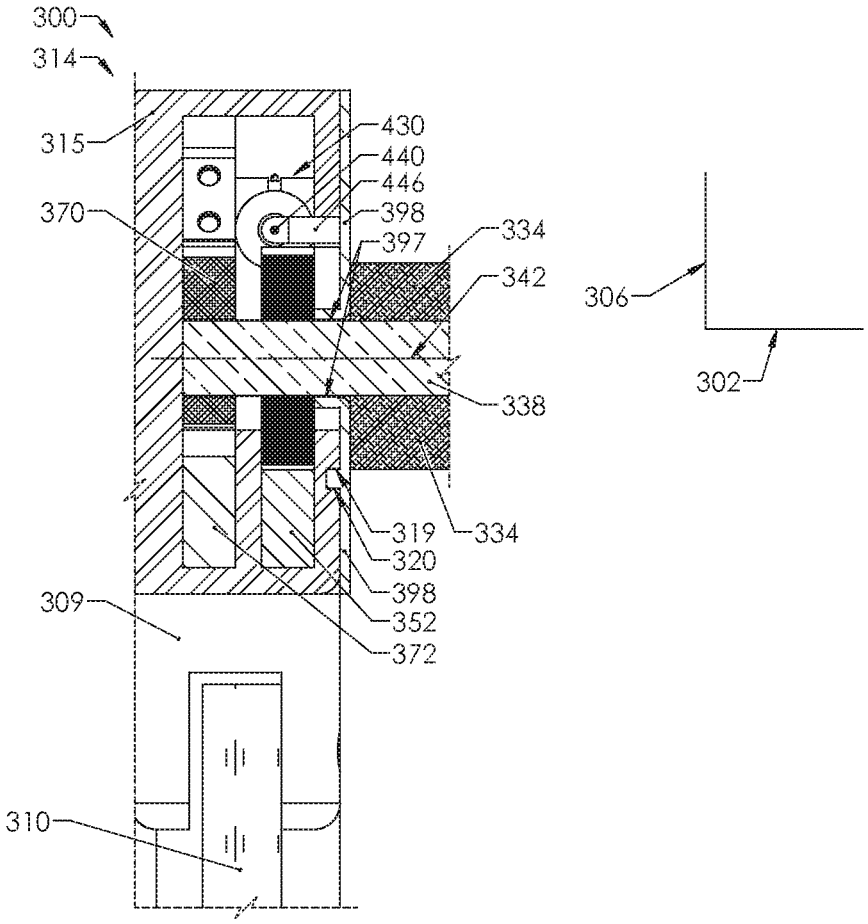
FIGS. 28-34 are front section views of guide rail systems for breath guards, according to various exemplary embodiments.

Referring to FIG. 28, in an alternative embodiment, the panel slot 313, the panel slot 316, and the panel slot 318 are omitted, and the side panels 310 are coupled to the side frame assemblies 307 by a series of couplers, clamps, brackets, or clips, shown as panel clips 309. The panel clips 309 are coupled (e.g., fastened, welded, etc.) to the side frame assemblies 307. The panel clips 309 each define a groove that is configured to receive an end portion (e.g., a bottom end portion, a top end portion, a rear end portion, etc.) of the corresponding side panel 310. The panel clips 309 are coupled to the side panels 310, coupling the side panels 310 to the side frame assemblies 307. By way of example, each panel clip 309 may include a set screw that presses against the side panel 310 to hold the side panel 310 in place. By way of another example, each panel clip 309 may include a pin (e.g., a fastener) that extends through a corresponding aperture in the side panel 310 to hold the side panel 310 in place.

Figure 13:
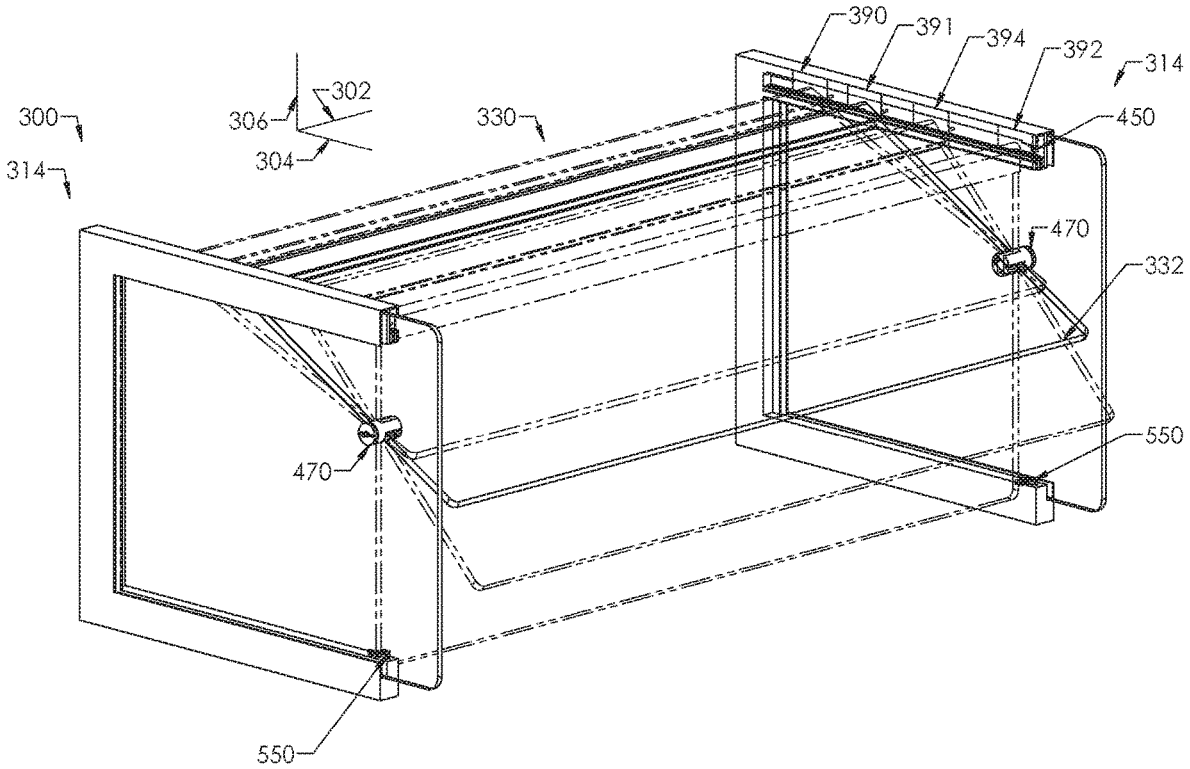
FIG. 13 is a perspective view of the breath guard of FIG. 12.
Figure 14:
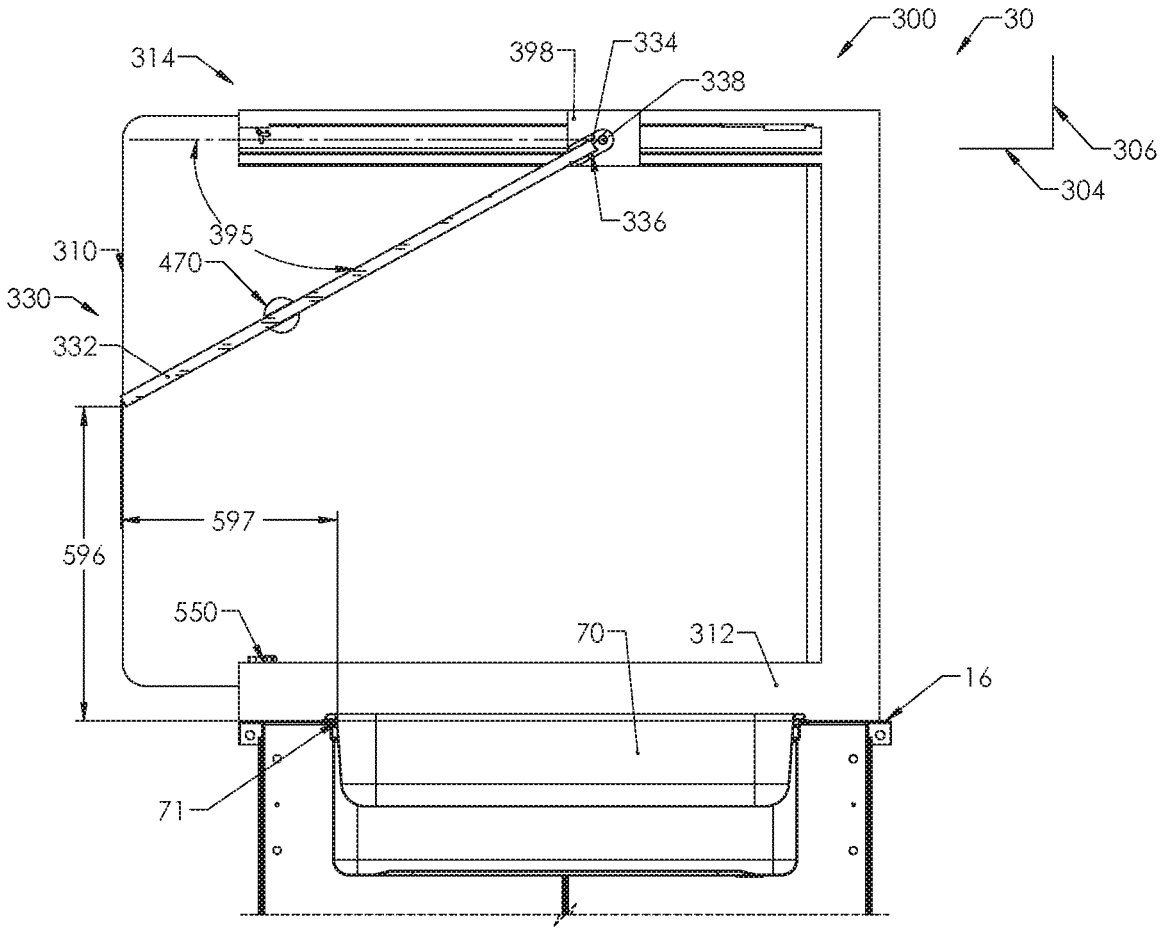
FIGS. 14 and 15 are side section views of the breath guard of FIG. 12.

Referring to FIGS. 12-14, the breath guard 300 further includes an adjustable panel assembly, shown as adjustable panel 330. The adjustable panel 330 includes a shield or panel 332 and a bracket 334. The bracket 334 defines a slot, groove, or pocket, shown in FIG. 14 as slot 336, configured to receive a portion of the top end of the panel 332. The panel 332 is coupled (e.g., adhered, fastened, etc.) to the bracket 334. By way of example, the panel 332 may be coupled to the bracket 334 with a through-bolt fastener, a friction clamp or clip, an adhesive or bonded joint, or using magnets. The panel 332 may be removed from the bracket 334 (e.g., for cleaning). The adjustable panel 330 extends between the side panels 310, from the guide rail system 314 on one of the side panels 310 to the guide rail system 314 on the other of the side panels 310. As shown in FIGS. 12, 14, and 27, a torsional member or rod, shown as axle 338, extends laterally through an aperture defined in the bracket 334. The axle 338 extends laterally outward from the bracket 334 and is received by an aperture, recess, or slot, shown as slide slot 399, defined by the frame rail 315 on each lateral side of the adjustable panel 330. The axle 338 rotatably and translatably couples the adjustable panel 330 to the guide rail systems 314. As such, the adjustable panel 330 rotates about a laterally extending axis, shown as axis of rotation 342, that extends through the center of the axle 338. In some embodiments, the guide rail systems 314 are configured to selectively permit the adjustable panel 330 to slide entirely out of the frame rails 315 (e.g., for cleaning).

Referring to FIG. 12, in some embodiments, the breath guard 300 includes 1 or more of holding or rotational positioning mechanisms or assemblies, shown as wrist systems 470. The wrist systems 470 are similar to the bosses 160 in that the wrist systems 470 support the adjustable panel 330 and constrain the rotational movement of the adjustable panel 330 such that the each longitudinal position of the adjustable panel 330 has a corresponding rotational position. However, unlike the bosses 160, the wrist systems 470 at least partially surround the adjustable panel 330, preventing the adjustable panel 330 from being lifted off of the wrist systems 470. The wrist systems 470 constrain the movement of the adjustable panel 330 such that the adjustable panel 330 rotates about a lateral axis, shown as axis of rotation 343, that extends through the centers of both wrist systems 470. Together, the guide rail systems 314 and the wrist systems 470 constrain the movement of the adjustable panel 330 such that each longitudinal position of the axis of rotation 342 corresponds to an orientation of the adjustable panel 330 about the axis of rotation 343. As discussed herein, the guide rail system 314 limits movement of the axis of rotation 342 to movement along the length of the slide slots 339. As the adjustable panel 330 moves longitudinally, the adjustable panel 330 slides within the slide slots 339 and the wrist systems 470 rotate relative to the side panels 310. Contact between the adjustable panel 330 and the wrist systems 470 causes angular positioning of the adjustable panel 330 about the axis of rotation 343. The wrist systems 470 may additionally provide a biasing torque to bias the adjustable panel 330 toward the cafeteria configuration.

The breath guard 300 is selectively reconfigurable into a buffet configuration and a cafeteria configuration similar to the buffet configuration and the cafeteria configuration of the breath guard 100. In the buffet configuration, shown in FIG. 14, the adjustable panel 330 is angled (e.g., 165 degrees, 150 degrees, 135 degrees, 120 degrees, etc.) relative to a horizontal plane. An angle 395 is defined between the adjustable panel 330 and a horizontal plane (e.g., the horizontal plane along which the guide rail systems 314 extend). In some embodiments, the exact value of the angle 395 in the buffet configuration may be varied by the user (e.g., depending upon the user's preference). In other embodiments, the value of the angle 395 in the buffet configuration is fixed (e.g., by the geometry of the guide rail systems 314 and the locations of the wrist systems 470). In the buffet configuration, an aperture or opening is formed between the top surface 16, the side panels 310, and the adjustable panel 330. The opening facilitates access to the food pans 70 from a front side of the system 30 (e.g., the side opposite the spines 317). Such a configuration may be used in a self-service or buffet setting, where a customer reaches through the opening to retrieve food from the food pans 70, serving themselves.

In the buffet configuration, a vertical distance, shown as distance 596, is defined between the lowest edge of the adjustable panel 330 and the top surface 16. The distance 596 may be sufficiently large such that a customer can access the food pans 70 through the opening. A horizontal distance, shown as distance 597, is defined between the frontmost edge of the adjustable panel 330 and a front edge 71 of the depression of a food pan 70. In some embodiments, the distance 597 is set such that a front edge of each side panel 310 is aligned with the frontmost edge of the adjustable panel 330 in the buffet configuration.

Figure 15:
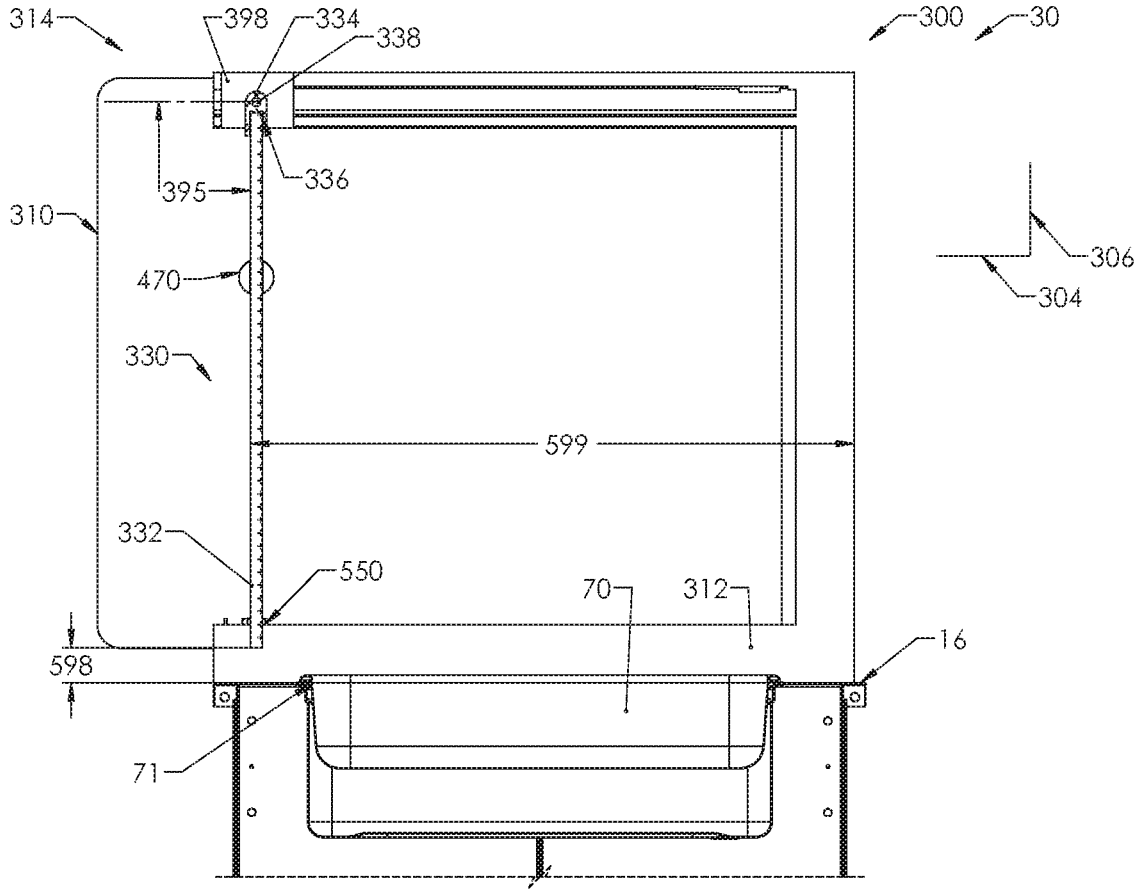

In the cafeteria configuration shown in FIG. 15, the adjustable panel 330 is oriented substantially vertically (i.e., parallel to a vertical plane) such that the angle 395 is approximately 90 degrees. In other embodiments, the angle 395 has a value other than 90 degrees while in the cafeteria configuration. In the cafeteria configuration, the adjustable panel 330 extends between the top surface 16 and the side panels 310. Accordingly, the adjustable panel 330 prevents (i.e., blocks) access to the food pans 70 from the front side of the system 30 while in the cafeteria configuration. As such, the opening is smaller in the cafeteria configuration than in the buffet configuration. The cafeteria configuration may be used in a full-service or cafeteria setting, where food service personnel stand on one side of the system 30 and serve food to a customer on the opposite side of the system 30. The system 30 permits access to the food pans 70 by the food service personnel from the rear side, but the adjustable panel 330 prevents access to the food pans 70 by the customers from the front side.

In the cafeteria configuration, a vertical distance, shown as distance 598, is defined between the lowest edge of the adjustable panel 330 and the top surface 16. In the NSF cafeteria position, the distance 598 may be a maximum of 1.5 inches. A horizontal distance, shown as distance 599, is defined between the frontmost edge of the adjustable panel 330 and a rear edge of the side panels 310.

Figure 16:
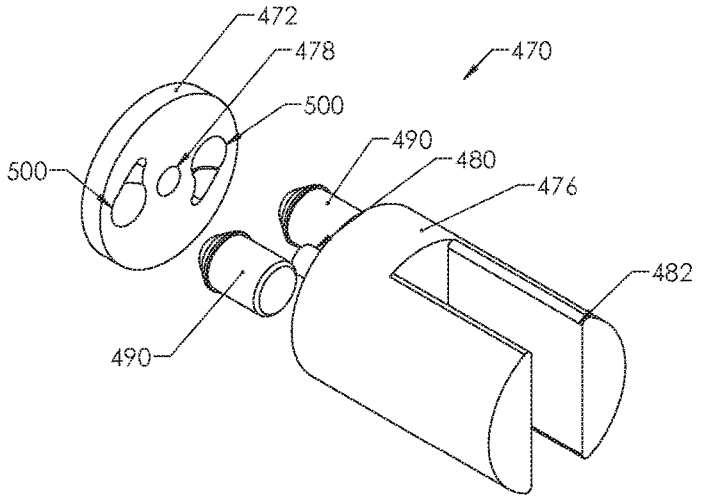
FIG. 16 is an exploded perspective view of a wrist system of the breath guard of FIG. 12.
Figure 17:
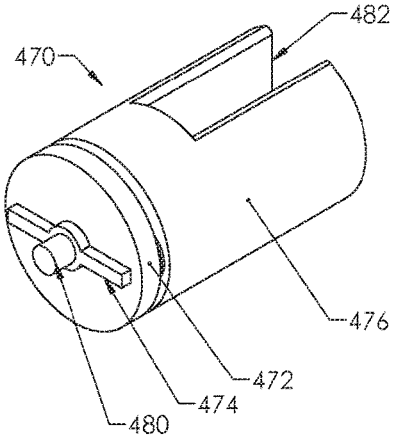
FIG. 17 is a perspective view of the wrist system of FIG. 16.

Referring to FIGS. 16 and 17, each wrist system 470 includes a base member, shown as wrist base 472, fixedly coupled to one of the side panels 310. To prevent the wrist base 472 from rotating relative to the side panel 310, the wrist base 472 includes a projection, shown as key 474, extending therefrom. The key 474 is received in a corresponding slot or aperture defined in the side panel 310. The key 474 and the corresponding slot have corresponding non-circular shapes (e.g., square, triangular, rectangular, elliptical, etc.) such that the key 474 rotationally fixes the wrist base 472 to the side panel 310. In other embodiments, the key 474 is omitted, and the wrist base 472 is otherwise rotationally fixed relative to the side panel 310 (e.g., using adhesive). The wrist system 470 further includes a wrist body 476 rotatably coupled to the wrist base 472. The wrist base 472 defines an aperture 478 configured to receive a protrusion or pin, shown as mounting boss 480, extending from the wrist body 476, rotatably coupling the wrist body 476 to the wrist base 472. The wrist body 476 defines a groove or slot, shown as panel slot 482, extending through the entire width of the wrist body 476 and away from the wrist base 472. The panel slot 482 is configured to receive the panel 332 of the adjustable panel 330 such that the wrist body 476 at least partially surrounds the adjustable panel 330. As shown in FIG. 12, the wrist systems 470 are positioned on opposing lateral sides of the adjustable panel 330. Accordingly, the adjustable panel 330 can slide through the panel slots 482, but the adjustable panel 330 is prevented from leaving the panel slots 482 entirely. As the adjustable panel 330 moves longitudinally, the adjustable panel 330 slides within the panel slots 482 and the wrist bodies 476 rotate relative to the wrist bases 472. Contact between the adjustable panel 330 and the wrist body 476 causes angular positioning of the adjustable panel 330 relative to the frame rail 315 when the panel slot 482 receives the adjustable panel 330. Accordingly, due to the wrist systems 470, every longitudinal position of the adjustable panel 330 has a corresponding rotational position.

Figure 18:
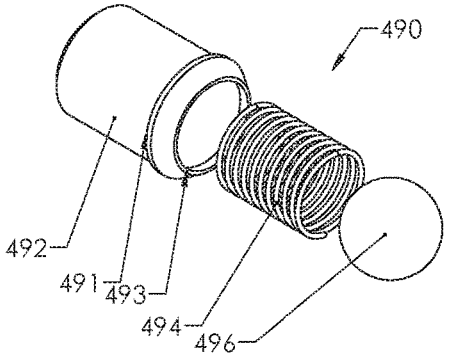
FIG. 18 is an exploded perspective view of a plunger assembly of the wrist system of FIG. 16.
Figure 19:
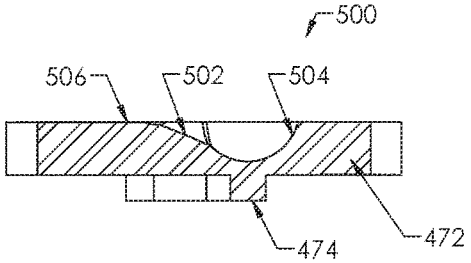
FIG. 19 is a side section view of a wrist base of the wrist system of FIG. 16.

Referring to FIGS. 16, 18, and 19, each wrist system 470 includes a pair of detent assemblies or biasing assemblies, shown as plunger assemblies 490. The use of at least a pair of plunger assemblies 490 may facilitate the balancing of the reaction forces incurred. Each plunger assembly 490 includes a receiving member, can, or cup, shown as plunger body 492. The plunger body 492 defines an aperture configured to receive a biasing member, shown as spring 494, and a detent member, shown as plunger 496. In some embodiments, the plunger 496 is spherical. The plunger 496 is translatably coupled to the plunger body 492. The spring 494 is a compression spring positioned between the plunger body 492 and the plunger 496 such that the spring 494 biases the plunger 496 out of the plunger body 492. The plunger body 492 is formed with an internal lip or crimp, shown as lip 493, that extends radially inward from the wall of the plunger body 492 to prevent the plunger 496 from leaving the plunger body 492. In some embodiments, lip 493 is omitted. Each plunger assembly 490 is inserted into a cavity or aperture defined by the wrist body 476 such that the plungers 496 are biased toward the wrist base 472. An external lip or crimp, shown as lip 491, extends radially outward from the wall of the plunger body 492. When the plunger assembly 490 is installed into the wrist body 476, the lip 491 engages the wrist body 476 to facilitate locating the plunger assembly 490 relative to the wrist body 476. In some embodiments, the lip 491 is omitted.

Referring to FIGS. 16 and 19, the plungers 496 are each selectively received within a calibrated recess or pocket, shown as pocket 500, defined in the wrist base 472. Each pocket 500 includes a ramp 502 positioned adjacent and connected to a depression 504. In some embodiments, the depression 504 is spherical, with a radius of curvature substantially equal to the radius of the plunger 496. The ramp 502 leads away from the depression 504, having a progressively shallower depth as the distance from the depression 504 increases. In some embodiments, the ramp 502 has multiple sections, each having a different slope. The ramp 502 extends along a circular path having a constant radius from the center of the aperture 478. The ramp 502 transitions into a flat surface 506.

The pocket 500 is configured to receive the plunger 496. With the plunger 496 in the pocket 500, the spring 494 presses the plunger 496 against the interior surface of the pocket 500, and the shape of the pocket 500 biases the wrist body 476 to rotate toward a biased rotational position in which the plunger 496 is centered within the depression 504. The biased rotational position may correspond to the cafeteria configuration, the buffet configuration, and/or another configuration of the adjustable panel 330. Once in the biased rotational position, the spring 494 holds the plunger 496 in place within the depression 504, thereby holding the wrist body 476 in the biased rotational position and holding the adjustable panel 330 in place relative to the frame rail 315 to prevent inadvertent movement of the adjustable panel 330, but not locking the adjustable panel 330 in place.

The quantity, geometry, and locations of the pockets 500 may be varied between different embodiments. In some embodiments, the wrist base 472 may include more than one set of pockets 500 such that the wrist body 476 has more than one biased rotational position. By way of example, the wrist base 472 may define two sets of pockets 500: one corresponding to the cafeteria configuration of the adjustable panel 330 and one corresponding to a secondary configuration (e.g., the buffet configuration) of the adjustable panel 330. In some embodiments, the wrist base 472 includes additional ramps 502 that facilitate rotation of the adjustable panel 330 in a desired direction. By way of example, the ramps 502 may assist the user to overcome the force of gravity when moving the adjustable panel 330 in the second longitudinal direction 366. Accordingly, an additional set of ramps 502 may be added to bias the adjustable panel 330 in the second longitudinal direction 366 once the plungers 496 have exited the pockets 500 corresponding to the cafeteria configuration. Near the ends of these additional ramps 502, the wrist base 472 may define depressions 504 that hold the plungers 496 in the secondary positions and/or resist further travel of the adjustable panel 330.

A first threshold torque may be applied to the wrist body 476 to rotate it out of the biased rotational position in a first rotational direction, and a second threshold torque may be applied to the wrist body 476 to rotate it out of the biased rotational position in a second rotational direction. The magnitude of the threshold torque is dependent on the strength (i.e., the spring constant) of the springs 494 and the slope of the surface that the plunger 496 moves across. Rotating the wrist body 476 such that the plunger 496 moves up the ramp 502 requires a lesser threshold torque than rotating the wrist body 476 such that the plunger 496 moves up the side of the depression 504, due to the relatively shallow slope of the ramp 502 and the relatively steep slope of the depression 504. Once the plunger 496 is moved out of the pocket 500 and rests on the flat surface 506, the springs 494 no longer provide a biasing torque due to the lack of slope. The engagement between the plunger assemblies 490 and the surfaces of the wrist base 472 (e.g., the ramp 502, the depression 504, the flat surface 506) may impart a frictional force that opposes rotation of the wrist body 476. This frictional force may be adjusted by varying the materials and finishes of the different surfaces that engage one another.

Figure 20:
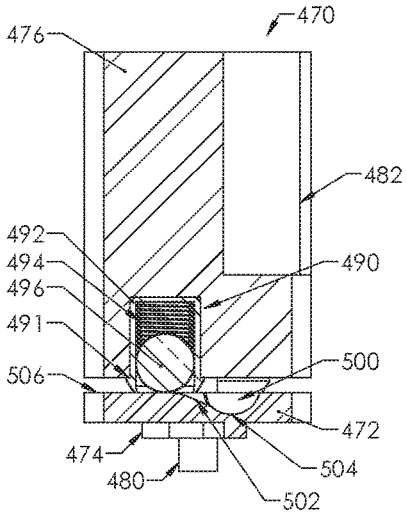
FIGS. 20-22 are front section views of the wrist system of FIG. 16.
Figure 21:
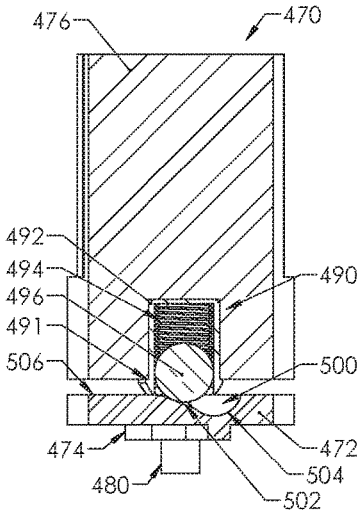
Figure 22:
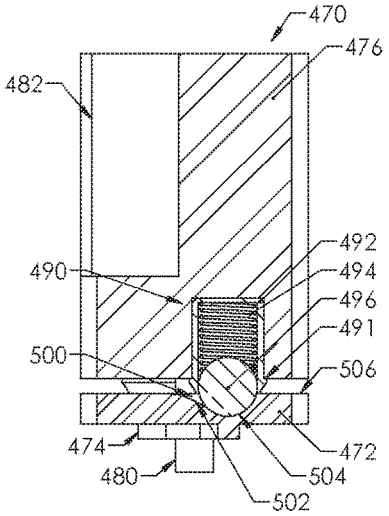

FIGS. 20-22 illustrate the process of rotating the plungers 496 into the pockets 500. In FIG. 20, the plungers 496 engage the flat surface 506 such that no biasing torque is applied to the wrist body 476. In FIG. 21, the wrist body 476 is rotated (e.g., by a user, by the force of gravity acting on the adjustable panel 330, etc.), and the plungers 496 engage the ramps 502. The plunger assemblies 490 and the ramps 502 cooperate to apply a biasing torque to bias the plungers 496 toward the depressions 504. As the plungers 496 enter the depressions 504, the momentum of the adjustable panel 330 may cause the plungers 496 to engage the surfaces of the depressions 504 opposite the ramps 502. The steep slope of these surfaces causes the plunger assemblies 490 to dissipate the momentum of the adjustable panel 330 and to push the plungers 496 to be centered within the depressions 504, as shown in FIG. 22. If a large enough torque is applied to the wrist bodies 476, however, the plungers 496 will ride out of the depressions 504. The plungers 496 have similar geometries to the depressions 504, reducing wear. The process illustrated in FIGS. 20-22 can be followed in reverse to rotate the plungers 496 out of the pockets 500.

Figure 23:
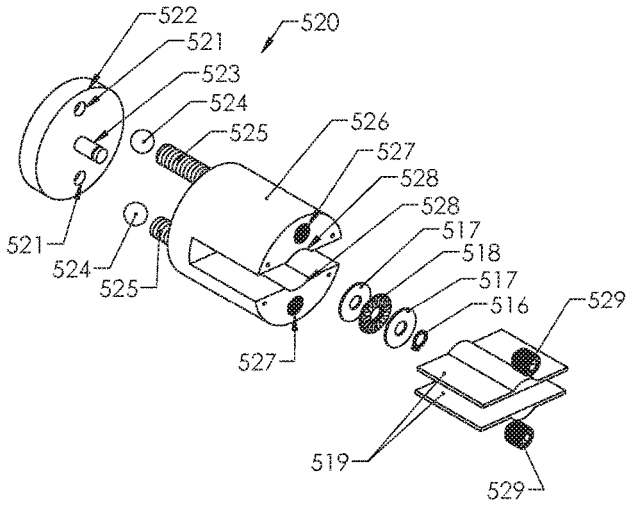
FIG. 23 is an exploded perspective view of a wrist system for a breath guard, according to an exemplary embodiment.
Figure 24:
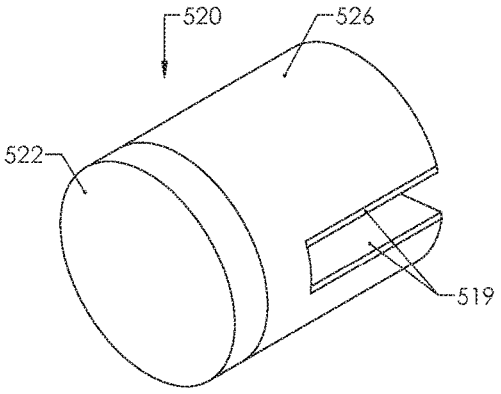
FIG. 24 is a perspective view of the wrist system of FIG. 23.

Referring to FIGS. 23 and 24, a holding or rotational positioning mechanism or assembly, shown as wrist system 520, is an alternative to the wrist system 470. The wrist system 520 may be used in place of the wrist system 470 and may be substantially similar to the wrist system 470 except as discussed herein. The wrist system 520 includes a base member, shown as wrist base 522. The wrist base 522 may have a flat bottom surface, as shown, omitting the key 474 of the wrist base 472. The wrist base 522 is configured to be coupled to one of the side panels 310. By way of example, the wrist base 522 may be adhered to one of the side panels 310. Adhesion between the flat surface of the wrist base 522 and the side panel 310 may prevent both translation and rotation of the wrist base 522, fixedly coupling the wrist base 522 to the side panel 310.

A post, protrusion, or projection, shown as axle 523, extends laterally inward from the wrist base 522. The axle 523 may have a circular cross section. A wrist body 526 defines an aperture that receives the axle 523, rotatably coupling the wrist body 526 to the axle 523. Engagement between the axle 523 and the wrist body 526 prevents relative vertical and longitudinal movement of the wrist base 522 and the wrist body 526. To prevent the wrist body 526 from separating laterally from the wrist base 522, the wrist system 520 includes a retainer or retaining ring, shown as snap ring 516, that is received within a corresponding groove of the axle 523. A bearing, shown as thrust bearing 518, surrounded by a pair of washers 517 extends between the snap ring 516 and the wrist body 526. The washers 517 are made from a material that is harder than the material of the wrist body 526 (e.g., hardened steel versus aluminum) such that one of the washers 517 helps to prevent the thrust bearing 518 causing wear on the wrist body 526. The other of the washers 517 spreads a load imparted by the snap ring 516 out over the entire area of the thrust bearing 518. The thrust bearing 518 minimizes friction between the wrist base 522 and the wrist body 526. The washers 517 and the thrust bearing 518 are received within a pair of recesses, shown as bearing bores 528. A pair of plates, shown as liners 519, are coupled to the wrist body 526. The liners 519 extend into the bearing bores 528 and each define a flat surface. Alternatively, in embodiments that do not include the bearing bores 528, the liners 519 may be flat sheets. The flat surfaces define a slot therebetween that receives the panel 332. The liners 519 may be made from a material (e.g., plastic, etc.) that has a low coefficient of friction with the material of the panel 332 to facilitate smooth movement of the adjustable panel 330.

In some embodiments, the liners 519 are coupled to the wrist body 526 (e.g., by adhesive, by fasteners, etc.). In some embodiments, the liners 519 are retained relative to the wrist by 526 by their geometries. By way of example, the liners 519 may extend into the bearing bores 528 such that engagement between the liners 519 and the bearing bores 528 limit longitudinal and vertical movement of the liners 519. In an alternative embodiment, a web extends between the liners 519 such that both liners 519 cooperate to form a continuous element. The web may press against the end of the adjustable panel 330, limiting lateral movement of the liners 519. In an embodiment where the liners 519 extend into the bearing bores 528 and the liners 519 are coupled by the web, the liners 519 may be retained relative to the wrist body 526 without the use of fasteners or adhesive.

The wrist system 520 includes a pair of detent assemblies or biasing assemblies. Specifically, the wrist base 522 defines a pair of apertures, recesses, or depressions, shown as pockets 521. As shown in FIG. 23, the pockets 521 each have a circular cross section. The wrist body 526 defines a pair of apertures, shown as threaded apertures 527. The threaded apertures 527 extend laterally through the entirety of the wrist body 526, although the threaded portion may extend along only a portion of each threaded aperture 527. A detent member, shown as plunger 524, and a biasing member, shown as spring 525, are inserted into each of the threaded apertures 527. As shown in FIG. 23, the plungers 524 are spherical. In other embodiments, the pockets 521 and/or the plungers 524 are otherwise shaped (e.g., rectangular, triangular, cylindrical, conical, etc.). A fastener, shown as set screw 529, is threaded into each of the threaded apertures 527. The set screws 529 engage the springs 525, which in turn engage the plungers 524. The springs 525 are compressed between the plungers 524 and the set screws 529, forcing the plungers 524 toward the wrist base 522. The compression of each spring 525 may be adjusted by tightening or loosening the set screws 529, thereby adjusting the force of the plungers 524 against the wrist base 522.

The surface of the wrist base 522 that engages the plungers 524 is substantially flat, except for the pockets 521. Accordingly, the wrist body 526 rotates freely except for any friction between the plungers 524 and the wrist base 522. When the centers of the plungers 524 align with the pockets 521, the springs 525 bias the plungers 524 into alignment with the pockets 521, thereby imparting a biasing torque on the wrist body 526. The magnitude of the biasing torque varies based on the forces imparted by the springs 525 (e.g., determined based on the compression and a spring constant of each spring 525) and the shapes and sizes of the pockets 521 relative to the corresponding plungers 524. Increasing the size of a pocket 521 permits the corresponding plunger 524 to enter farther into the pocket 521, which in turn increases the biasing torque and the amount of energy that is required to rotate the plunger 524 out of the pocket 521. Any of these factors may be varied to adjust the biasing torque. The plungers 524 and the pockets 521 are symmetrical such that the biasing torque is the same on each side of the pockets 521 (i.e., whether the plungers 524 enter the pockets 521 rotating clockwise or counterclockwise). When the plungers 524 are fully seated within and centered on the pockets 521, the wrist body 526 is in a biased rotational position. The biased rotational position may correspond to the cafeteria configuration, the buffet configuration, and/or another configuration of the adjustable panel 330. The springs 525 then resist rotation of the wrist body 526 out of the biased rotational position, requiring a threshold torque to be applied to the wrist body 526 to rotate the wrist body 526 out of the biased rotational position. Additional pockets 521 may be added to provide additional biased rotational positions. In some embodiments, the pockets 521 include ramps and/or depressions similar to the ramps 502 and the depressions 504.

Figure 25:
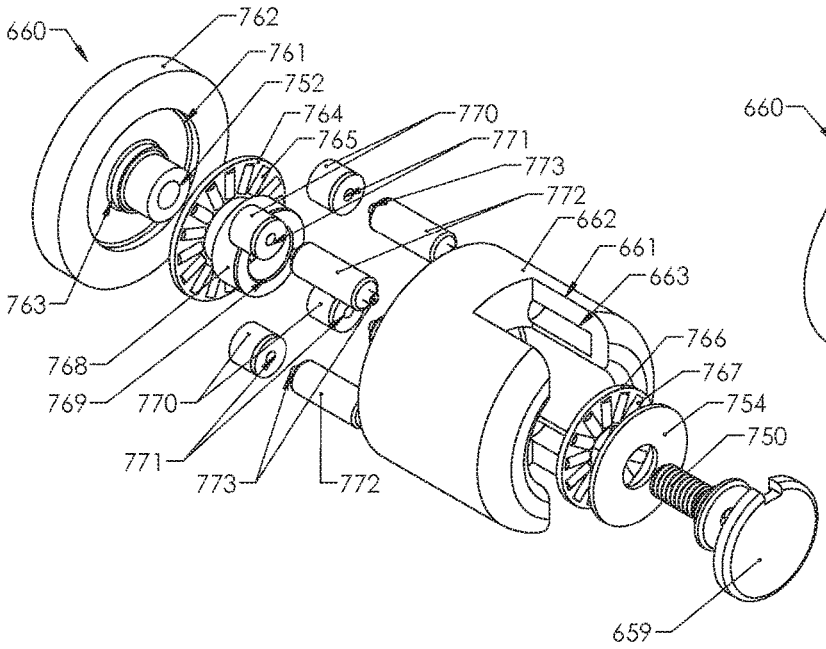
FIG. 25 is an exploded perspective view of a wrist system for a breath guard, according to another exemplary embodiment.
Figure 26:
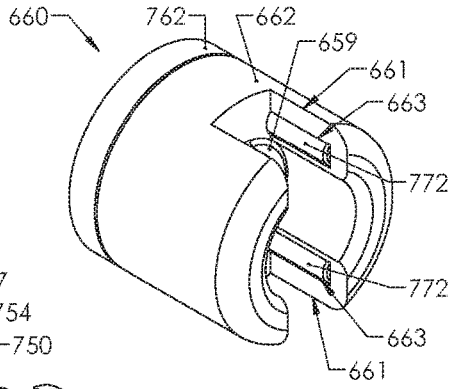
FIG. 26 is a perspective view of the wrist system of FIG. 25.

Referring to FIGS. 25 and 26, a holding or rotational positioning mechanism or assembly, shown as wrist system 660, is an alternative to the wrist system 470. The wrist system 660 may be used in place of the wrist system 470 and may be substantially similar to the wrist system 470 except as discussed herein. Each wrist system 660 includes a base member, shown as mounting plate 762, fixedly coupled to one of the side panels 310. To prevent the mounting plate 762 from rotating relative to the side panel 310, the mounting plate 762 may include one or more projections (e.g., bosses, keys, etc.) that extend from the mounting plate 762 to engage a corresponding aperture or recess defined in the side panel 310. Alternatively, the mounting plate 762 may be coupled to the side panel 310 using an adhesive (e.g., cyanoacrylate, etc.). The wrist system 660 further includes a holding member, shown as wrist body 662, rotatably coupled to the mounting plate 762.

A fastener 750 extends through an aperture defined by the wrist body 662 and engages a corresponding threaded aperture 752 defined in the center of the mounting plate 762, rotatably coupling the wrist body 662 and the mounting plate 762. A washer 754 positioned on the shaft of the fastener 750 distributes torsional and compressive loads imparted on the wrist body 662 over the head of the fastener 750. The fastener 750 can be used to couple the wrist body 662 to the mounting plate 762 after the mounting plate 762 has been coupled to the side panel 310. This facilitates precise placement of the mounting plate 762 without having to work around the wrist body 662.

The mounting plate 762 defines an annular groove or slot, shown as indent 761, centered about the threaded aperture 752. The mounting plate 762 further includes a protrusion or projection, shown as boss 763, which increases the thickness of the mounting plate 762 at the threaded aperture 752, increasing the amount of engagement between the fastener 750 and the mounting plate 762. A first bushing or bearing, shown as thrust bearing 764, is received within the indent 761. The thrust bearing 764 includes a series of rollers 765 that extend between and engage the mounting plate 762 and the wrist body 662, reducing friction caused by a compressive lateral loading imparted on the wrist system 660 (e.g., by imparting a torsional loading on the wrist system 660). A second bushing or bearing, shown as thrust bearing 766, is received between the wrist body 662 and the washer 754, which is held in place by a head of the fastener 750. The thrust bearing 766 includes a series of rollers 767 that extend between and engage the wrist body 662 and the washer 754, reducing friction caused by a tensile lateral loading imparted on the wrist system 660 (e.g., by imparting a torsional loading on the wrist system 660). A third bushing or bearing, shown as bushing 768, defines an aperture 769 that receives the outer diameter of the boss 763. The bushing 768 extends between and engages the outer diameter of the boss 763 and the wrist body 662, reducing friction caused by longitudinal and/or vertical loading on the wrist system 660. Together the thrust bearing 764, the thrust bearing 766, and the bushing 768 reduce friction within the wrist system 660 while precisely controlling the rotational movement of the wrist body 662. The space between the wrist body 662 and the mounting plate 762 is minimized such that, in the event of an impact to the wrist body 662, the force is transferred from the wrist body 662 to the mounting plate 762 with minimal damage while preserving intact the function of the friction-reducing components and their ability to provide space between the wrist body 662 and the mounting plate 762.

The wrist body 662 defines a pair of grooves or slots, shown as slots 661. The slots 661 are aligned with one another. The slots 661 extend through the entire width of the wrist body 662 and laterally inward away from the mounting plate 762. The slots 661 are configured to receive the panel 332 of the adjustable panel 330 such that the wrist body 662 at least partially surrounds the panel 332. The wrist body 662 defines a series of apertures or recesses, shown as axle recesses 663. Specifically, the wrist body 662 defines four axle recesses 663, one on each side of each slot 661. The axle recesses 663 each define an opening that opens into the slot 661 and an opening that opens laterally outward toward the mounting plate 762. The axle recesses 663 are each configured to receive a cylindrical roller or pin, shown as roller 772. The rollers 772 are each positioned tangent to the panel 332 and configured to rotate about their own central lateral axis. Each roller 772 includes a pair of projections, protrusions, or pins, shown as axles 773, extending laterally from each side of the roller 772. One of the axles 773 engages the wrist body 662, rotationally coupling the roller 772 to the wrist body 662. The other axle 773 is received within a cylindrical spacer, shown as wrist spacer 770. Specifically, the axle 773 is received within an aperture 771 of the wrist spacer 770, rotatably coupling the roller 772 and the wrist spacer 770. The wrist spacer 770 is configured to engage the wall of the axle recess 663, limiting vertical movement of the roller 772 and longitudinal movement of the roller 772 in a first direction relative to the wrist body 662. The wrist spacer 770 is press fit into the axle recess 663, limiting longitudinal movement of the roller 772 in a second direction opposite the first direction. The wrist spacer 770 may be positioned such that the wrist spacers 770 do not engage the mounting plate 762 unless an abnormally large load is experienced by the wrist system 660. Alternatively, the wrist spacer 770 may be configured to engage the mounting plate 762 to limit longitudinal movement of the roller 772. The axle recess 663 may be sized to be a close fit with the corresponding axle 773 such that, in the event of an impact to the axle 773, the force is absorbed by the wrist body 662 with minimal damage.

A plate or cover, shown as low-friction cover 659, is coupled to the wrist body 662. The low-friction cover 659 faces laterally inward and covers the fastener 750. The low-friction cover 659 is made from a material that has a low coefficient of friction when engaging the material of the panel 332 (e.g., plastic and glass, respectively).

Together, the rollers 772 and the low-friction covers 659 constrain the movement of the adjustable panel 330 such that the adjustable panel 330 is forced to rotate about the axis of rotation 343. The rollers 772 of each wrist system 660 engage the panel 332 at four different points, limiting or preventing relative rotation between the wrist body 662 and the adjustable panel 330 about the axis of rotation 643. The wrist bodies 662 and the adjustable panel 330 are free to rotate together about the axis of rotation 643, which is fixed relative to the side panels 310 by the mounting plates 762. The low-friction covers 659 each engage the lateral sides of the panel 332, limiting outward lateral movement of adjustable panel 330. The rollers 772 and the low-friction covers 659 minimize friction between the adjustable panel 330 and the wrist systems 660, facilitating free movement of the adjustable panel 330 through the slots 661. The wrist systems 660 are positioned on opposing lateral sides of the adjustable panel 330. Accordingly, the adjustable panel 330 can slide through the slots 661, but the adjustable panel 330 is prevented from leaving the slots 661 entirely. The side panels 310 are spaced such that the low-friction covers 659 limit or prevent lateral movement of the adjustable panel 330. In other embodiments, the wrist body 662 and the rollers 772 are incorporated into the wrist system 470 or the wrist system 520 (e.g., such that a plunger imparts a biasing force on the wrist body 662).

Referring to FIGS. 27-44, the breath guard 300 includes two or more load bearing elements or bearing elements (e.g., bearings, bushings, gears, pins, etc.), shown as gears 350 (e.g., spur gears, helical gears, etc.). Each gear 350 receives the axle 338 or is otherwise coupled to the axle 338 such that the gear 350 is centered about the axis of rotation 342 of the adjustable panel 330. Each of the guide rail systems 314 include a rack gear 352 coupled (e.g., fastened, welded, adhered, etc.) to the corresponding frame rail 315 and configured to engage one of the gears 350. The rack gear 352 extends longitudinally along at least a portion of the length of the guide rail system 314. The rack gear 352 is received by a slot, groove, or pocket defined in the frame rail 315 below the path of the axle 338, such that the teeth of the rack gear 352 extend upward to interface with the teeth of the gear 350. Accordingly, movement of the adjustable panel 330 in a first longitudinal direction 364 or a second longitudinal direction 366 opposite the first longitudinal direction 364 causes a corresponding rotational movement of the gears 350 and the axle 338. The arrangement of the axle 338, the gears 350, and the rack gears 352 may be similar to that of the axle 138, the gears 150, and the rack gears 152. Alternatively, the gears 350 may be omitted, and the axis of rotation 342 is maintained parallel to the lateral axis 302 by the wrist systems 470, the adjustment mechanisms 368, and the spacing of the side frame assemblies 307.

Referring again to FIGS. 27-44, the breath guard 300 includes one or more front panel adjustment mechanisms, shown as adjustment mechanisms 368, configured to selectively hold the adjustable panel 330 in a series of longitudinal positions. In some embodiments, both guide rail systems 314 each include an adjustment mechanism 368. In other embodiments, only one of the guide rail systems 314 includes an adjustment mechanism 368. Each adjustment mechanism 368 includes a pawl 370 rotatably coupled (e.g., directly, indirectly through the axle 338, etc.) to the adjustable panel 330. One or both of the guide rail systems 314 include a rack 372 configured to cooperate with one of the pawls 370 to selectively prevent longitudinal movement of the adjustable panel 130 in the first longitudinal direction 364 and to permit movement in the second longitudinal direction 366. The axle 338 extends through an aperture defined in the pawl 370, rotatably coupling the pawl 370 to the axle 338, and thereby indirectly rotatably coupling the pawl 370 to the adjustable panel 330. Accordingly, the axle 338, the gears 350, and the pawls 370 are all configured to move longitudinally in unison with the adjustable panel 330.

Figure 36:
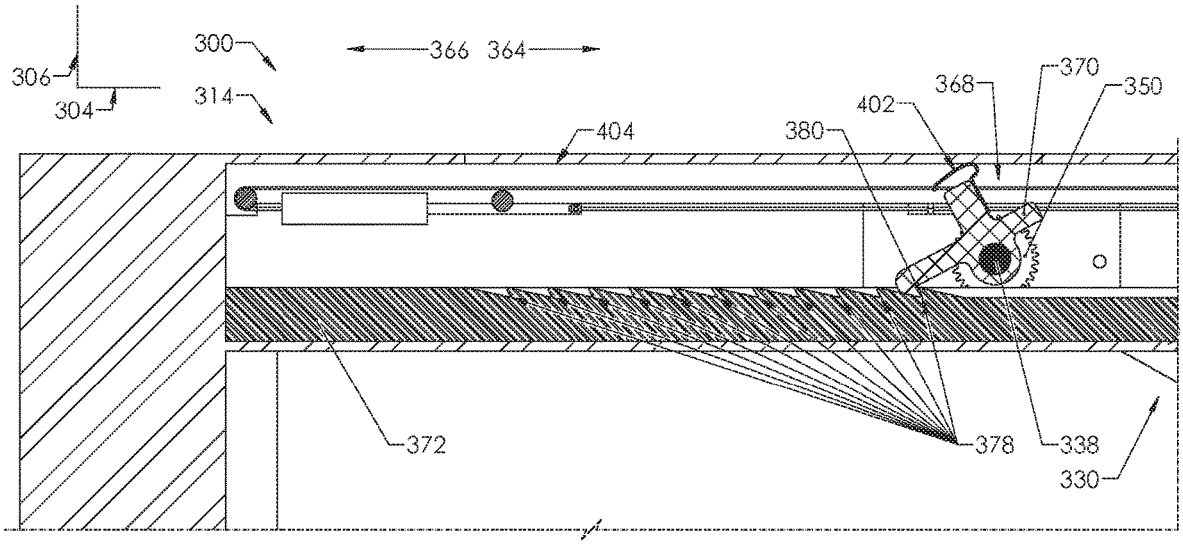
FIGS. 36-40 are side section views of the guide rail system of FIG. 27.

The rack 372 is received by a slot, groove, or pocket defined in the frame rail 315 below the path of the axle 338. The rack 372 is disposed laterally outward from the rack gear 352. It should be understood, however, that the rack 372 and the rack gear 352 may each be positioned above or below the path of the axle 338 and may have any lateral positioning relative to one another. The rack 372 is coupled (e.g., fastened, adhered, welded, etc.) to the frame rail 315. As shown in FIG. 36, the rack 372 defines a series (e.g., two, four, fifteen, etc.) of teeth 378 extending from a surface of the rack 372. Alternatively, the frame rail 315 and the rack 372 may be formed from a single component (e.g., the teeth 378 may be formed in a surface of the frame rail 315, etc.). The teeth 378 are configured to selectively engage a tooth 380 defined in the pawl 370. When the tooth 380 engages the teeth 378, the pawl 370 prevents the adjustable panel 330 from moving in the first longitudinal direction 364. The teeth 378 and the tooth 380 are angled such that the tooth 380 automatically disengages the tooth 380 when a force is applied to the adjustable panel 330 in the second longitudinal direction 366. Accordingly, the adjustable panel 330 is free to move in the second longitudinal direction 366.

Figure 35:
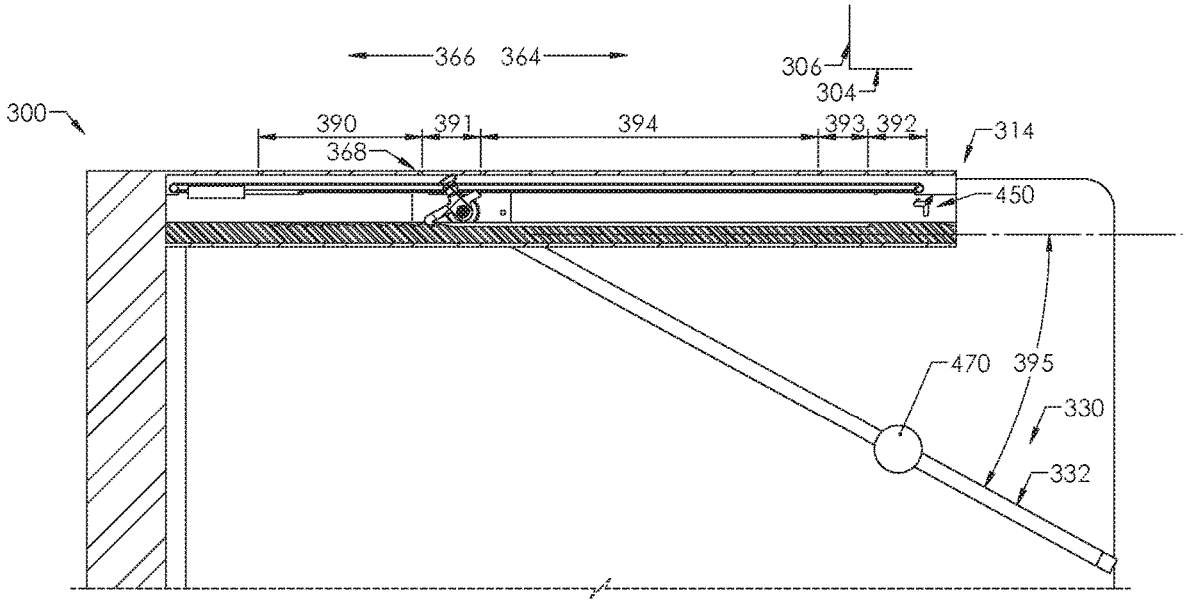
FIG. 35 is a side section view of the breath guard of FIG. 12.

As shown in FIGS. 14, 15, and 35, an angle 395 is defined between the adjustable panel 330 and a horizontal plane (e.g., the horizontal plane along which the guide rail systems 314 extend). The angle 395 may be adjusted by applying a force to the adjustable panel 330 such that the pawls 370 translate longitudinally along the rack 372 through a series of different areas or zones. Specifically, proceeding along the frame rail 315 in the first longitudinal direction 364, the pawls 370 travel through: a cleaning or loading zone 390, a self-service or buffet zone 391 (corresponding to the buffet configuration), a transition zone 394, a capture or arresting zone 393, and a full-service or cafeteria zone 392 (corresponding to the cafeteria configuration). The positions of the adjustable panel 330 associated with these zones are shown in FIG. 13.

Figure 37:
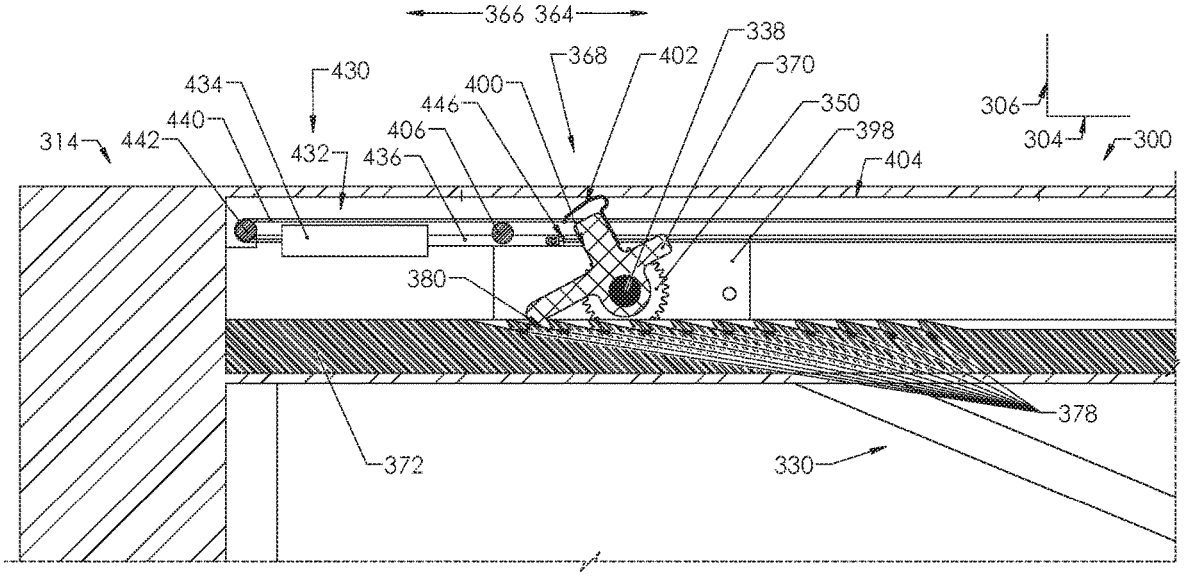
Figure 49:
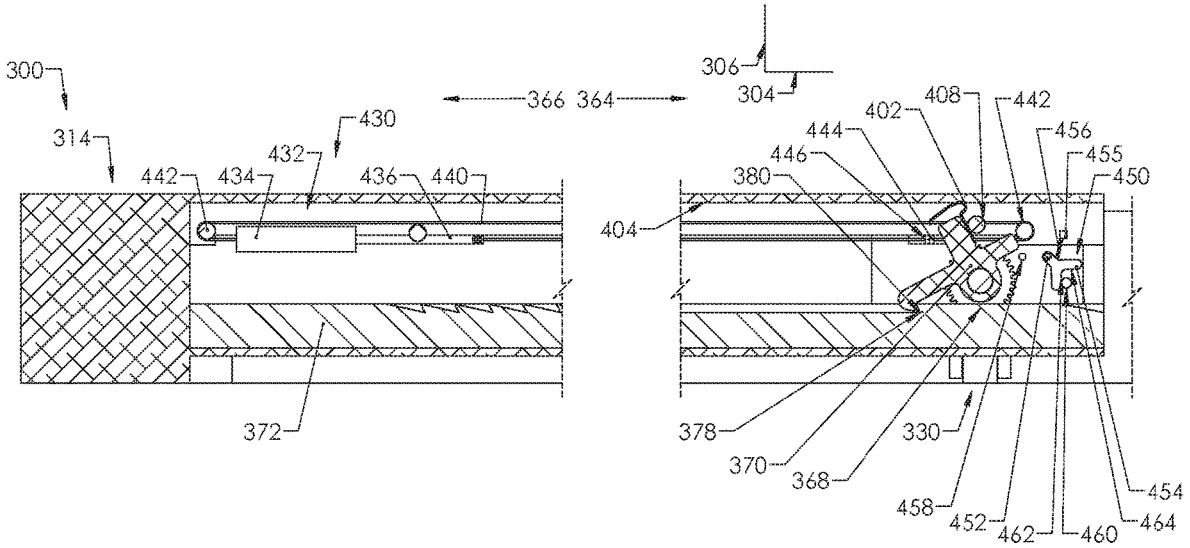

Referring to FIGS. 35, 36, 37, and 49, in some of the zones, the tooth 380 is configured to engage the teeth 378 to selectively prevent the adjustable panel 330 from moving in the first longitudinal direction 364. Proceeding in the first longitudinal direction 364, the rack 372 includes a first series of teeth 378, a space with no teeth 378, and finally a single tooth 378. All but one of the first series of teeth 378 correspond to the loading zone 390. These teeth 378 facilitate placing the adjustable panel 330 into a cleaning or loading configuration in which the top surface 16 can be easily accessed (e.g., for cleaning, for adding or removing food pans 70, etc.). An example of a loading configuration is shown in FIG. 37. The rightmost tooth 378 of the first series of teeth 378 corresponds to the buffet zone 391. As shown in FIGS. 35 and 36, this tooth 378 holds the adjustable panel 330 in the buffet configuration. The space with no teeth 378 corresponds to the transition zone 394 and the arresting zone 393. As shown in FIG. 49, the single tooth corresponds to the cafeteria zone 392. This tooth 378 holds the adjustable panel 330 in the cafeteria configuration.

Referring to FIGS. 12 and 27, the breath guard 300 further includes a pair of covers or guards, shown as covers 398. The covers 398 extend between the bracket 334 and each guide rail system 314. The covers 398 each define an aperture 397 that receives the axle 338. The apertures 397 are sized to limit or prevent relative longitudinal and vertical movement between the axle 338 and the cover 398 such that the covers 398 move longitudinally with the adjustable panel 330.

Figure 29:
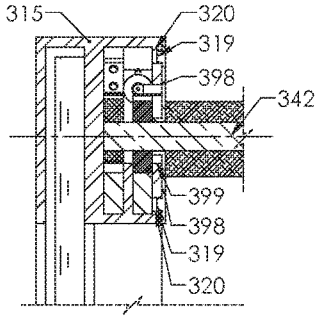
Figure 30:
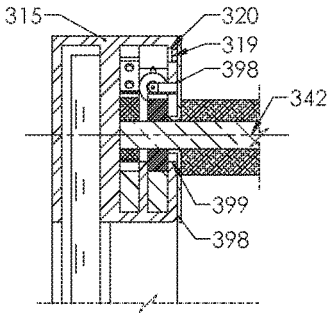

The covers 398 are rotationally fixed relative to the guide rail systems 314 (e.g., such that rotation of the covers 398 about the axis of rotation 342 is limited). This may be accomplished using a variety of different mechanisms that limit rotation while facilitating longitudinal translation of the covers 398. In the embodiments shown in FIGS. 27 and 28, a protrusion or projection (e.g., a boss, a tab, a pin, etc.), shown as protrusion 319, extends laterally outward from a main body of the cover 398 and is received within a recess or groove, shown as frame rail slot 320, defined in a lower half of the frame rail 315. The frame rail slot 320 extends longitudinally such that the protrusion 319 permits the covers 398 to move longitudinally. Engagement between the protrusion 319 and the walls of the frame rail slot 320 limits rotation of the cover 398 about the axis of rotation 342. FIG. 29 illustrates an alternative embodiment of the guide rail system 314. In this embodiment, each cover 398 includes two protrusions 319, each vertically offset from one another such that one is defined in an upper half of the frame rail 315 (e.g., above the slide slot 399), and one is defined in the lower half of the frame rail 315 (e.g., below the slide slot 399). The protrusions 319 are each received within a corresponding frame rail slot 320 defined by the frame rail 315. The protrusions 319 and the frame rail slots 320 are vertically offset from one another. In yet other embodiments, each guide rail system 314 includes three or more protrusions 319 and/or frame rail slots 320. FIG. 30 illustrates another alternative embodiment of the guide rail system 314. In this embodiment, a protrusion 319 is received within a frame rail slot 320 defined in the upper half of the frame rail 315.

Figure 31:
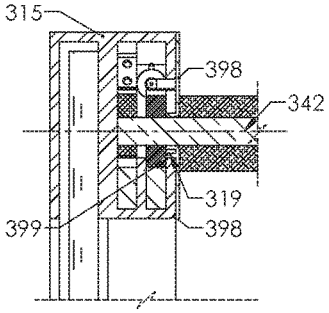

FIG. 31 illustrates yet another alternative embodiment of the guide rail system 314. In this embodiment, the cover 398 includes a protrusion 319 that engages an edge of the slide slot 399 to limit rotation of the cover 398 about the axis of rotation 342. Specifically, the protrusion 319 engages the bottom surface of the slide slot 399. Additionally or alternatively, another protrusion 319 may be provided that engages a top surface of the slide slot 399.

Figure 32:
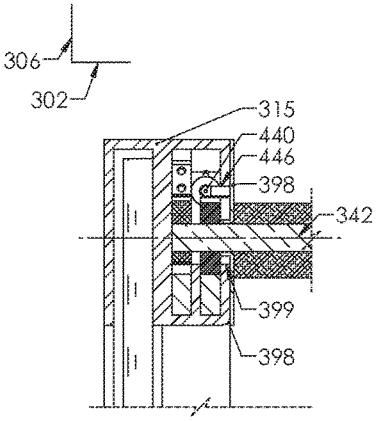

FIG. 32 illustrates yet another embodiment of the guide rail system 314. A follower 446, which is described herein, is coupled to the cover 398. The follower 446 is configured to engage the top surface of the slide slot 399 to limit rotation of the cover 398. Additionally or alternatively, the follower 446, which receives a cable 440 therethrough, may engage the cable 440 to limit rotation of the cover 398.

Figure 33:
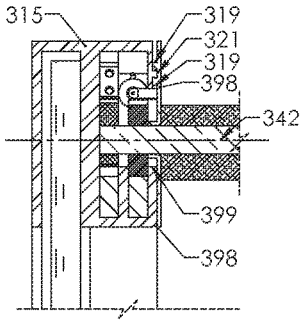
Figure 34:
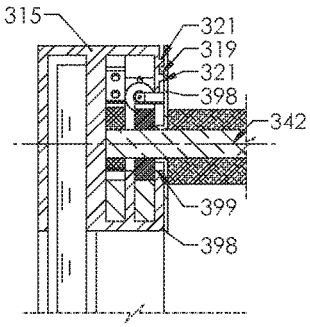

FIG. 33 illustrates yet another embodiment of the guide rail system 314. A pair of protrusions 319 extend toward the frame rail 315, defining a slot or groove therebetween. A protrusion or projection (e.g., a boss, a tab, a pin, etc.), shown as protrusion 321, extends laterally from the frame rail 315 toward the cover 398. The protrusion 321 is received between the protrusions 319, such that engagement between the protrusion 321 and the protrusions 319 limits rotation of the cover 398. FIG. 34 illustrates yet another embodiment of the guide rail system 314. A pair of protrusions 321 extend from the frame rail 315 toward the cover, defining a slot or groove therebetween. A protrusion 319 is received between the protrusions 321, such that engagement between the protrusion 319 and protrusions 321 limits rotation of the cover 398. Although specific examples of features that limit rotation of the cover 398 are shown and described herein, it should be understood that in other embodiments any such features may be combined and/or relocated along the interface between the cover 398 and the frame rail 315.

Referring to FIGS. 36-40, the pawl 370 includes a protrusion or boss, shown as leg 400, extending radially outward from the axle 338. A biasing member, shown as spring 402, is coupled to the leg 400 near the distal end of the leg 400. The spring 402 is configured to engage an inner surface 404 of the frame rail 315 positioned near the top of the frame rail 315. The inner surface 404 is arranged substantially parallel to the path of the axle 338 (e.g., horizontally) such that a substantially consistent distance is maintained between the inner surface 404 and the axis of rotation of the pawl 370 throughout the range of movement of adjustable panel 330.

Figure 39:
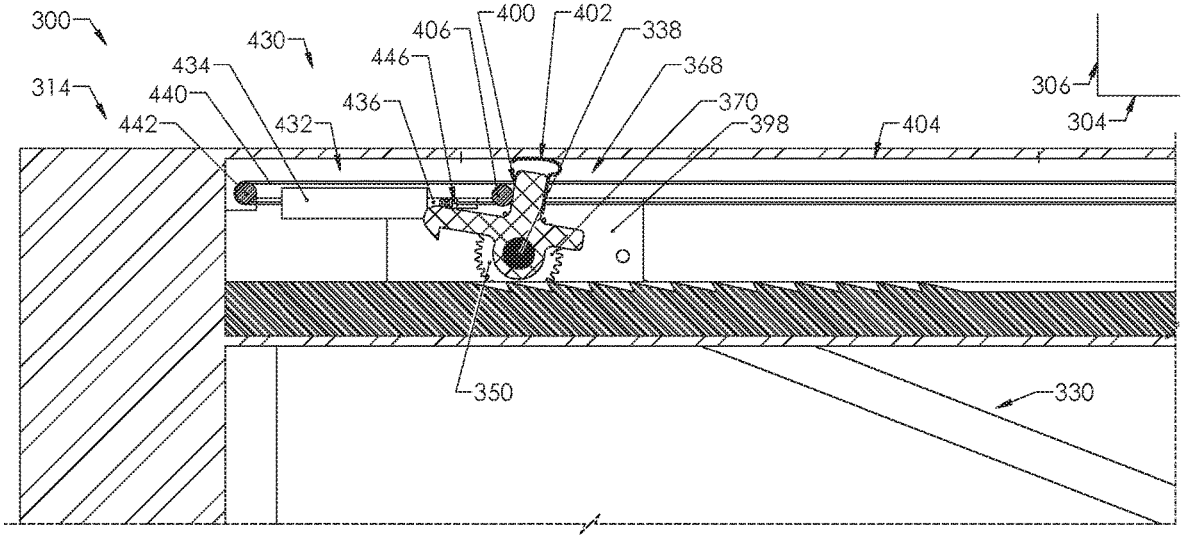
Figure 40:
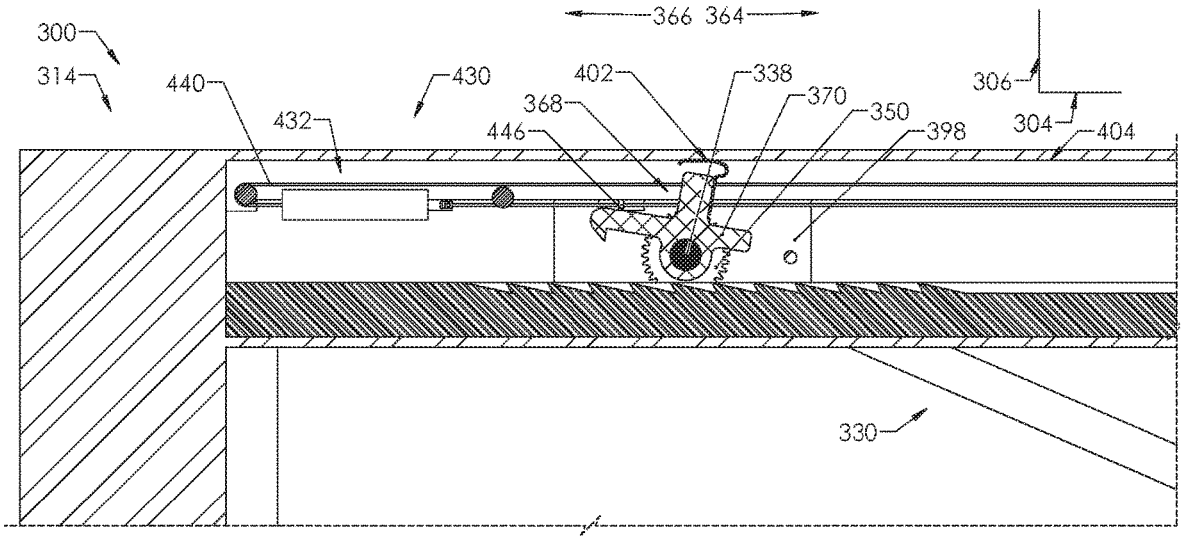
Figure 41:
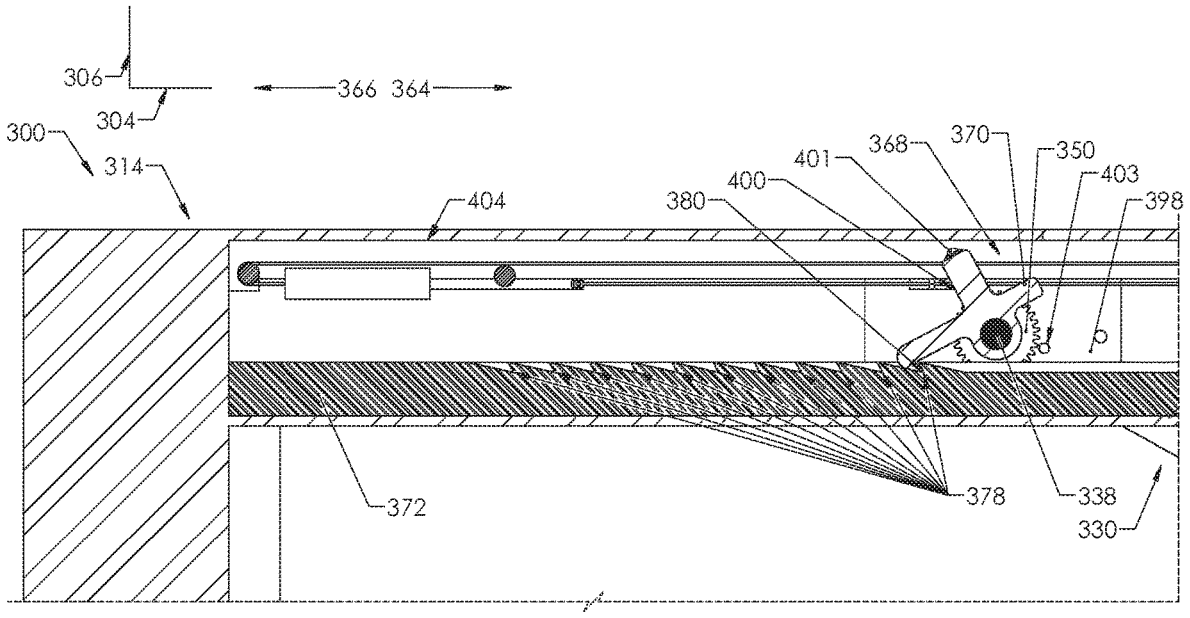
FIGS. 41-44 are side section views of a guide rail system for a breath guard, according to an exemplary embodiment.
Figure 42:
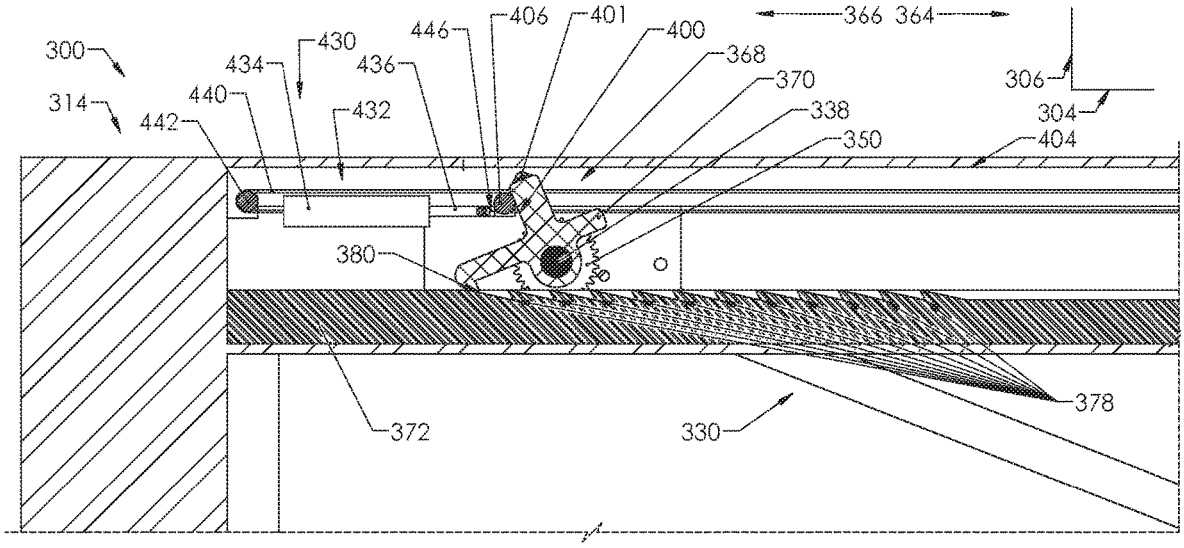
Figure 43:
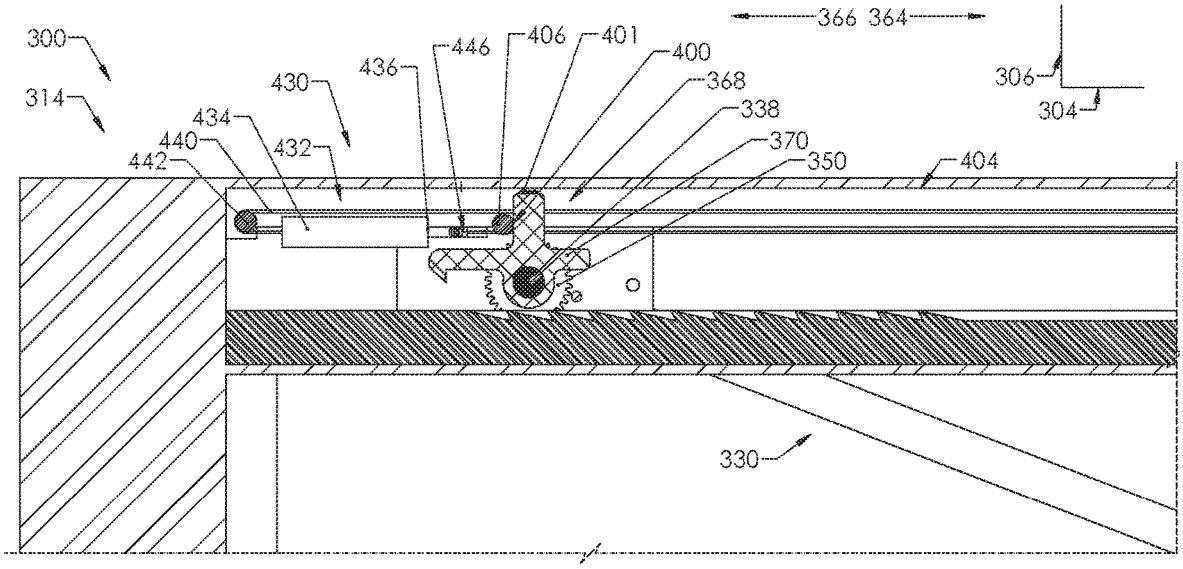

The spring 402 is configured to bias the pawl 370 into either an engaged or activated position, shown in FIGS. 36 and 37, and a disengaged or deactivated position, shown in FIGS. 39 and 40. In the activated position, the tooth 380 of the pawl 370 is configured (e.g., positioned) to engage at least one of the teeth 378 of the rack 372, preventing movement of the adjustable panel 330 in the first longitudinal direction 364 and permitting movement of the adjustable panel 330 in the second longitudinal direction 366. In the deactivated position, the tooth 380 of the pawl 370 is rotated away from the rack 372, permitting movement of the adjustable panel 330 in both the first longitudinal direction 364 and the second longitudinal direction 366. Between the activated and deactivated positions is a center position where the spring 402 experiences a maximum amount of compression. The center position may or may not be rotationally centered between the activated and deactivated positions. When the pawl 370 is positioned between the activated position and the center position, the spring 402 biases the pawl 370 toward the activated position. When the pawl 370 is positioned between the deactivated position and the center position, the spring 402 biases the pawl 370 toward the deactivated position. Accordingly, when the pawl 370 experiences a torque sufficient to overcome the biasing force of the spring 402 and move the pawl 370 beyond the center position, the spring 402 adjusts to bias the pawl 370 in a different direction. The spring 402 may be sufficiently stiff and lubricious to prevent rotation of the pawl 370 due to friction between the spring 402 and the inner surface 404.

Figure 44:
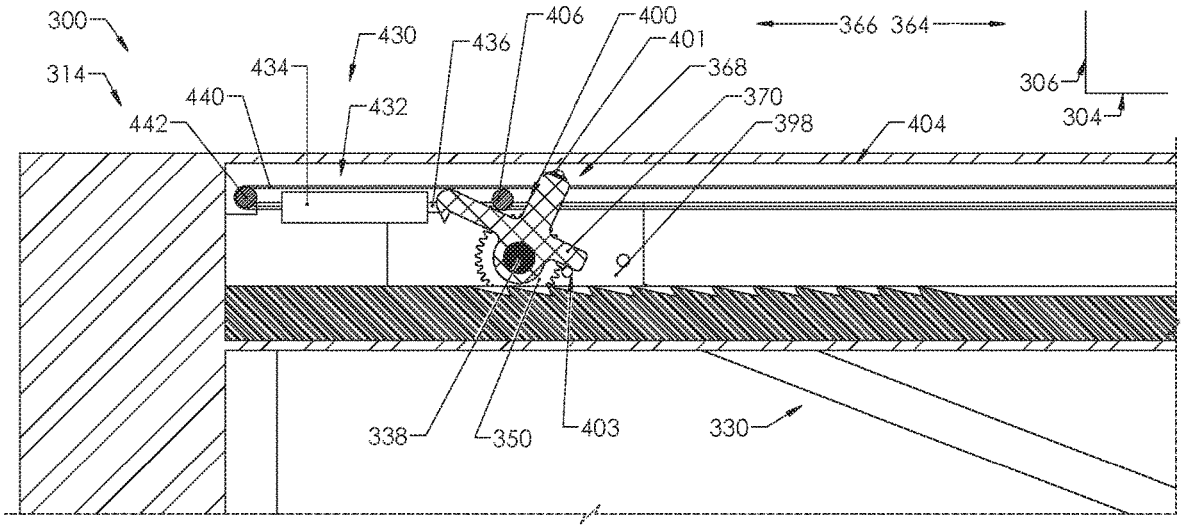

FIGS. 41-44 illustrate an alternative embodiment of the guide rail system 314. In this embodiment, the spring 402 is replaced with a biasing assembly, shown as plunger assembly 401. The plunger assembly 401 may be similar in construction to the plunger assembly 490. The plunger assembly 401 is received within an aperture or recess of the leg 400. The recess is oriented such that the plunger assembly 401 extends radially outward from the axis of rotation 342. The plunger assembly 401 functions similarly to the spring 402 except instead of deforming like the spring 402, a plunger biased by a spring of the plunger assembly 401 is forced into the leg 400. Specifically, as the pawl 370 rotates toward the center position, the plunger engages the inner surface 404 and is forced into the leg 400, compressing the spring. The spring forces the plunger against the inner surface 404, biasing the pawl 370. However, unlike the spring 402, the plunger assembly 401 only biases the pawl 370 when the pawl 370 is near the center position due to the limited contact between the plunger and the inner surface 404. Accordingly, the plunger assembly 401 resists inadvertent movement of the pawl 370 between the activated and deactivated positions. When the pawl 370 is farther from the center position, the pawl 370 is manipulated by the force of gravity but not biased by the plunger assembly 401. The center of gravity of the pawl 370 moves relative to the axis of rotation 342 between the activated and deactivated positions. In the activated position, gravity forces the pawl 370 to engage the rack 372. As shown in FIG. 44, in the deactivated position, gravity forces the pawl 370 to engage a protrusion or boss, shown as pawl rest pin 403. The pawl rest pin 403 is coupled (e.g., fastened, welded, etc.) to the cover 398. The pawl 370 rests against (e.g., atop) the pawl rest pin 403, and the location of the pawl rest pin 403 determines the orientation of the pawl 370 in the deactivated position.

In an alternative embodiment, the guide rail system 314 includes the spring 402 and the pawl rest pin 403. The spring 402 actively biases the pawl 370 toward the rack 372 when in the activated position, but does not actively bias the pawl 370 away from the rack 372 in the deactivated position. Instead, gravity holds the pawl 370 against the pawl rest pin 403 in the deactivated position. In another alternative embodiment, the spring 402 actively biases the pawl 370 away from the rack 372 in the deactivated position, but does not actively bias the pawl 370 toward the rack 372 in the activated position. Instead, gravity holds the pawl 370 against the rack 372. In other embodiments, the axis of rotation of the pawl 370 is offset from the axis of rotation 342.

Referring to FIGS. 37-40 and 42-44, the adjustment mechanism 368 further includes a first logic resetting protrusion, or pin, shown as pawl deactivation pin 406, extending from and coupled (e.g., fastened, welded, etc.) to the frame rail 315. The pawl deactivation pin 406 is positioned such that the pawl deactivation pin 406 engages the leg 400 when the adjustable panel 330 moves in the second longitudinal direction 366 into a logic disengaging position near the end of the loading zone 390. As the adjustable panel 330 enters the logic disengaging position, the pawl deactivation pin 406 pushes against the leg 400, introducing a torque on the pawl 370 and moving the pawl 370 toward the deactivated position. As the pawl 370 reaches the center position, the plunger assembly 401 or the spring 402 begins to bias the pawl 370 toward the deactivated position. The adjustable panel 330 may continue to move in the second longitudinal direction 366 until the pawl deactivation pin 406 pushes the pawl 370 fully into the deactivated position, or the plunger assembly 401 or the spring 402 may move the pawl 370 into the deactivated position automatically. Once fully in the deactivated position, the spring 402 and/or gravity hold the pawl 370 in the deactivated position. The adjustable panel 330 may then be freely moved in both the first longitudinal direction 364 and the second longitudinal direction 366.

Figure 52:
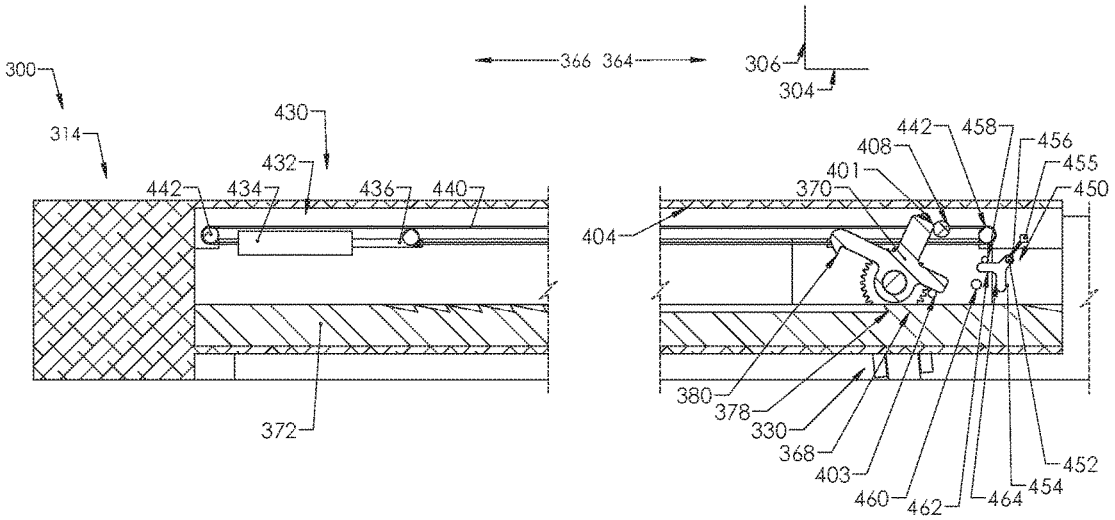
FIGS. 52-54 are side section views of the guide rail system of FIG. 41.
Figure 53:
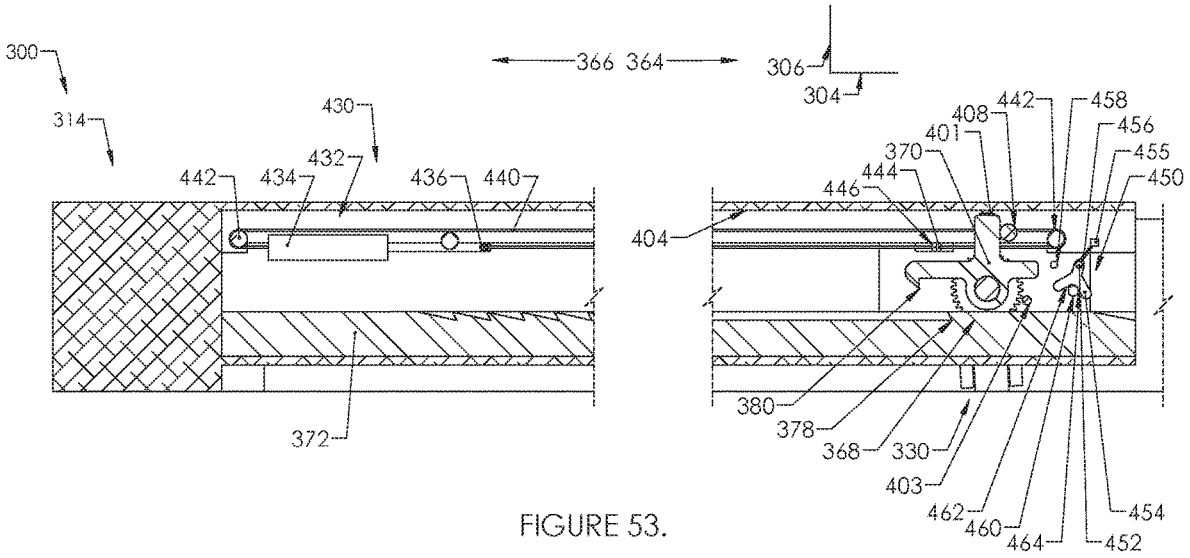
Figure 54:
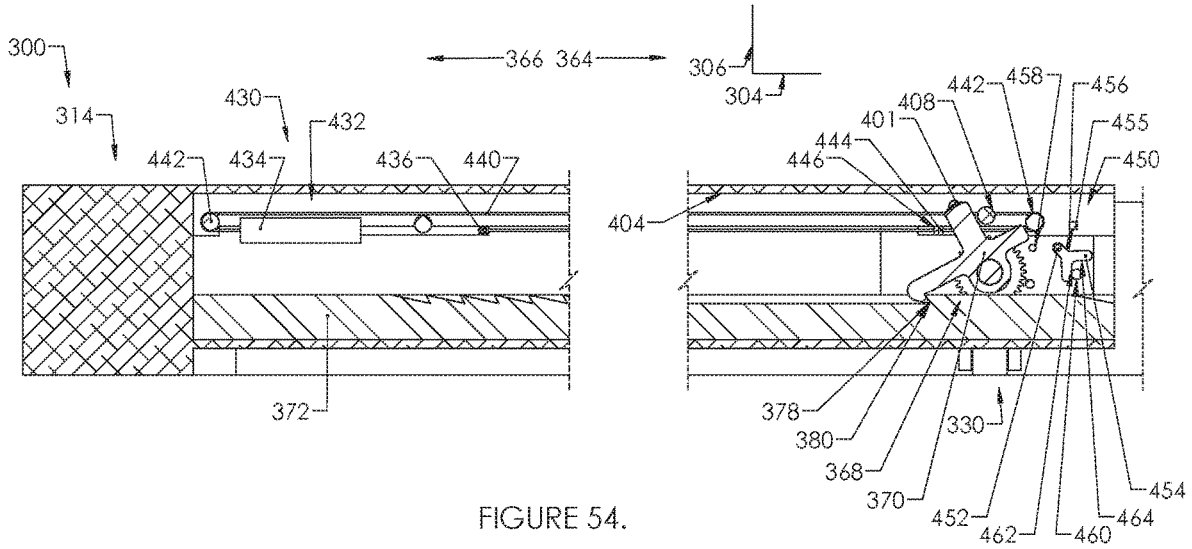

Referring to FIGS. 45-51, the adjustment mechanism 368 further includes a second logic resetting protrusion, boss, or pin, shown as pawl activation pin 408, extending from and coupled (e.g., fastened, welded, etc.) to the frame rail 315. The pawl activation pin 408 is longitudinally offset (i.e., offset along the longitudinal axis 304) relative to the pawl deactivation pin 406 such that the pawl activation pin 408 contacts the leg 400 when the adjustable panel 330 moves in the first longitudinal direction 364 into a logic resetting position located near (e.g., on either side of, within, etc.) the cafeteria zone 392. As illustrated, the pawl activation pin 408 engages the leg 400 just before the tooth 380 of the pawl 370 reaches the tooth 378 of the cafeteria zone 392. As the adjustable panel 330 moves into the logic resetting position, the pawl activation pin 408 pushes against the leg 400, introducing a torque on the pawl 370 and moving the pawl 370 toward the activated position. As the pawl 370 reaches the center position, the spring 402 begins to bias the pawl 370 toward the activated position. The adjustable panel 330 may continue to move in the first longitudinal direction 364 until the pawl activation pin 408 pushes the pawl 370 fully into the activated position, or the spring 402 and/or gravity may move the pawl 370 into the activated position automatically. Once fully in the activated position, the spring 402 holds the pawl 370 in the activated position. The adjustable panel 330 may then be freely moved in the second longitudinal direction 366, but is prevented from being moved in the first longitudinal direction 364 (e.g., by engagement between the tooth 380 and the tooth 378 of the cafeteria zone 392). FIGS. 52-54 illustrate a similar process in an embodiment where the spring 402 is replaced with the plunger assembly 401.

Referring to FIGS. 27,37-40, and 45-51, the breath guard 300 further includes a pair of damping systems, shown as damping assemblies 430. Although only one damping assembly 430 is shown, it should be understood that each guide rail system 314 may include a damping assembly 430. Each damping assembly 430 is configured to provide damping forces that oppose the longitudinal movement of the adjustable panel 330 when the adjustable panel 330 is near the limits of its travel. The damping assembly 430 includes a damper assembly, shown as snubber 432. The snubber 432 includes a body 434 configured to receive a rod 436 such that an internal volume is defined between the body 434 and the rod 436. The body 434 is coupled (e.g., fastened, welded, etc.) to the frame rail 315, and the rod 436 is configured to travel longitudinally relative to the body 434. The body 434 and the rod 436 are sized such that air can pass into or out of the internal volume of the snubber 432 through one or more orifices (e.g., apertures defined in the body 434, an annular aperture formed by a loose fit between the body 434 and the rod 436, etc.). Accordingly, when the rod 436 moves relative to the body 434, air is forced through the orifices to impart a damping force on the rod 436.

Figure 45:
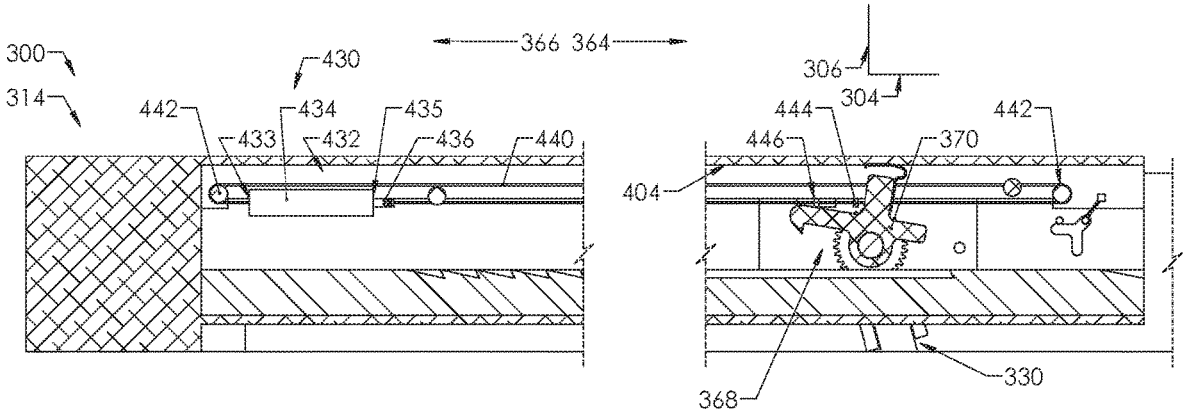
FIGS. 45-51 are side section views of the guide rail system of FIG. 27.
Figure 46:
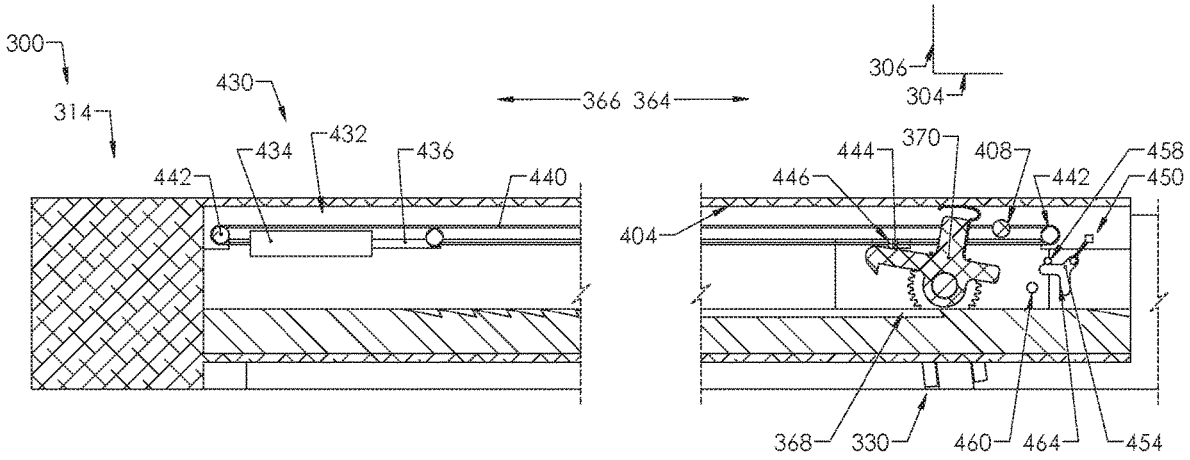

The magnitude of the damping force may be varied by varying the sizes of the orifices and/or the speed at which the rod 436 is moved. In some embodiments, the magnitude of the damping force is the same for movement of the rod 436 in both the first longitudinal direction 364 and the second longitudinal direction 366. In other embodiments, the magnitude of the damping force varies between movement of the rod 436 in the first longitudinal direction 364 and movement of the rod 436 in the second longitudinal direction 366. As shown in FIG. 45, the body 434 has an open face 433 (e.g., that passes air therethrough easily) at one end and a calibrated leak face 435 (e.g., that resists passing air therethrough) opposite the open face 433. The rod 436 includes a piston, defining an internal volume between the calibrated leak face 435, the wall of the body 434, and the piston. When the piston is near the calibrated leak face 435 (e.g., the rod 436 is near full extension), the volume of air within the snubber 432 is relatively small and thus the damping forces on the rod 436 are relatively high. When the piston is positioned near the open face 433 (e.g., the rod 436 is near full retraction), the volume of air within the snubber 432 is relatively large and thus the damping forces on the rod 436 are relatively low. As such, the damping forces are different when traveling in one direction than in another direction. Additionally or alternatively, a check valve may be added to the snubber 432 to open or close orifices based on the direction of the air flow. Although the rod 436 is shown extending from the body 434 in only one direction, the shape of the rod 436 may vary between different embodiments. By way of example, the rod 436 may extend from both sides of the body 434, or the rod 436 may simply be a piston that does not extend from the body 434 at all. Alternatively, the snubber 432 may be a different type of damper (e.g., a hydraulic damper, etc.). By way of example, the snubber 432 may be a dashpot. The dashpot may be configured with the same resistance in both directions, different resistances in each direction, and/or a resistance that is a function of a rate of travel of the adjustable panel 330.

The damping assembly 430 further includes a rope, string, cable, filament, line, or other type of tensile member, shown as cable 440. The cable 440 extends longitudinally along the guide rail system 314, forming a loop having an upper portion and a lower portion. The cable 440 extends around a pair of pins, bushings, or bearings, shown as idlers 442. The idlers 442 are coupled to the frame rail 315. The idlers 442 hold the cable 440 taut while facilitating rotation of the cable 440 around the idlers 442. The idlers 442 are offset longitudinally from one another. In some embodiments, the longitudinal spacing of the idlers 442 is adjustable to facilitate tensioning the cable 440. The idlers 442 may be configured to facilitate slippage between the cable 440 and the idlers 442 (e.g., configured with a hard, smooth outer surface, etc.), or the idlers 442 may be configured to rotate relative to the frame rail 315 (e.g., using bearings or bushings, etc.). In some embodiments, one or both of the idlers 442 are configured to impart a damping force on the cable 440 (e.g., using friction). In such embodiments, the snubber 432 may be omitted, and the idlers 442 may act as dampers. The bottom portion of the cable 440 is fixedly coupled to the rod 436 such that a longitudinal movement of the rod 436 causes a corresponding rotation of the cable 440 around the idlers 442. As shown in FIG. 34, a crimp or ferrule 444 is coupled (e.g., fixedly) to the bottom portion of the cable 440 opposite the snubber 432. In other embodiments, the cable 440 is replaced with a solid rod coupled to the snubber 432. In such embodiments, the ferrule 444 may be a protrusion extending from the rod.

Referring to FIGS. 27 and 45-54, a protrusion or slider, shown as follower 446, is coupled (e.g., fastened, welded, etc.) to the cover 398 and thereby indirectly coupled to the adjustable panel 330. Accordingly, the follower 446 moves longitudinally with the adjustable panel 330. The follower 446 defines an aperture that receives the bottom portion of the cable 440. The aperture is sized such that the follower 446 does not directly engage the cable 440. Instead, the follower 446 indirectly engages the cable 440 through the ferrule 444. In other embodiments, the follower 446 is coupled to another component that translates with the cover 398 (e.g., the pawl 370, the axle 338, etc.). The follower 446 is offset from the axis of rotation 342, imparting a moment on the cover 398 about the axis of rotation 342, which is resisted as described herein. In other embodiments, the follower 446 is aligned with the axis of rotation 342, imparting a negligible moment on the cover 398.

Referring to FIGS. 36-54, the longitudinal range of travel of the follower 446 may be divided into three portions. The first portion of the longitudinal range (shown for example in FIGS. 37-39), which corresponds to part of the loading zone 390, extends between where the follower 446 engages the fully extended snubber 432 and where the follower 446 engages the fully retracted snubber 432. When the adjustable panel 330 travels in the second longitudinal direction 366 while in the first portion, the snubber 432 imparts a damping force on the adjustable panel 330 in the first longitudinal direction 364 through the follower 446. This damping force may warn the user that the adjustable panel 330 is near the end of its range of travel. When the adjustable panel 330 travels in the first longitudinal direction 364 while in the first portion, the snubber 432 does not impart a damping force on the adjustable panel 330. When the snubber 432 is fully retracted, the snubber 432 may prevent further movement of the adjustable panel 330 in the second longitudinal direction 366. Additionally or alternatively, engagement between the pawl deactivation pin 406 and the leg 400 may limit movement of the adjustable panel 330 in the second longitudinal direction 366. Additionally or alternatively, the slide slots 399 may be sized to limit movement of the adjustable panel 330 in the second longitudinal direction 366.

The second portion of the longitudinal range, which corresponds to part of the loading zone 390, the buffet zone 391, and the transition zone 394, extends between where the follower 446 engages the fully extended snubber 432 and where the follower 446 engages the ferrule 444 with the snubber 432 fully retracted. When the adjustable panel 330 travels within the second portion, the snubber 432 does not impart a damping force on the adjustable panel 330 regardless of the direction of travel of the adjustable panel 330.

The third portion of the longitudinal range (shown for example in FIGS. 46-49), which corresponds to the arresting zone 393 and the cafeteria zone 392, extends between where the follower 446 engages the ferrule 444 with the snubber 432 fully retracted and where the follower 446 engages the ferrule 444 with the snubber 432 fully extended. When the adjustable panel 330 travels in the first longitudinal direction 364 while in the third portion, the snubber 432 imparts a damping force on adjustable panel 330 in the second longitudinal direction 366 through the follower 446, the ferrule 444, and the cable 440. When the adjustable panel 330 travels in the second longitudinal direction 366 while in the third portion, the snubber 432 does not impart a damping force on the adjustable panel 330. When the snubber 432 is fully extended, the snubber 432 may prevent further movement of the adjustable panel 330 in the first longitudinal direction 364. Additionally or alternatively, engagement between the pawl activation pin 408 and the leg 400 may limit movement of the adjustable panel 330 in the first longitudinal direction 364. Additionally or alternatively, the slide slots 399 may be sized to limit movement of the adjustable panel 330 in the first longitudinal direction 364.

In the embodiment shown in FIGS. 27 and 45-54, the snubber 432 does not include a biasing member. Accordingly, the snubber 432 remains stationary unless acted upon (directly or indirectly through the cable 440) by the follower 446. Movement of the adjustable panel 330 within the first portion of the longitudinal range of travel retracts the snubber 432 and applies a tensile force to the cable 440 which moves the ferrule 444 in the second longitudinal direction 366. Movement of the adjustable panel 330 within the third portion of the longitudinal range moves the ferrule 444 in the first longitudinal direction 364 and applies a tensile force to the cable 440 which extends the snubber 432. In other embodiments, the guide rail system 314 includes a biasing member (e.g., a compression spring) that imparts a biasing force on the adjustable panel 330 based on the position of the adjustable panel 330. Such a biasing member may be coupled to or separated from the snubber 432.

In one alternative embodiment, the ferrule 444 is coupled to the top portion of the cable 440, and an additional ferrule 444 is also coupled to the top portion of the cable 440 and positioned opposite the other ferrule 444. The follower 446 is positioned such that the follower 446 receives the top portion of the cable 440. In this embodiment, instead of the follower 446 engaging the snubber 432 directly, the follower 446 engages the snubber 432 indirectly through the ferrules 444 and the cable 440. Additionally, in this embodiment, the snubber 432 extends when the adjustable panel 330 is within the first portion of the longitudinal range of travel and retracts when the adjustable panel 330 is within the third portion. Alternatively, the snubber 432 may be moved to the top portion of the cable 440 and the second ferrule 444 may be omitted. Further alternatively, both ferrules 444 may be on the bottom portion and the snubber 432 may be coupled to the top portion.

In another alternative embodiment, the cable 440 forms a continuous loop that extends around the idlers 442. The cable 440 is fixed to the adjustable panel 330 (e.g., directly and fixedly coupled to the cover 398, etc.) such that a longitudinal movement of the adjustable panel 330 causes a corresponding movement of the cable 440. Accordingly, the follower 446 may be omitted. The snubber 432 is positioned such that the top portion of the cable 440 extends through the snubber 432 (e.g., through an aperture defined in the rod 436) without engaging the snubber 432 directly. Accordingly, the snubber 432 is decoupled from the cable 440 such that the cable 440 moves freely through the snubber 432. A ferrule 444 is fixedly coupled to the top portion of the cable 440 on each side of the snubber 432. The ferrules 444 are positioned to engage the rod 436 of the snubber 432 when the adjustable panel 330 is in the first portion or the third portion of the longitudinal range of travel. In each of the embodiments discussed herein, the damping assembly 430 is configured to provide similar damping forces in similar locations throughout the various portions of the longitudinal range. The sizes of the portions of the longitudinal range may be varied by varying the positions of the snubber 432 and the ferrules 444.

In another alternative embodiment, the guide rail system 314 includes two snubbers 432 that act independent of one another. By way of example, one snubber 432 may impart a damping force on the adjustable panel 330 when the adjustable panel 330 travels in the first longitudinal direction 364, and the other snubber 432 may impart a damping force on the adjustable panel 330 when the adjustable panel 330 travels in the second longitudinal direction 366. Such snubbers 432 may be reset (e.g., extended, retracted, etc.) independently of one another. By way of example, each snubber 432 may include a biasing member that automatically resets the snubber 432.

Figure 47:
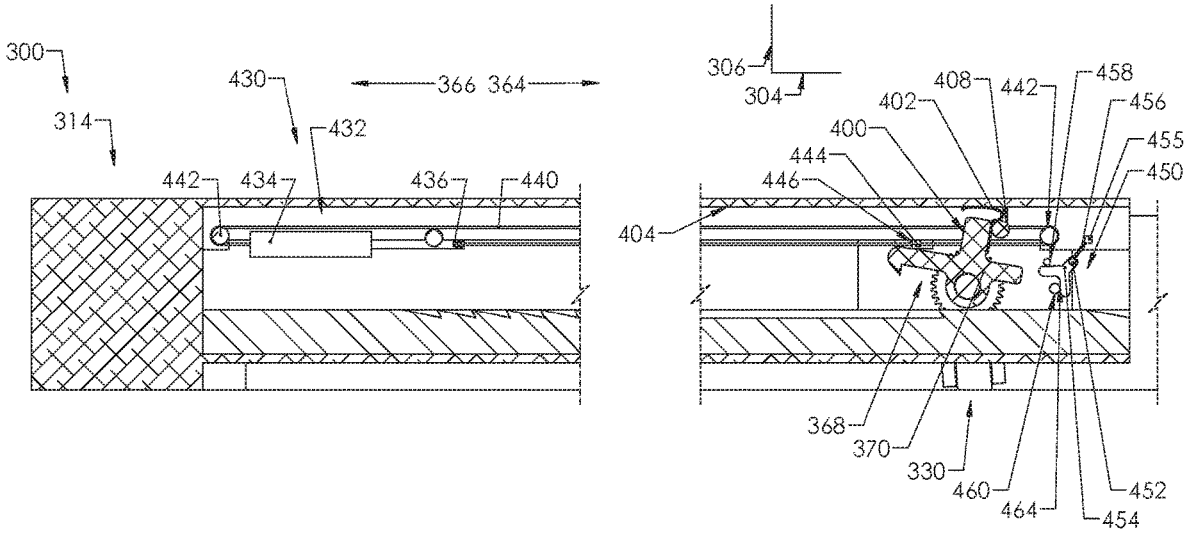

Referring to FIG. 47, in some embodiments, the breath guard 300 includes a pair of upper over-center mechanisms or holding assemblies, shown as rail-mount capture systems 450. Although only one rail-mount capture system 450 is shown, it should be understood that one or both guide rail systems 314 may include an over-center assembly, shown as rail-mount capture system 450. Each rail-mount capture system 450 is configured to apply a biasing force to hold the adjustable panel 330 in the cafeteria configuration. The rail-mount capture system 450 includes a protrusion or pin, shown as axle 452, extending laterally from and coupled to the frame rail 315. A Y-shaped paddle member or over-center member 454 is configured to receive the axle 452 such that the over-center member 454 is rotatable relative to the guide rail system 314 about a horizontal axis. A biasing member, shown as spring 456, is coupled to the over-center member 454 at a first attachment point and to a boss, shown as spring mount 455, at a second attachment point. The spring mount 455 is coupled (e.g., fastened, welded, etc.) to the frame rail 315. Accordingly, the spring 456 extends between the over-center member 454 and the spring mount 455. A protrusion, shown as stop pin 458, extends laterally outward from the frame rail 315 and is positioned to limit rotation of the over-center member 454. Another protrusion, shown as capture pin 460, is coupled (e.g., fastened, welded, etc.) to the cover 398 and thereby coupled to and configured to move longitudinally in unison with the adjustable panel 330.

Referring to FIGS. 46-51, the over-center member 454 is selectively repositionable between a held position, a center position, and an open position. Each of these positions also corresponds to a similarly named position of the adjustable panel 330. It should be understood that the center positon may or may not be directly centered between the held and open positions. In FIG. 49, the rail-mount capture system 450 is located in the held position, which corresponds to the cafeteria configuration of the adjustable panel 330. While in the held position, the capture pin 460 engages a first engagement surface, shown as capture surface 462, of the over-center member 454. In this position, the first attachment point and the second attachment point of the spring 456 are not positioned in line (i.e., are positioned out of alignment) with the axle 452. Accordingly, the spring 456 imparts a moment on the over-center member 454 in a first rotational direction (counterclockwise as shown in FIG. 49). This transfers a longitudinal force into the capture pin 460, biasing the adjustable panel 330 in the first longitudinal direction 364. In some embodiments, the adjustable panel 330 is prevented from moving in the first longitudinal direction 364 beyond the cafeteria configuration and held position (e.g., by one or more stops contacting the cover 398, by engagement between the tooth 380 and a tooth 378 etc.). Accordingly, the spring 456 holds the adjustable panel 330 in place until a threshold force is applied to the adjustable panel 330. This prevents the adjustable panel 330 from being moved out of the cafeteria configuration unintentionally, but does not lock the adjustable panel 330 in place.

Figure 48:
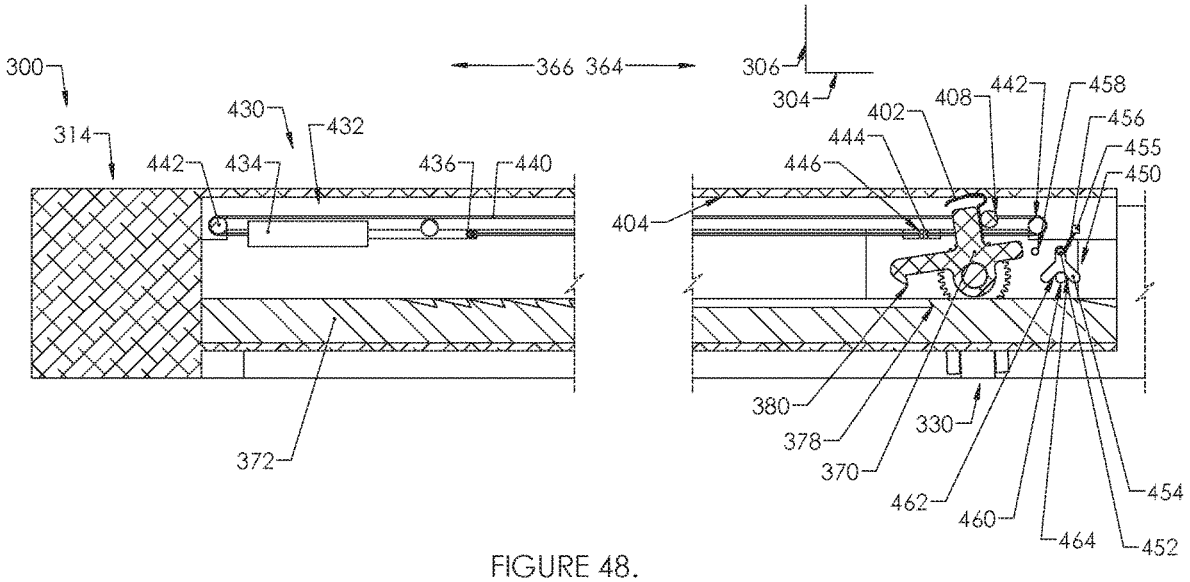

Once a threshold force is applied to the adjustable panel 330 (e.g., in the second longitudinal direction 366), the moment imparted by the spring 456 is overcome, and the adjustable panel 330 moves in the second longitudinal direction 366. As the adjustable panel 330 moves, the engagement between the capture pin 460 and the capture surface 462 of the over-center member 454 causes the over-center member 454 to rotate in a second rotational direction (clockwise as shown in FIG. 48). FIG. 48 shows the rail-mount capture system 450 in an intermediate position located between the held and open positions. As the adjustable panel 330 continues to move, the adjustable panel 330 eventually enters a center position, which corresponds to a center position of the rail-mount capture system 450. In the center position, the first attachment point and the second attachment point of the spring 456 are positioned in line with the axle 452 such that a straight line drawn between the first attachment point and the second attachment point intersects the axis of rotation of the over-center member 454. In this position, the spring 456 imparts a negligible moment on the over-center member 454.

If the adjustable panel 330 is again moved in the second longitudinal direction 366, the first attachment point and the second attachment point again move out of alignment with the axle 452. However, the spring 456 is then positioned on the opposite side of the axle 452 such that the spring 456 imparts a moment on the over-center member 454 in a second rotational direction (clockwise as shown in FIG. 47). This moment forces a second engagement surface, shown as eject surface 464, of the over-center member 454 to engage the capture pin 460. This transfers a longitudinal force onto the capture pin 460, biasing the adjustable panel 330 in the second longitudinal direction 366. The adjustable panel 330 may then continue to be moved in the second longitudinal direction 366 until it reaches the open position.

Referring to FIG. 47, the rail-mount capture system 450 is shown in the open position. In the open position, the over-center member 454 is rotated in the second rotational direction until the over-center member 454 engages the stop pin 458. Once the over-center member 454 engages the stop pin 458, the stop pin 458 prevents further rotation of the over-center member 454, and the spring 456 no longer biases the adjustable panel 330. The adjustable panel 330 may then continue to be moved in the second longitudinal direction 366 and into a free position where the capture pin 460 is no longer in contact with the over-center member 454. When the adjustable panel 330 is moved into the free position, shown in FIG. 46, the spring 456 holds the over-center member 454 in the open position until the capture pin 460 once again engages the eject surface 464. When the adjustable panel 330 is moved into the cafeteria configuration, the same sequence of events occurs, but in reverse.

Referring to FIGS. 12 and 55-57, in some embodiments, the breath guard 300 includes a pair of lower over-center mechanisms or holding assemblies, shown as foot-mount capture systems 550. Each foot-mount capture system 550 is configured to apply a biasing force to hold the adjustable panel 330 in the cafeteria configuration. The foot-mount capture system 550 includes a protrusion or pin, shown as axle 552, extending vertically upward from and coupled to the bracket 312. A Y-shaped paddle member or over-center member 554 is configured to receive the axle 552 such that the over-center member 554 is rotatable relative to the bracket 312 about a vertical axis. A biasing member, shown as spring 556, is coupled to the over-center member 554 at a first attachment point and to a boss, shown as spring mount 555, at a second attachment point. The spring mount 555 is coupled (e.g., fastened, welded, etc.) to the bracket 312. Accordingly, the spring 556 extends between the over-center member 554 and the spring mount 555. A protrusion, shown as stop pin 558, extends vertically upward from the bracket 312 and is positioned to limit rotation of the over-center member 554.

Figure 55:
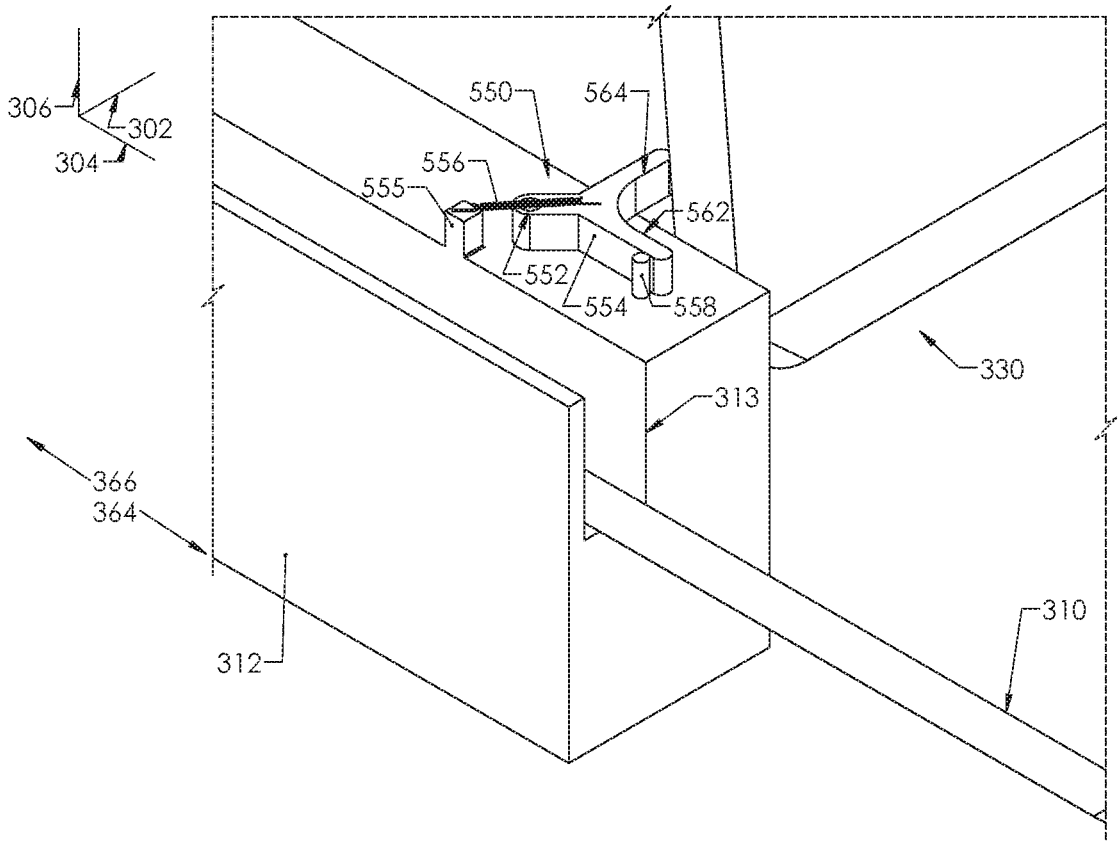
FIGS. 55-57 are perspective views of a foot-mount capture system of the breath guard of FIG. 12.
Figure 56:
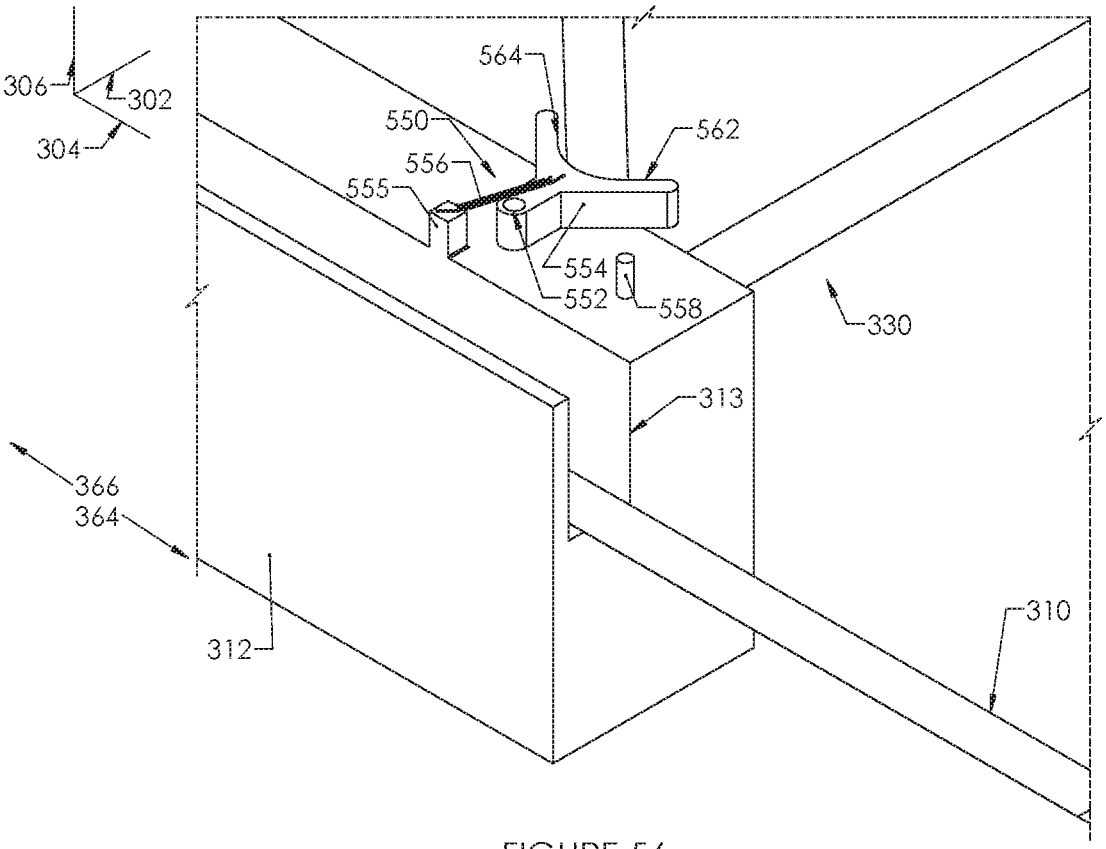
Figure 57:
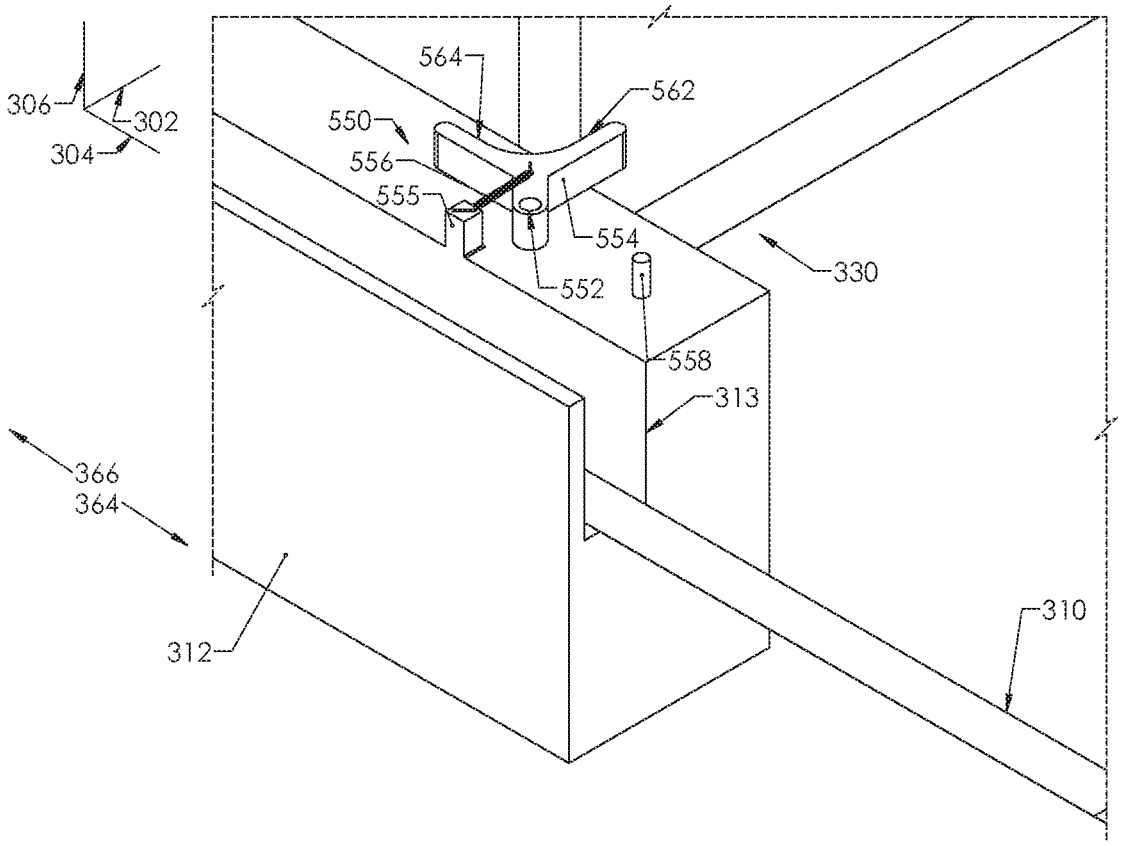

Referring to FIGS. 55-57, the over-center member 554 is repositionable between a held position, a center position, and an open position. It should be understood that the center position may or may not be directly centered between the held and open positions. In some embodiments, one or more of these positions correspond to the held, intermediate, and open positions of the rail-mount capture system 450. By way of example, the foot-mount capture system 550 may be placed such that the held positions of the rail-mount capture system 450 and the foot-mount capture system 550 correspond, but center and open positions occur at different rotational positions of the adjustable panel 330. Each of these positions also corresponds to a similarly named position of the adjustable panel 330. In FIG. 57, the over-center member 554 is in the held position. While in the held position, the panel 332 engages a capture surface 562 of the over-center member 554. In this position, the first attachment point and the second attachment point of the spring 556 are not positioned in line (i.e., are positioned out of alignment) with the axle 552. Accordingly, the spring 556 imparts a moment on the over-center member 554 in a first rotational direction (counterclockwise as shown in FIG. 57). This transfers a longitudinal force onto the panel 332, biasing the adjustable panel 330 to rotate such that the axle 338 moves in the first longitudinal direction 365. The rail-mount capture systems 450 and the foot-mount capture systems 550 impart forces on the adjustable panel 330 in opposing directions, a result of their being located opposite of each other about the axis of rotation 343 as seen in FIG. 1. In some embodiments, the adjustable panel 330 is prevented from rotating beyond the cafeteria configuration (e.g., by a stop that contacts the panel 332, etc.) and is effectively held in that position by the force of the spring 556 acting upon the over-center member 554 in the first rotational direction. Accordingly, the spring 556 holds the adjustable panel 330 in place until a threshold force is applied to the adjustable panel 330. This prevents the adjustable panel 330 from being moved out of the cafeteria configuration unintentionally, but does not lock the adjustable panel 330 in place.

Once a threshold force is applied to the adjustable panel 330 (e.g., in the first longitudinal direction 364 below the wrist systems 470, in a lifting direction), the moment imparted by the spring 556 is overcome, and the adjustable panel 330 rotates such that the axle 338 moves in the second longitudinal direction 366. As the adjustable panel 330 moves, the engagement between the panel 332 and the first engagement surface, shown as capture surface 562, of the over-center member 554 causes the over-center member 554 to rotate in a second rotational direction (clockwise as shown in FIG. 56). FIG. 56 shows the foot-mount capture system 550 in an intermediate position located between the held and open positions. As the adjustable panel 330 continues to move, the adjustable panel 330 eventually enters a center position, which corresponds to a center position of the foot-mount capture system 550. In the center position, the first attachment point and the second attachment point of the spring 556 are positioned in line with the axle 552 such that a straight line drawn between the first attachment point and the second attachment point intersects the axis of rotation of the over-center member 554. In this position, the spring 556 imparts a negligible moment effect on the over-center member 554.

If the axle 338 continues to rotate move in the second longitudinal direction 366, the first attachment point and the second attachment point again move out of alignment with the axle 552. However, the spring 556 is then positioned on the opposite side of the axle 552 such that the spring 556 imparts a moment on the over-center member 554 in the second rotational direction (clockwise as shown in FIG. 55). This moment forces a second engagement surface, shown as eject surface 564, of the over-center member 554 to engage the panel 332. This transfers a longitudinal force onto the panel 332, biasing the bottom portion of the adjustable panel 330 in the first longitudinal direction 364. The top of the adjustable panel 330 may then continue to be moved in the second longitudinal direction 366 until the over-center member 554 reaches the open position.

Referring to FIG. 55, the foot-mount capture system 550 is shown in the open position. In the open position, the over-center member 554 is rotated in the second rotational direction until the over-center member 554 engages the stop pin 558. Once the over-center member 554 engages the stop pin 558, the stop pin 558 prevents further rotation of the over-center member 554, and the spring 556 no longer biases the adjustable panel 330. The adjustable panel 330 may then continue to be rotated upwards and into a free position, shown in FIG. 55, where the panel 332 is no longer in contact with the over-center member 554. When the adjustable panel 330 is moved into the free position, the spring 556 holds the over-center member 554 in the open position until the panel 332 once again engages the eject surface 564. When the adjustable panel 330 is moved into the cafeteria configuration, the same sequence of events occurs, but in reverse.

To adjust the position of the adjustable panel 330, a user may impart a longitudinal force on the adjustable panel 330 (e.g., above the wrist systems 470), and/or the user may apply a lifting force to the adjustable panel 330 (e.g., below the wrist systems 470). Throughout at least a portion of the range of motion of the adjustable panel 330, the weight of the adjustable panel 330 biases the adjustable panel 330 toward the cafeteria configuration.

To move the top of the adjustable panel 330 in the second longitudinal direction 366, a user may simply lift upward on the bottom of the adjustable panel 330 or impart a force on the top of the adjustable panel 330 in the second longitudinal direction 366. When starting in the cafeteria configuration, the adjustable panel 330 may be held in place by some combination of the biasing forces of gravity and/or the rail-mount capture systems 450 and/or the wrist systems 470 and/or the foot-mount capture systems 550. In other embodiments, one or more of the rail-mount capture systems 450, the wrist systems 470, and the foot-mount capture systems 550 are omitted. As the adjustable panel 330 is moved toward the buffet configuration, all biasing forces are overcome by the user. Collectively, these biasing forces prevent the adjustable panel 330 from accidentally being moved out of the cafeteria configuration, but do not hinder the movement of the adjustable panel 330 once the adjustable panel 330 is a sufficient distance from the cafeteria configuration.

Figure 50:
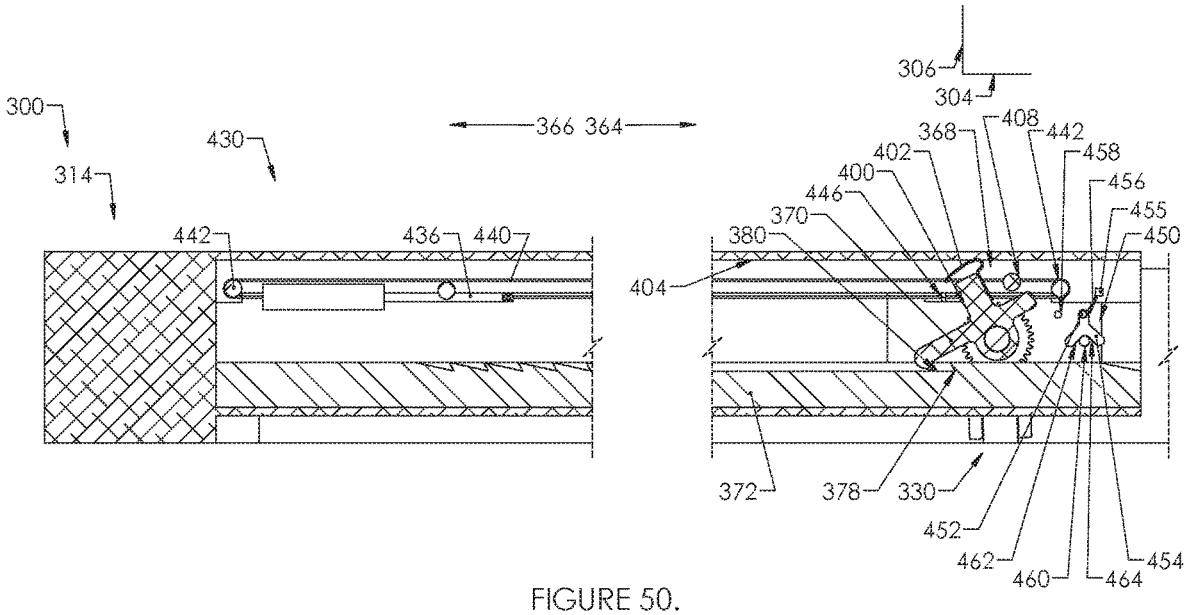
Figure 51:
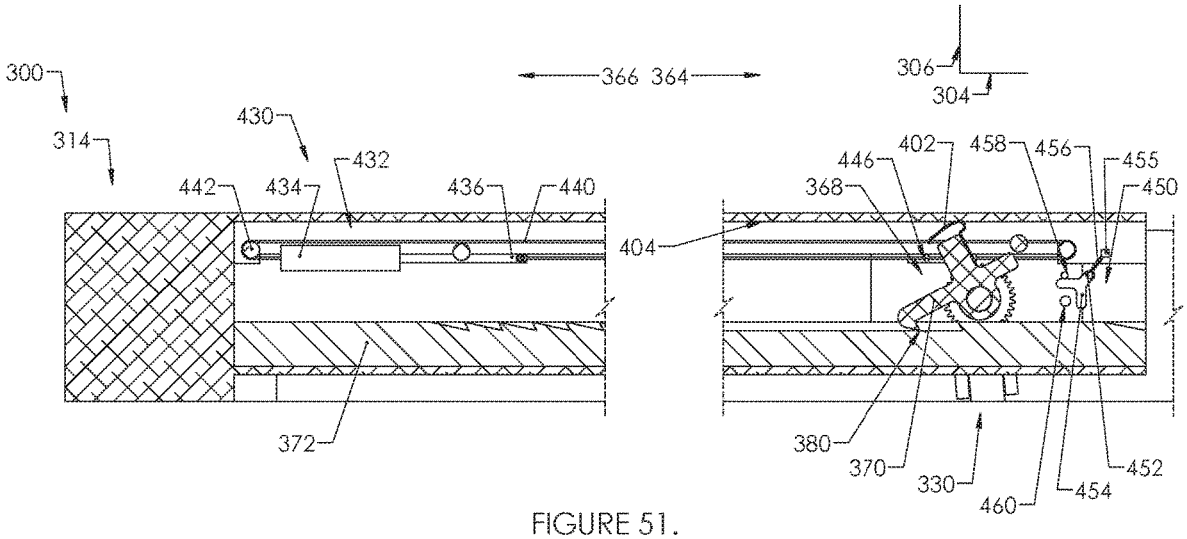

Referring to FIGS. 49-51, as the adjustable panel 330 moves toward the buffet configuration, the capture pin 460 of the rail-mount capture system 450 moves in the second longitudinal direction 366. This opposes the biasing force provided by the spring 456 until the rail-mount capture system 450 reaches the center position. At this point, the spring 456 rotates the over-center member 454 until the eject surface 464 engages the capture pin 460, and the spring 456 biases the capture pin 460 in the second longitudinal direction 366. Once the rail-mount capture system 450 reaches the open position, the stop pin 458 prevents further rotation of the over-center member 454, and the rail-mount capture system 450 no longer affects the movement of the adjustable panel 330.

Referring to FIGS. 20-22, as the adjustable panel 330 moves toward the buffet configuration, the adjustable panel 330 rotates the wrist body 476 of each wrist system 470. This rotates the plungers 496 out of their biased rotational positions. Specifically, this movement moves the plungers 496 up the ramps 502. While the plungers 496 contact the ramps 502, the user overcomes the biasing torque provided by the spring 494 pushing against the ramp 502. Once the adjustable panel 330 is rotated a sufficient distance, the plungers 496 engage the flat surface 506, and the springs 494 no longer impart a biasing torque on the adjustable panel 330.

Referring to FIGS. 55-57, as the adjustable panel 330 moves toward the buffet configuration, the panel 332 rotates the over-center member 554 of the foot-mount capture system 550. This opposes the biasing force provided by the spring 556 until the foot-mount capture system 550 reaches the center position. At this point, the spring 556 rotates the over-center member 554 until the eject surface 564 engages the panel 332, and the spring 456 biases the adjustable panel 330 to rotate such that the axle 338 travels in the second longitudinal direction 366. Once the foot-mount capture system 550 reaches the open position, the stop pin 558 prevents further rotation of the over-center member 554, and the foot-mount capture system 550 no longer affects the movement of the adjustable panel 330.

Figure 38:
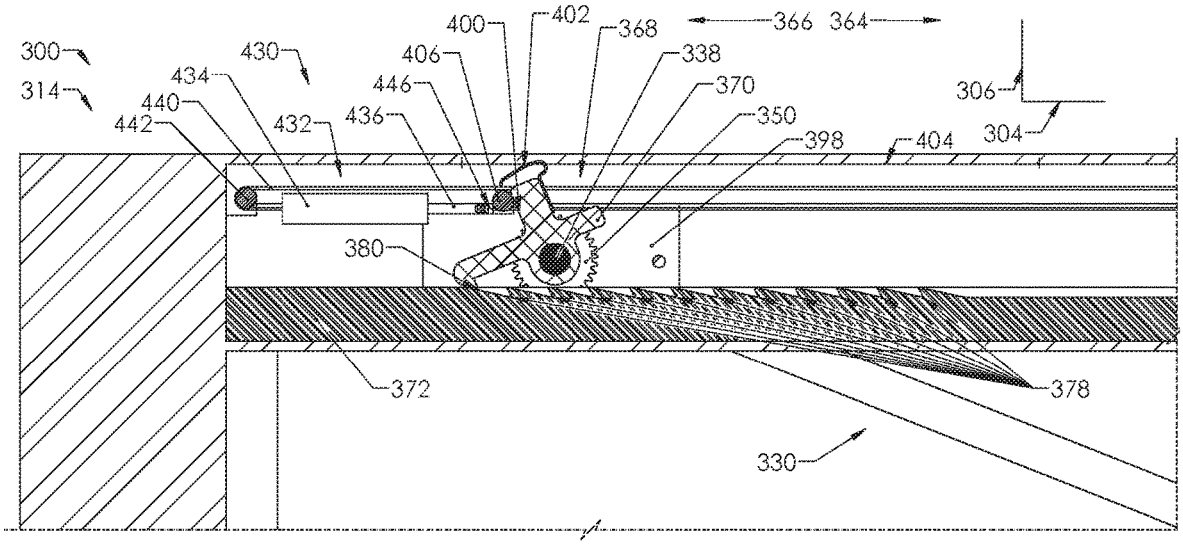

Referring to FIGS. 49-51, then to FIG. 36, the user may then move the adjustable panel 330 until the pawl 370 engages the tooth 378 of the rack 372 within the buffet zone 391. At this point, the adjustment mechanism 368 holds the adjustable panel 330 in place, and the user may release the adjustable panel 330 without the adjustable panel 330 falling. The user may continue to lift upward on the bottom of the adjustable panel 330, for example, to adjust the adjustable panel 330 to have a shallower angle 395 such that the pawl 370 engages the teeth 378 of the loading zone 390. As shown in FIGS. 37-39, as the pawl 370 nears the end of the loading zone 390, the follower 446 engages the rod 436 of the snubber 432. This imparts a damping force on the adjustable panel 330 that opposes further movement of the adjustable panel 330 in the second longitudinal direction 366. This also causes the cable 440 to move the ferrule 444 in the second longitudinal direction 366. This damping force alerts the user that the adjustable panel 330 is nearing the end of its travel. If the user continues to move the adjustable panel 330 in the second longitudinal direction 366, the leg 400 engages the pawl deactivation pin 406, and the pawl 370 is moved from the activated position to the deactivated position. The spring 402 then holds the pawl 370 in the deactivated position, and the adjustable panel 330 may be moved freely throughout its longitudinal range of travel in both the first longitudinal direction 364 and the second longitudinal direction 366.

The adjustable panel 330 may then be moved by the user toward the cafeteria configuration. Referring to FIGS. 45-49, as the adjustable panel 330 nears the cafeteria configuration, the follower 446 engages the ferrule 444. A damping force from the snubber 432 is transferred to the adjustable panel 330 through the cable 440, the follower 446, and the cover 398. This damping force opposes lowering of the adjustable panel 330. Accordingly, this damping force facilitates a controlled lowering of the adjustable panel 330, preventing damage that might otherwise result from lowering the adjustable panel 330 quickly. As the adjustable panel 330 moves closer to the cafeteria configuration, the pawl activation pin 408 engages the leg 400, which in turn rotates the pawl 370 back into the activated position.

Once the adjustable panel 330 is near the cafeteria configuration, the biasing forces of the rail-mount capture systems 450 and/or the wrist systems 470 and/or the foot-mount capture systems 550 begin to bias the adjustable panel 330 toward the cafeteria configuration. These biasing forces assist the user in lowering the adjustable panel 330 and oppose the damping force provided by the damping assembly 430.

Referring to FIGS. 46-49, as the adjustable panel 330 moves toward the cafeteria configuration, the capture pin 460 of the rail-mount capture system 450 moves in the first longitudinal direction 364. The capture pin 460 engages the eject surface 464 of the over-center member 454 and moves the rail-mount capture system 450 toward the held position. Initially, the biasing force of the spring 456 opposes this movement. However, the attachment points of the spring 456 may be positioned such that the center position of the rail-mount capture system 450 is near the open position, minimizing the movement of the adjustable panel 330 that is opposed by the spring 456. As the rail-mount capture system 450 reaches the center position, the spring 456 rotates the over-center member 454 until the capture surface 462 engages the capture pin 460, and the spring 456 biases the capture pin 460 in the first longitudinal direction 364. Once the adjustable panel 330 reaches the cafeteria configuration, the spring 456 holds the adjustable panel 330 in place.

Referring to FIGS. 20-22, as the adjustable panel 330 moves toward the cafeteria configuration, the adjustable panel 330 rotates the wrist body 476 of each wrist system 470. This rotates the plungers 496 into the pockets 500 and toward their biased rotational positions. Specifically, this movement moves the plungers 496 into engagement with the ramps 502. While the plungers 496 contact the ramps 502, the spring 494 provides a biasing force to bias the plungers 496 towards the depressions 504. Once the plungers 496 reach the depressions 504, the springs 494 hold the adjustable panel 330 in the cafeteria configuration.

Referring to FIGS. 54-57, as the adjustable panel 330 moves toward the cafeteria configuration, the panel 332 engages the eject surface 564 of the over-center member 554, moving the foot-mount capture system 550 toward the held position. Initially, the biasing force of the spring 556 opposes this movement. However, the attachment points of the spring 556 may be positioned such that the center position of the foot-mount capture system 550 is near the open position, minimizing the movement of the adjustable panel 330 that is opposed by the spring 556. As the foot-mount capture system 550 reaches the center position, the spring 556 rotates the over-center member 554 until the capture surface 562 engages the panel 332, and the spring 556 biases the adjustable panel 330 toward the cafeteria configuration. Once the adjustable panel 330 reaches the cafeteria configuration, the spring 556 holds the adjustable panel 330 in place.

Referring to FIGS. 59-67, an assembly, shown as guide rail system 514, is an alternative to the guide rail system 314. The guide rail system 514 may be substantially similar to the guide rail system 314 except as described herein. The guide rail system 514 may include the gear 350 and the rack gear 352 or another load bearing element that supports the weight of the adjustable panel 330. The guide rail system 514 includes a front panel adjustment mechanism, shown as adjustment mechanism 568. The adjustment mechanism 568 is contained within a base member or track, shown as frame rail 515.

Figure 58:
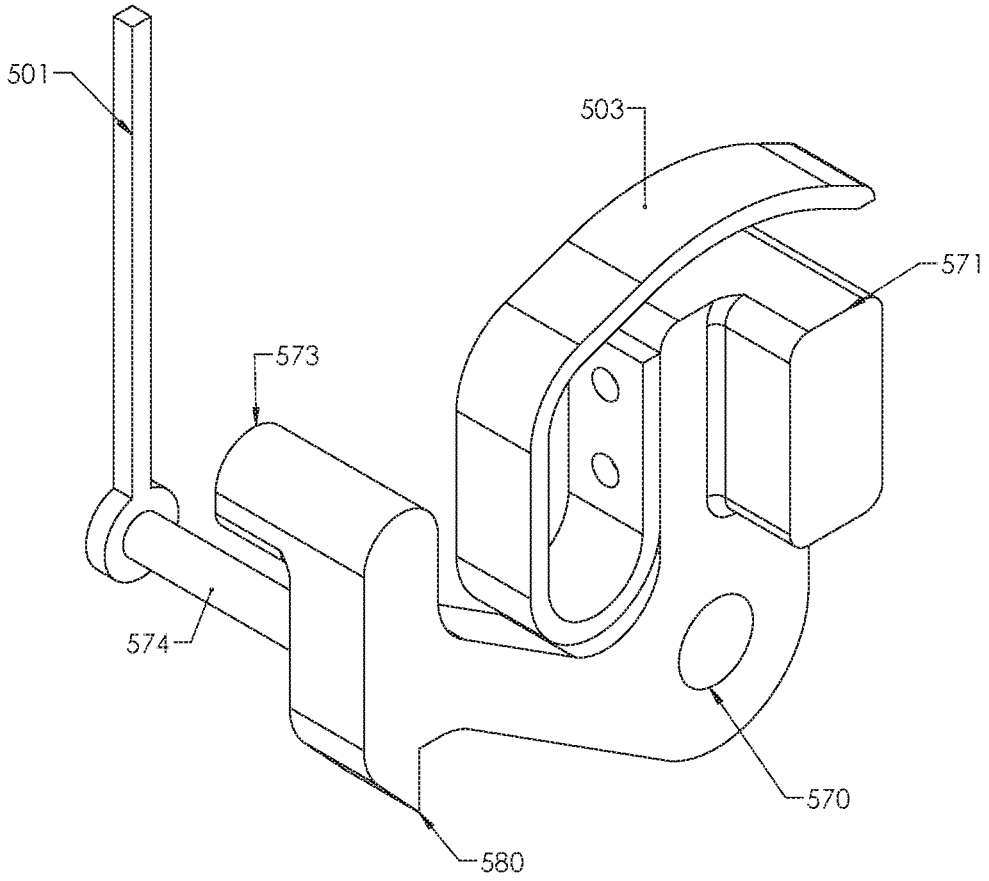
FIG. 58 is a perspective view of a pawl of a guide rail system for a breath guard, according to an exemplary embodiment.
Figure 59:
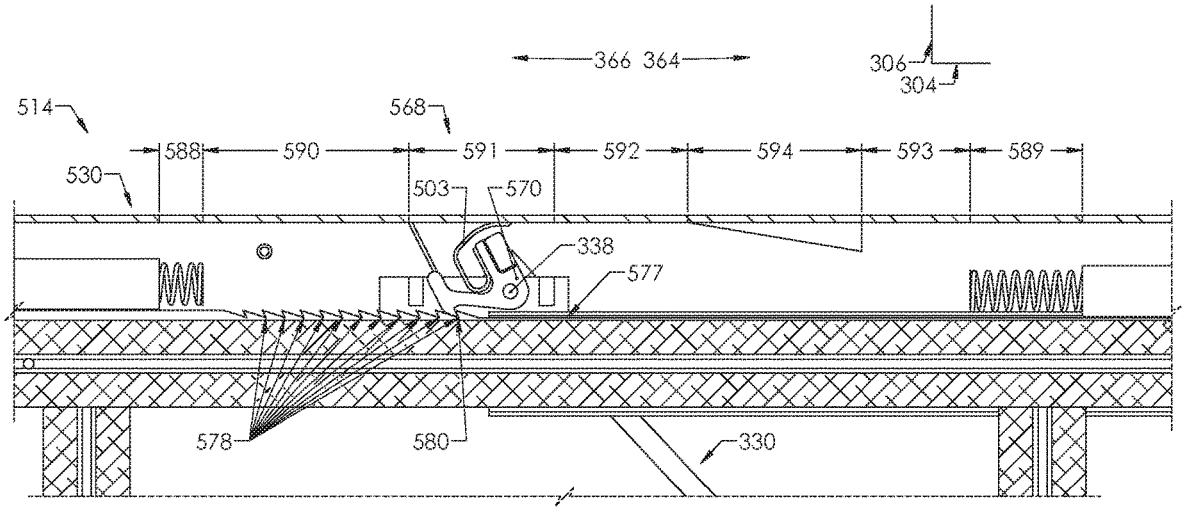
FIGS. 59-67 are side section views of the guide rail system of FIG. 58.

Referring to FIGS. 58-67, the adjustment mechanism 568 includes a pawl 570 configured to selectively prevent longitudinal movement of the adjustable panel 330 in the first longitudinal direction 364. The pawl 570 is rotatably coupled to the adjustable panel 330. Specifically, as shown in FIG. 59, the pawl 570 is configured to rotate about the axle 338. In other embodiments, the axis of rotation of the pawl 570 is offset from the axis of rotation 342. By way of example, the pawl 570 may be configured to rotate about a fastener that is coupled to the cover 398.

As shown in FIG. 58, the pawl 570 includes various features that are each positioned within at least one of four laterally offset planes. Laterally offsetting different features permits those features interacting with other components of the adjustment mechanism 568 without interfering with one another. In other embodiments, the placement of the features within each plane is varied. In the first plane, which is shown furthest to the right in FIG. 58, the pawl 570 includes a boss or protrusion, shown as deactivation boss 571. The second plane, which is shown to the left of the first plane in FIG. 58, includes the main body of the pawl 570. The main body defines an aperture that receives the axle 338, rotatably coupling the pawl 570 to the adjustable panel 330. The main body also defines a tooth 580. The tooth 580 is configured to selectively engage a rack 577 that defines a series of teeth 578. When the tooth 580 engages one of the teeth 578, the pawl 570 prevents longitudinal movement of the adjustable panel 330 in the first longitudinal direction 364. The rack 577 is fixedly coupled (e.g., welded, fastened, integrally formed, etc.) to the frame rail 515. The main body is coupled to a biasing member, shown as spring 503, that is positioned within the second plane. Positioning the spring 503 in the second plane minimizes any moment loading of the spring 503 on the main body about a longitudinal or vertical axis. The third plane, which is shown to the left of the second plane in FIG. 58, includes a boss or protrusion, shown as rest boss or activation boss 573. The fourth plane, which is shown to the left of the third plane in FIG. 58, includes an indicator, shown as safety flag 501. The deactivation boss 571 and the activation boss 573 are positioned on opposite sides of one another such to center the weight distribution of the pawl 570 on the main body. A spacer or coupler, shown as safety flag mount 574, extends laterally between and fixedly couples the safety flag 501 and the main body of the pawl 570. The main body of the pawl 570, the tooth 580, the deactivation boss 571, the activation boss 573, the safety flag mount 574, and the safety flag 501 are all coupled (e.g., fastened, welded, integrally formed, etc.) to one another.

Figure 63:
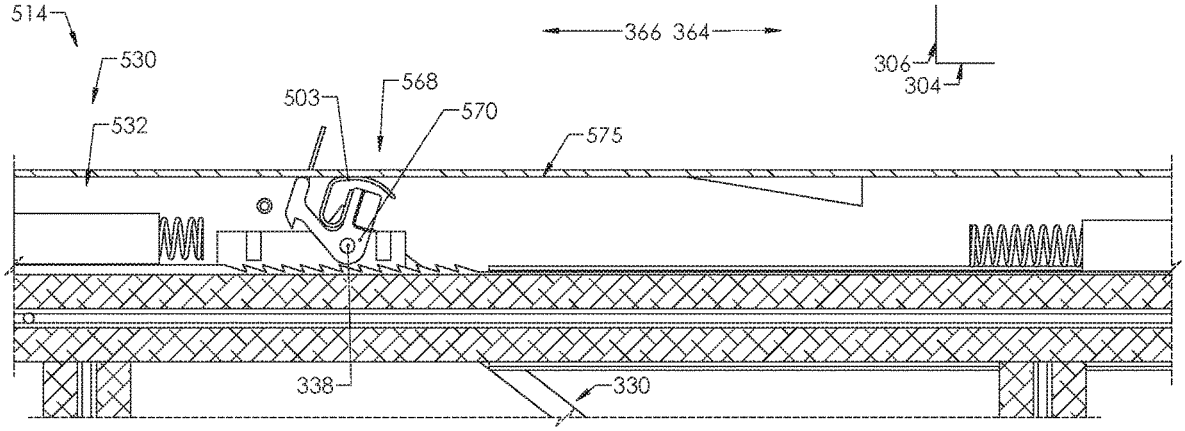
Figure 64:
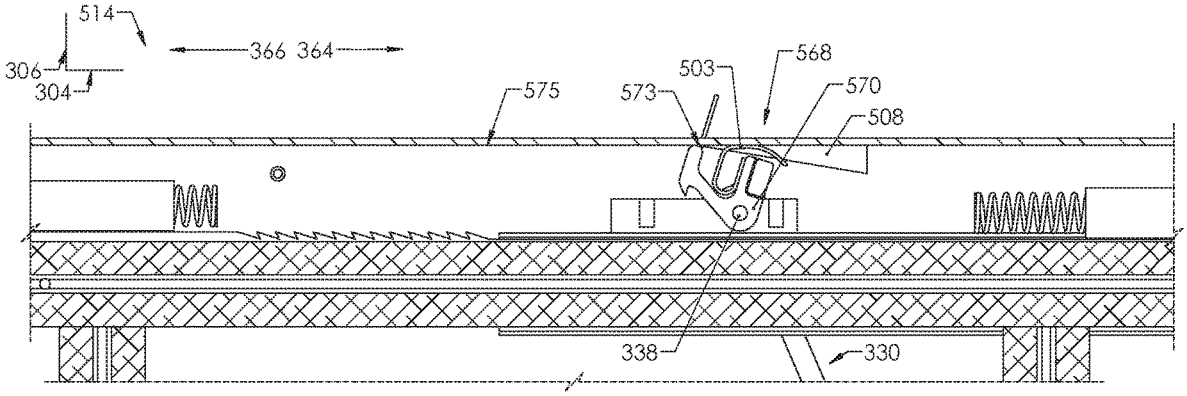
Figure 65:
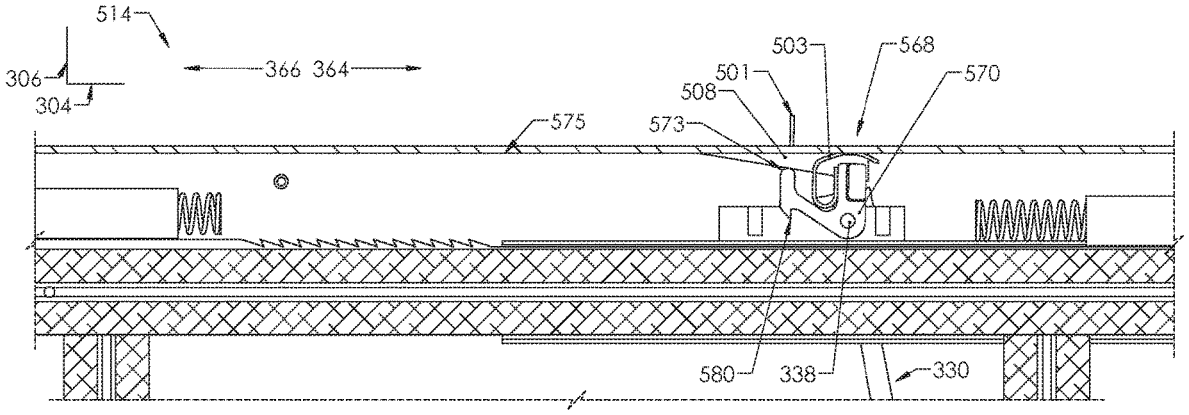

The pawl 570 is selectively reconfigurable between an engaged or activated position, shown in FIG. 59, and a disengaged or deactivated position, shown in FIG. 63. In the activated position, the tooth 580 engages the rack 577 such that the tooth 580 is configured to engage the teeth 578 in certain longitudinal positions of the adjustable panel 330. In the activated position, the center of gravity of the pawl 570 biases the pawl 570 to rotate in a first rotational direction (e.g., counterclockwise as shown in FIG. 59), such that the tooth 580 is biased into engagement with the rack 577. Additionally, the spring 503 engages an inner surface 575 of the frame rail 515, biasing the pawl 570 in the first rotational direction. The spring 503 is sufficiently lubricious that the adjustable panel 330 can translate longitudinally without friction between the spring 503 and the inner surface 575 changing the orientation of the pawl 570. In the deactivated position, the tooth 580 is rotated away from the rack 577 such that the tooth 580 does not engage the teeth 578 and the pawl 570 is free to translate in both the first longitudinal direction 364 and the second longitudinal direction 366. The center of gravity of the pawl 570 may be positioned to bias the pawl 570 to stay in the deactivated position when in the deactivated position and/or to stay in the activated position when in the activated position.

Referring to FIG. 59, the pawls 570 are configured to move longitudinally through a series of zones. Specifically, proceeding along the frame rail 515 in the first longitudinal direction 364, the pawls 570 travel through: a rear logic switch zone 588, a cleaning or loading zone 590, a buffet zone 591, a transition zone 592, a mechanism activation zone 594, a cafeteria zone 593, and an over-travel zone 589.

Referring to FIG. 59, the pawl 570 is in the activated position and within the buffet zone 591. The tooth 580 engages the tooth 578 that is farthest in the first longitudinal direction 364, retaining the adjustable panel 330 in the buffet configuration. A force may be applied by the user to the adjustable panel 330 (e.g., a longitudinal force, a lifting force, etc.), moving the adjustable in the second longitudinal direction 366 and into the loading zone 590. As the adjustable panel 330 moves, the tooth 380 engages different teeth 378 throughout the loading zone 390, retaining the adjustable panel 330 in various loading orientations.

Figure 60:
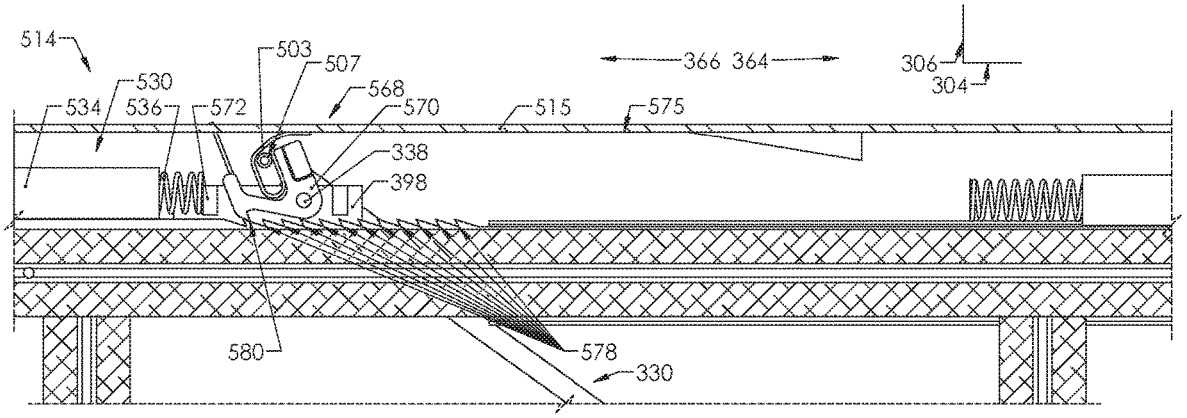

Referring to FIG. 60, the guide rail system 514 includes a damping system or damping assembly, the damping assembly including a damper assembly or mechanism deactivation snubber, shown as deactivation snubber 530. The deactivation snubber 530 includes a main body, shown as body 534 that is coupled (e.g., fastened, welded, etc.) to the frame rail 515. A biasing member, shown as spring 536, is coupled to the body 534 and extends longitudinally from the body 534 toward the pawl 570. A pair of bosses or protrusions, shown as snubber plates 572, are coupled to the cover 398 on opposite sides of the pawl 570. As shown in FIG. 60, when the pawl 570 nears the end of the loading zone 590, one of the snubber plates 572 engages the spring 536. If the adjustable panel 330 continues in the second longitudinal direction 366, the snubber plate 572 deforms (e.g., compresses) the spring 536, introducing a damping or biasing force onto the adjustable panel 330 in the first longitudinal direction 364. This absorbs any momentum of the adjustable panel 330 and warns the user that the adjustable panel 330 is reaching the end of its travel. This warning occurs while in the loading zone 590 such that the user may release the adjustable panel 330 and have one of the teeth 578 engage the tooth 580 to support the adjustable panel 330.

Figure 61:
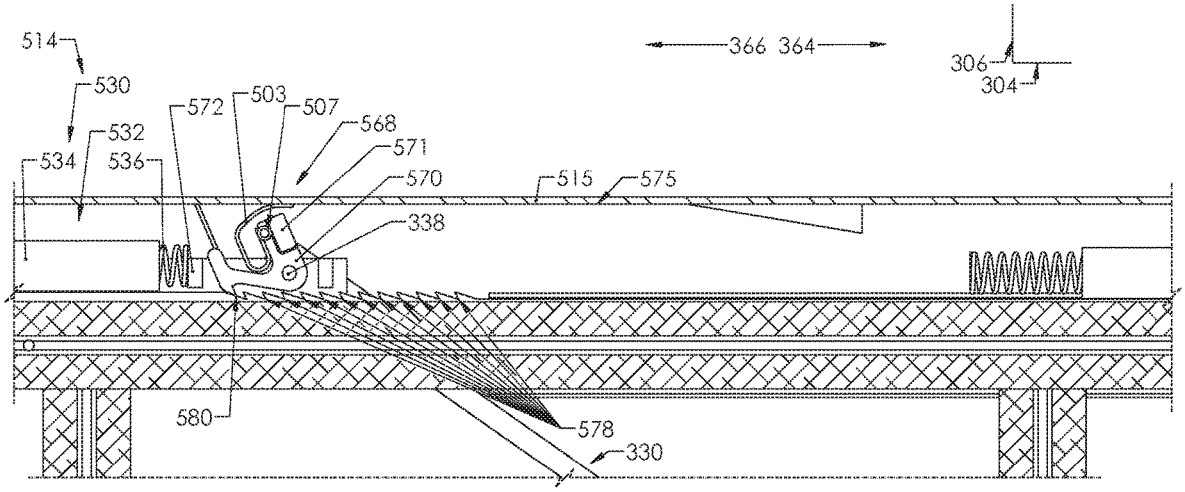
Figure 62:
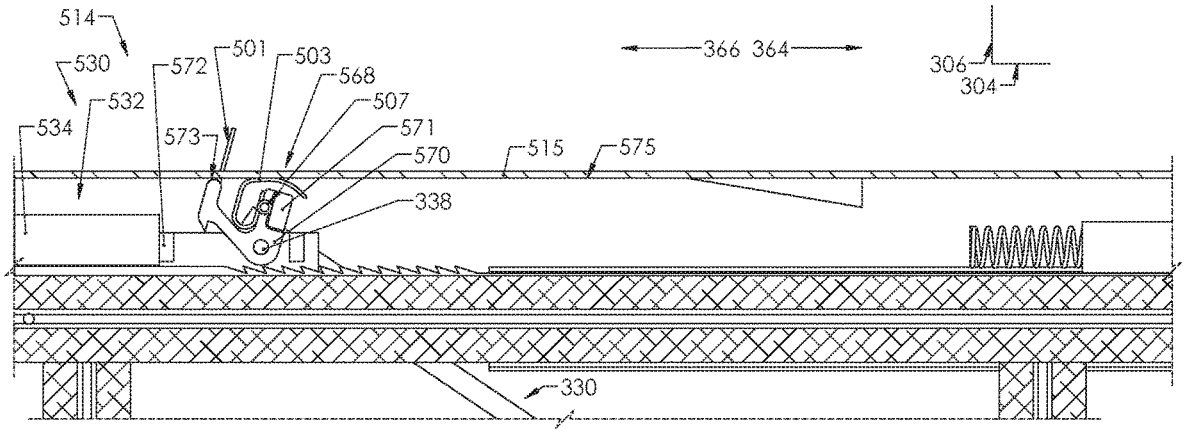

Referring to FIGS. 61 and 62, as the spring 536 is compressed, the pawl 570 enters the rear logic switch zone 588. In this zone, a logic resetting protrusion or boss, shown as pawl deactivation pin 507, engages the deactivation boss 571. As the user forces the adjustable panel 330 in the second longitudinal direction 366, the pawl deactivation pin 507 pushes the deactivation boss 571 in the first longitudinal direction 364, imparting a moment on the pawl 570 in the second rotational direction. This movement overcomes the biasing forces of gravity and the spring 503 on the pawl 570, forcing the spring 503 beyond a center position and forcing the pawl 570 into the deactivated position. Once in the deactivated position, the spring 503 presses against the inner surface 575 to bias the tooth 580 away from the rack 577. This forces the activation boss 573 into engagement with the inner surface 575, holding the pawl 570 in the deactivated position. The safety flag 501 may be positioned within the frame rail 515 or may be positioned outside of the frame rail 515 (e.g., between the frame rails 515). In the activated position of the pawl 570, the safety flag 501 is partially or completely obscured by the frame rail 515. In the deactivated position, the safety flag 501 extends above the top surface of the frame rail 515 and is visible. The frame rail 515 may define a slot through which the safety flag 501 can extend. When visible, the safety flag 501 warns the user that the pawl 570 is in the deactivated position and the adjustable panel 330 can move freely in the first longitudinal direction 364. When the spring 536 is fully compressed, the snubber plate 572 engages the body 534, acting as a hard stop for the adjustable panel 330 in the second longitudinal direction 366.

Referring to FIGS. 63-66, with the pawl 570 in the deactivated position, the adjustable panel 330 is free to move throughout the loading zone 590, the buffet zone 591, and the transition zone 592. Upon entering the mechanism activation zone 594, however, the activation boss 573 engages a sloped logic resetting protrusion or boss, shown as pawl activation ramp 508. The pawl activation ramp 508 is coupled to the frame rail 515 and extends downward from the inner surface 575 in alignment with the activation boss 573. As the activation boss 573 moves across the pawl activation ramp 508, the sloped surface of the pawl activation ramp 508 forces the activation boss 573 downward, imparting a moment on the pawl 570 in the first rotational direction. This force overcomes the biasing force of the spring 503, forcing the spring 503 beyond its center position and forcing the pawl 570 back into the activated position. This lowers the safety flag 501, indicating to the user that the adjustment mechanism 568 has been activated. In other embodiments, the longitudinal position of the pawl activation ramp 508 is varied to adjust when the pawl 570 is returned to the activation position.

Figure 66:
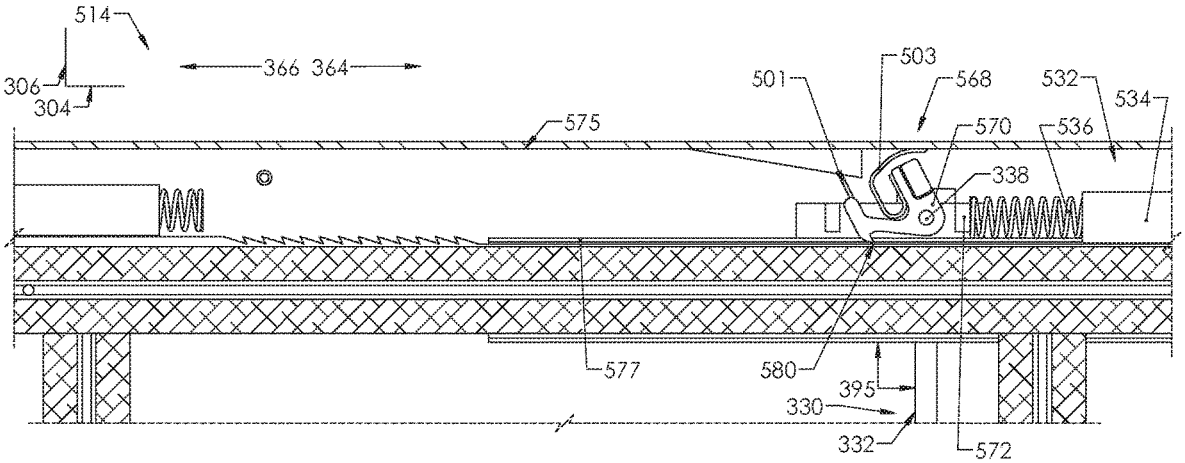
Figure 67:
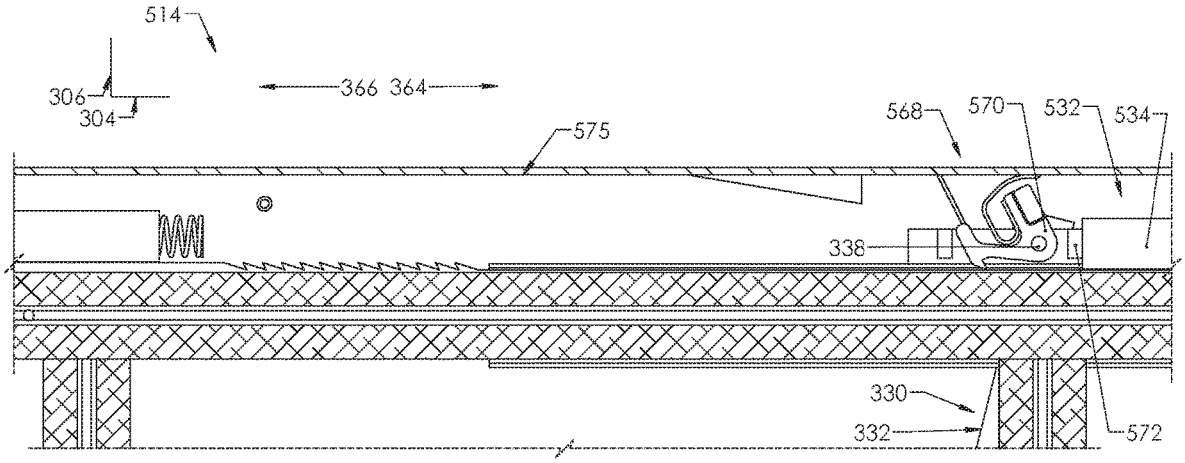

Referring to FIG. 66, after the pawl 370 passes the mechanism activation zone 594, the pawl 570 enters the cafeteria zone 593 and is held in the cafeteria configuration. The damping assembly of the guide rail system 514 includes a damper assembly, shown as over-travel snubber 532. The over-travel snubber 532 includes a main body, shown as body 534, that is coupled (e.g., fastened, welded, etc.) to the frame rail 515. A biasing member, shown as spring 536, is coupled to the body 534 and extends longitudinally from the body 534 toward the pawl 570. The spring 536 engages one of the snubber plates 572. The spring 536 may be sized such that, when the adjustable panel 330 is in the cafeteria configuration, the spring 536 engages the snubber plate 572 but applies a negligible biasing force. Alternatively, the spring 536 may be partially compressed, applying a relatively small biasing force on the adjustable panel 330 to retain the adjustable panel 330 in the cafeteria configuration. Referring to FIG. 67, if the pawl 570 extends into the over-travel zone 589, the spring 536 will apply a damping or biasing force that biases the adjustable panel 330 back into the cafeteria configuration. This may help absorb and dissipate any momentum from the effect of gravity on the adjustable panel 330 without causing any damage to the adjustable panel 330 or the guide rail systems 514. Between the biasing force of the spring 536 and the effect of gravity on the adjustable panel 330, the adjustable panel 330 is automatically biased into the cafeteria configuration. Additionally, when near the cafeteria configuration (e.g., on either side of the cafeteria configuration), the wrist systems 470 and/or the wrist systems 520 may be configured to bias the adjustable panel 330 into the cafeteria configuration. The biasing torque of the wrist systems 470 and/or the wrist systems 520 may be greater than that of the spring 536 such that the wrist systems 470 and/or the wrist systems 520 compress the spring 536 when in the cafeteria configuration. At the end of the longitudinal travel of the adjustable panel 330, the spring 536 is fully compressed and the snubber plate 572 engages the body 534, acting as a hard stop for the adjustable panel 330 in the first longitudinal direction 364.

Figure 68:
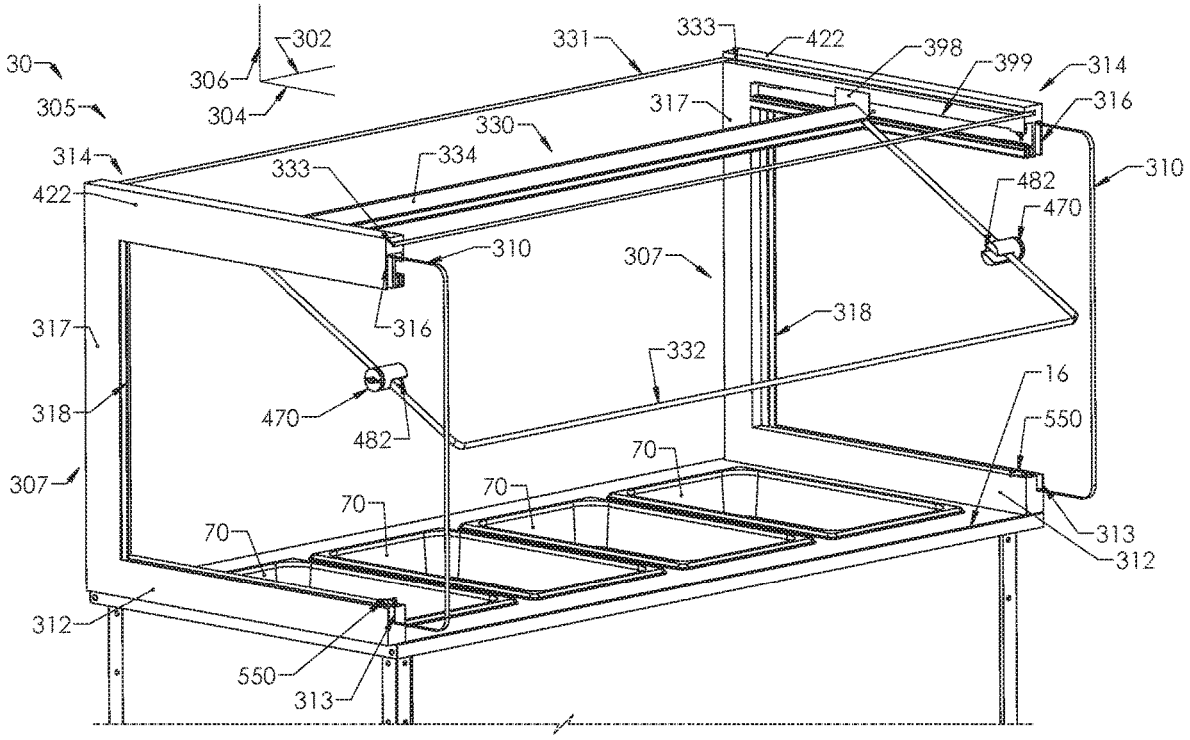
FIG. 68 is a perspective view of a food display system including a breath guard, according to another exemplary embodiment.

Referring to FIG. 68, a breath guard 305 is shown as an alternative embodiment to the breath guard 300 with the adjustable panel 330 in the buffet configuration. The breath guard 305 may be substantially similar to the breath guard 300, except the breath guard 305 includes a panel, shown as shelf panel 331, that extends along a top surface of the breath guard 305. The shelf panel 331 may be made from a material that is substantially similar to that of the side panels 310. The shelf panel 331 prevents debris from reaching the food pans 70 from above the breath guard 305 and may increase the strength of the breath guard 305. The shelf panel 331 may additionally provide storage. In the breath guard 305, the frame rails 315 of the breath guard 300 are replaced with frame rails 422. The frame rails 422 are substantially similar to the frame rails 315 except the frame rails 422 each define a longitudinally extending slot, groove, or recess, shown as shelf slot 333. The shelf slot 333 extends laterally inward to receive the shelf panel 331, coupling the shelf panel 331 to the frame rails 422. In other embodiments, the shelf panel 331 is otherwise coupled to the frame rails 422 (e.g., with fasteners, with adhesive, etc.). The frame rails 422 may be selectively fixedly coupled to the shelf panel 331 (e.g., with a set screw) such that, when attached, the shelf panel 331 does not move relative to the side frame assemblies 307 and transfers loads between the side frame assemblies 607. Alternatively, the shelf panel 331 may be slidably coupled to the frame rails 422 such that the shelf panel 331 can be easily slid out of the shelf slots 333 to facilitate cleaning.

Figure 69:
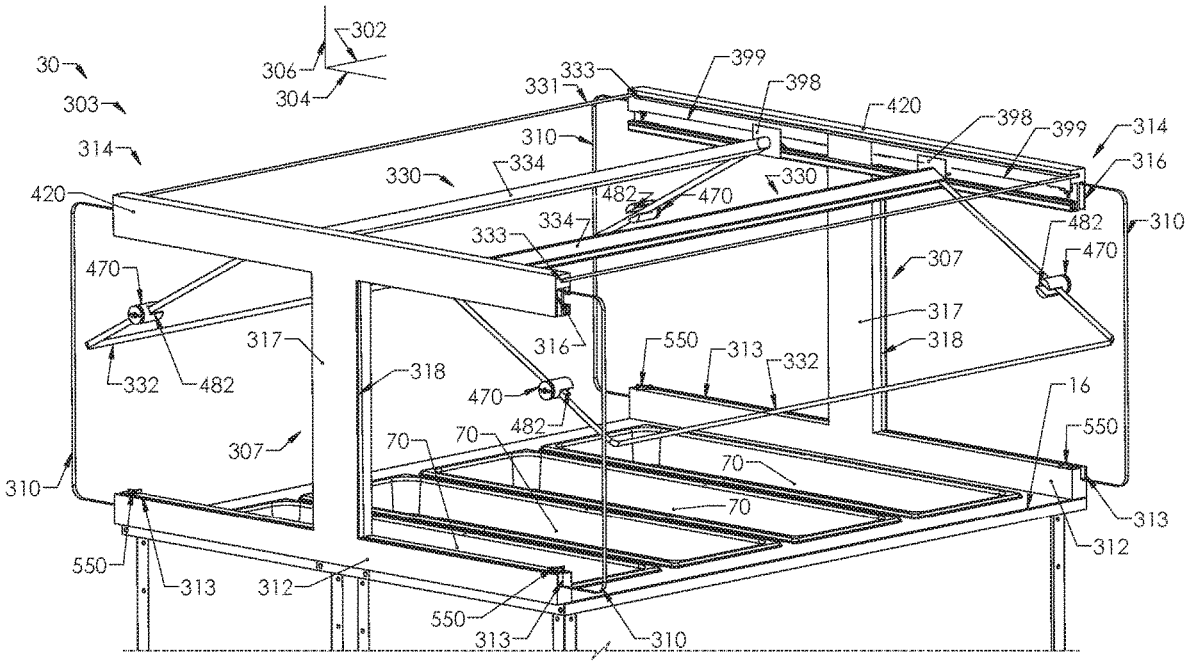
FIG. 69 is a perspective view of a food display system including a breath guard, according to yet another exemplary embodiment.

Referring to FIG. 69, a double-sided breath guard, shown as breath guard 303, is an alternative embodiment to the breath guard 305 and includes a pair of adjustable panels 330 each in the buffet configuration. The breath guard 303 may be substantially similar to the breath guard 300 except as described herein. The breath guard 303 includes a pair of adjustable panels 330, each disposed on an opposite longitudinal side of the system 30. This configuration may be useful in buffet scenarios where customers access the food pans 70 from both longitudinal sides (i.e., the front side and the back side) of the system 30. Accordingly, in some such embodiments, the breath guard 303 may be configured such that the adjustable panels 330 are only reconfigurable into a buffet configuration and not into a cafeteria configuration. However, such embodiments still facilitate adjustment of the orientation of the adjustable panels 330. The length of the adjustable panel 330 (e.g., outward from the axis of rotation 342) and the locations of the wrist systems 470 may be varied while still providing an effective buffet configuration.

Each side frame assembly 307 includes two guide rail systems 314, each facing opposite directions. In other embodiments, the guide rail systems 514 replace the guide rail systems 314. Both of the guide rail systems 314 are supported by a single spine 317. The spine 317 is supported by a bracket 312 that extends both forward and rearward from the spine 317 along the longitudinal axis 304. The guide rail systems 314 and the adjustable panels 330 may be shorter relative to embodiments that are reconfigurable into a cafeteria configuration. The guide rail systems 314 of each side frame assembly 307 share a frame rail, shown as double sided frame rail 420. The double sided frame rails 420 may each define a shelf slot 333, both of which cooperate to support a shelf panel 331. In some embodiments, the inclusion of the shelf panel 331 facilitates the breath guard 303 conforming with one or more regulations (e.g., NSF requirements).

Figure 70:
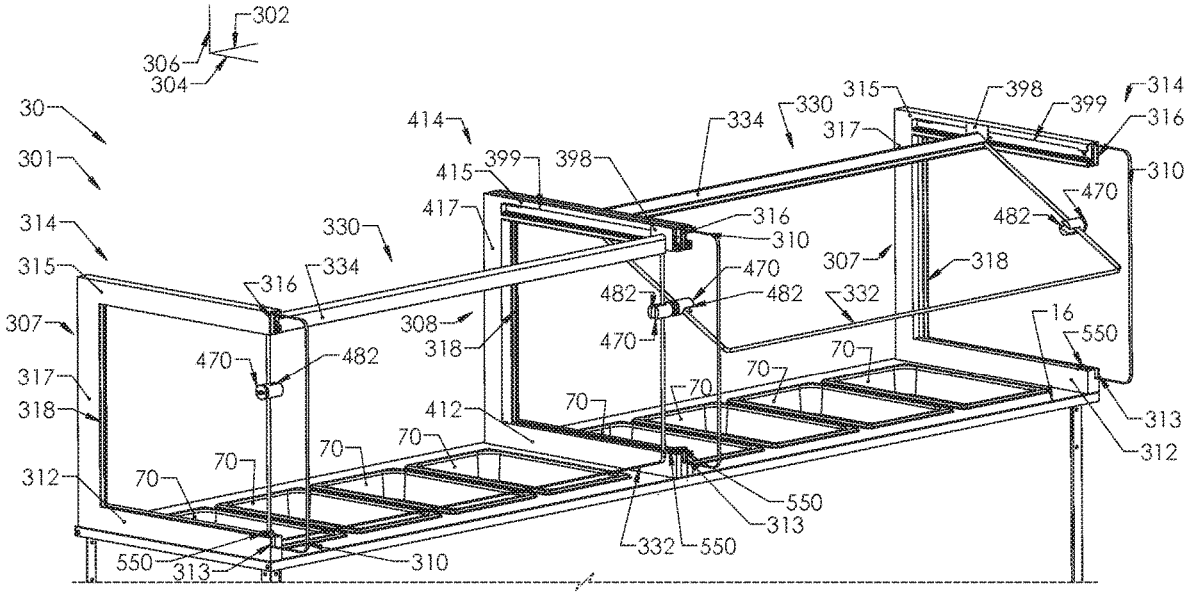
FIG. 70 is a perspective view of a food display system including a breath guard, according to yet another exemplary embodiment.

Referring to FIG. 70, a side-by-side breath guard system, shown as breath guard 301, is an alternative embodiment to the breath guard 300. The breath guard 301 may be substantially similar to the breath guard 300 except as described herein. The breath guard 301 includes two adjustable panels 330 positioned adjacent one another. One adjustable panel 330 is shown in the buffet configuration, and the other adjustable panel 330 is shown in the cafeteria configuration. The breath guard 301 may be used in a setting where many different food products are to be displayed simultaneously.

The breath guard 301 may serve a similar purpose to two breath guards 300 placed adjacent one another. However, instead of having two of the side frame assemblies 307 positioned directly adjacent one another, a center frame assembly 308 supports two of the adjustable panels 330, reducing the number of components and providing many operational benefits to the user. The center frame assembly 308 includes a bracket 412 and a spine 417. The guide rail system 314 is replaced with a side-by-side guide rail system 414 that includes a frame rail 415. The side-by-side guide rail system 414 includes two of the adjustment mechanisms 368, each of which operates independently and is coupled to a different one of the adjustable panels 330. To facilitate connections between the adjustment mechanisms 368 and the respective adjustable panels 330, the frame rail 415 defines two slide slots 399, each facing opposite directions. In other embodiments, the side-by-side guide rail system 414 includes components of the guide rail system 514 (e.g., a pair of the adjustment mechanisms 568, etc.). Additionally, two of the wrist systems 470 are coupled to the adjustment mechanism 368 through a side panel 310. The wrist systems 470 face in opposite directions and each receive one of the adjustable panels 330.

In other embodiments, the breath guard 301 is modified to include a pair of shelf panels 331, each of which are positioned above one of the adjustable panels 330. The shelf panels 331 may be coupled to the side frame assemblies 307 and the center frame assembly 308 as described with respect to FIG. 68. Additionally or alternatively, the breath guard 301 may be configured as a double-sided breath guard having two adjustable panels 330 on each longitudinal side of the system 30, similar to the breath guard 303 shown in FIG. 69. In some embodiments, a section of the breath guard 301 is configured as a double-sided breath guard and another section of the breath guard 301 is configured as a single-sided breath guard. In some embodiments, additional center frame assemblies 308 are added to the breath guard 301, and the breath guard 301 includes three or more sections, each including one or two adjustable panels 330, depending on if the section is configured as a double-sided breath guard or a single-sided breath guard. In any of the embodiments described herein, the breath guards may include features that facilitate attachment of various accessories, such as lights, heat lamps, and heat strips.

The system 30 and the system 10 may be made with various materials having properties suitable for the applications described herein. The system 30 and the system 10 may be made with food safe materials that are noncorrosive and nontoxic. The side panels 110, the side panels 310, the top panel 120, the shelf panel 331, the panel 132, and the panel 332 may be made with glass or another type of transparent material to facilitate a clear view of the food in the food pans 70 from outside of the corresponding breath guard. Alternatively, the side panels 110, the side panels 310, the top panel 120, the shelf panel 331, the panel 132, and the panel 332 may be opaque, translucent, or otherwise alter visibility therethrough (e.g., with a tint, with a mirror coating, etc.). In some embodiments, the side panels 110, the side panels 310, the top panel 120, the shelf panel 331, the panel 132, and/or the panel 332 are selectively reconfigurable between different levels of visibility (e.g., with a switchable color or darkness filter). The side panels 110, the side panels 310, the top panel 120, the shelf panel 331, the panel 132, and the panel 332 may all be removable to facilitate cleaning. The various structural members (e.g., the frame rail 315, the spine 417, the bracket 112, etc.) may be made from stainless steel, aluminum, composites, or another type of material that offers sufficient strength for the structure of the breath guard without the potential for corrosion.

The breath guards disclosed herein may be used as display cases for products other than food. By way of example, the display cases may be used to display jewelry, trading cards, electronics, firearms, tools, or other valuable items. The display cases would protect the products from being accessed by customers positioned in front of the display cases while still facilitating viewing of the products through the display cases. The display cases would facilitate access to the products by a shopkeeper or other operator positioned behind the display cases. The display cases may be selectively reconfigurable to selectively permit or prevent access by a customer to one or more products therein (e.g., by raising or lowering the adjustable panel 330). The various regulations and requirements described herein with respect to breath guards may not apply to the display cases.

The construction and arrangement of the apparatus, systems, and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, some elements shown as integrally formed may be constructed from multiple parts or elements, some elements shown as constructed from multiple parts or elements may be integrally formed, the position of elements may be reversed or otherwise varied, and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

References herein to the positions of elements (e.g., "top," "bottom," "above," "below," "upper," "lower," etc.) are merely used to describe the orientation of various elements as illustrated in the Figures. It should be noted that the orientation of various elements may differ according to other exemplary embodiments, and that such variations are intended to be encompassed by the present disclosure.

What is claimed is:

1. A breath guard for a food serving system, comprising:

a first support and a second support positioned laterally offset from one another;

a guide rail coupled to the first support and extending in a substantially longitudinal direction, the guide rail including a rack defining a plurality of teeth;

an adjustable panel extending between the first support and the second support, wherein the adjustable panel is rotatably and translatably coupled to the guide rail; and an adjustment mechanism including a pawl rotatably coupled to the adjustable panel and configured to selectively engage the teeth of the rack in a plurality of locations;

wherein the adjustable panel is rotatable relative to the guide rail about an axis of rotation that extends laterally;

wherein the adjustment mechanism is configured to prevent longitudinal movement of the adjustable panel relative to the guide rail in a first direction and allow longitudinal movement of the adjustable panel in a second direction opposite the first direction when the pawl engages the teeth of the rack, such that the adjustable panel is selectively repositionable between a plurality of longitudinal positions relative to the guide rail.

2. The breath guard of claim 1, wherein the adjustment mechanism includes a protrusion coupled to the pawl, and wherein the protrusion is configured such that the adjustable panel engages the protrusion to disengage the pawl from the rack when the adjustable panel is rotated upward.

3. The breath guard of claim 2, further comprising at least one of:

a first boss coupled to the first support and extending toward the second support; and a second boss coupled to the second support and extending toward the first support;

wherein the at least one of the first boss and the second boss are configured to support the adjustable panel, and wherein contact between the adjustable panel and the at least one of the first boss and the second boss causes angular positioning of the adjustable panel relative to the guide rail.

4. The breath guard of claim 3, wherein the adjustable panel rests on the at least one of the first boss and the second boss when the at least one of the first boss and the second boss supports the adjustable panel, and wherein the adjustable panel is configured to be lifted off of the at least one of the first boss and the second boss by a user.

5. The breath guard of claim 4, wherein the protrusion is positioned such that the adjustable panel does not disengage the pawl from the rack when the adjustable panel is supported by the at least one of the first boss and the second boss.

6. The breath guard of claim 1, wherein the guide rail is a first guide rail, further comprising a first gear, a second gear, a torsional member, and a second guide rail, wherein the second guide rail is coupled to the second support, wherein the first guide rail and the second guide rail include a first rack gear configured to engage the first gear and a second rack gear configured to engage the second gear, respectively, wherein the first gear and the second gear are rotatably coupled to the adjustable panel, and wherein the torsional member rotationally fixes the first gear relative to the second gear.

7. The breath guard of claim 1, wherein the pawl and the teeth of the rack are correspondingly shaped to prevent longitudinal movement of the adjustable panel in the first direction when the pawl engages the teeth, and wherein the pawl and the teeth of the rack are correspondingly shaped to allow longitudinal movement of the adjustable panel in the second direction when the pawl engages the rack.

8. The breath guard of claim 1, wherein the adjustable panel is selectively reconfigurable between a plurality of positions, the plurality of positions including an NSF cafeteria position and an NSF buffet position.

9. The breath guard of claim 1, wherein the adjustment mechanism is selectively reconfigurable between an activated position and a deactivated position, further comprising a logic resetting protrusion coupled to the guide rail;

wherein the adjustment mechanism is configured to engage the guide rail to prevent longitudinal movement of the adjustable panel relative to the guide rail in the first direction when the adjustment mechanism is in the activated position, wherein the adjustment mechanism is configured to allow longitudinal movement of the adjustable panel in the second direction opposite the first direction when the adjustment mechanism is in the activated position, and wherein the adjustment mechanism is configured to permit movement of the adjustable panel in both the first direction and the second direction when the adjustment mechanism is in the deactivated position; and wherein the logic resetting protrusion is configured to move the adjustment mechanism toward the deactivated position when the adjustment mechanism engages the logic resetting protrusion.

10. The breath guard of claim 9, wherein the logic resetting protrusion is a first logic resetting protrusion, further comprising a second logic resetting protrusion coupled to the guide rail and longitudinally offset from the first logic resetting protrusion, wherein the second logic resetting protrusion is configured to move the adjustment mechanism toward the activated position when the adjustment mechanism engages the second logic resetting protrusion.

11. The breath guard of claim 10, wherein the adjustment mechanism includes a biasing member configured to engage the guide rail;

wherein the adjustment mechanism is further selectively reconfigurable into a center position between the activated position and the deactivated position;

wherein the biasing member is configured to bias the adjustment mechanism toward the activated position when the adjustment mechanism is located between the activated position and the center position; and wherein the biasing member is configured to bias the adjustment mechanism toward the deactivated position when the adjustment mechanism is located between the deactivated position and the center position.

12. The breath guard of claim 11, wherein the pawl is coupled to the biasing member;

wherein the pawl is configured to engage at least one of the teeth when in the activated position;

wherein the first logic resetting protrusion is configured to rotate the pawl toward the deactivated position when the first logic resetting protrusion engages the pawl; and wherein the second logic resetting protrusion is configured to rotate the pawl toward the activated position when the second logic resetting protrusion engages the pawl.

13. The breath guard of claim 1, further comprising a wrist system, the wrist system including:

a base member coupled to one of the first support and the second support; and a wrist body rotatably coupled to the base member, the wrist body defining a slot that receives the adjustable panel;

wherein the wrist system is configured to support the adjustable panel, and wherein contact between the wrist system and the adjustable panel causes angular positioning of the adjustable panel relative to the guide rail.

14. The breath guard of claim 13, wherein the wrist system further includes:

a plunger translatably coupled to the wrist body; and a biasing member configured to bias the plunger toward the base member;

wherein the base member defines a depression configured to receive the plunger, and wherein the biasing member is configured to hold the plunger within the depression until a threshold torque is applied the wrist body, thereby holding limiting rotation of the adjustable panel until the threshold torque is applied to the wrist body.

15. The breath guard of claim 1, further comprising an over-center mechanism including:

an over-center member rotatably coupled to the first support, the over-center member defining a first engagement surface and a second engagement surface; and a biasing member coupled to the first support and the over-center member;

wherein the over-center member is selectively repositionable between an open position, a held position, and a center position, wherein the biasing member is configured to bias the over-center member toward the held position when the over-center member is between the center position and the held position, wherein the biasing member is configured to bias the over-center member toward the open position when the over-center member is between the center position and the open position, and wherein the over-center member is configured to resist movement of the adjustable panel when the over-center member is in the held position.

16. The breath guard of claim 1, further comprising:

a damping system including a snubber coupled to the guide rail;

wherein the adjustable panel is movable along a length of the guide rail within a longitudinal range, and wherein the snubber is configured to resist movement of the adjustable panel in the first direction when the adjustable panel is within a first portion of the longitudinal range.

17. The breath guard of claim 16, wherein the longitudinal range further includes a second portion and a third portion, wherein the second portion extends between the first portion and the third portion, and wherein the damping system is configured to resist movement of the adjustable panel in the second direction when the adjustable panel is within the third portion of the longitudinal range.

18. The breath guard of claim 17, wherein the damping system includes a cable coupled to the snubber, a ferrule coupled to the cable, and a follower coupled to the adjustable panel and configured to travel along the length of the cable, and wherein the follower is configured to engage at least one of the ferrule and the snubber to resist movement of the adjustable panel.

19. The breath guard of claim 17, wherein the snubber is a first snubber, wherein the damping system further includes a second snubber, and wherein the second snubber is configured to resist movement of the adjustable panel in the second direction when the adjustable panel is within the third portion of the longitudinal range.

20. The breath guard of claim 19, wherein the first snubber includes a body coupled to the guide rail and a biasing member coupled to the body, wherein the damping system includes a snubber plate coupled to the adjustable panel, wherein the snubber plate is configured to engage the biasing member when the adjustable panel is within the first portion of the longitudinal range to resist movement of the adjustable panel, and wherein the snubber plate is configured to engage the body of the first snubber when the adjustable panel is at an end of the longitudinal range to limit movement of the adjustable panel.

* * * * *